US005543259A

United States Patent [19]

Schwarz et al.

[11] Patent Number: 5,543,259

[45] Date of Patent: Aug. 6, 1996

[54] DEVELOPER COMPOSITIONS

[75] Inventors: William M. Schwarz, Webster; Timothy J. Fuller, West Henrietta, both of N.Y.

[73] Assignee: Xerox Corporation, Stamford, Conn.

[21] Appl. No.: 466,541

[22] Filed: Jun. 6, 1995

Related U.S. Application Data

[63] Continuation of Ser. No. 166,374, Dec. 13, 1993, abandoned.

[51] Int. Cl.[6] ..... G03G 9/09

[52] U.S. Cl. ..... 430/106; 430/901; 430/110; 430/115

[58] Field of Search ..... 430/106, 115, 430/110, 76

[56] References Cited

U.S. PATENT DOCUMENTS

| | | | |
|---|---|---|---|
| 3,909,259 | 9/1975 | Mammino et al. | 430/107 |
| 4,073,965 | 2/1978 | Mammino et al. | 430/106 |
| 4,284,782 | 8/1981 | Schmidt | 546/288 |
| 4,566,908 | 1/1986 | Nakatani et al. | 106/287.11 |
| 4,600,674 | 7/1986 | Emoto et al. | 430/72 |
| 4,701,389 | 10/1987 | Morimoto et al. | 430/110 |
| 4,734,349 | 3/1988 | Champman et al. | 430/106 |
| 4,822,710 | 4/1989 | Croucher et al. | 430/115 |
| 4,988,594 | 1/1991 | Hattori et al. | 430/59 |
| 5,030,535 | 7/1991 | Drappel et al. | 430/116 |

FOREIGN PATENT DOCUMENTS

| | | | |
|---|---|---|---|
| 60-108863 | 6/1985 | Japan | 430/106 |
| 60-153053 | 8/1985 | Japan | 430/106 |
| 62-071966 | 4/1987 | Japan | 430/106 |
| 62-147465 | 7/1987 | Japan | 430/106 |
| 1-231062 | 9/1989 | Japan | 430/106 |
| 2-051166 | 2/1990 | Japan | 430/106 |
| 309468 | 11/1990 | Japan . | |
| 3-42676 | 2/1991 | Japan | 430/106 |
| 04180968 | 6/1992 | Japan . | |
| 5-142863 | 6/1993 | Japan | 430/106 |
| 81522 | 4/1983 | Romania | 430/106 |

OTHER PUBLICATIONS

Chemical Abstracts, Resistry, "C.I. 12700", C.I. Solvent Yellow 16 (1994).

*Xerox Disclosure Journal,* vol. 1, No. 3, pp. 37–38, 1978.

Xerox Disclosure Journal, vol. 3, No. 1 pp. 37–38 Jan.–Feb. 1978.

ACS copyright 1994—Chemical Abstracts Registry "CI 12700"–CI Solvent Yellow 16.

Polymer Science Dictionary, M. Alger, Elsevier Science Publishers Ltd., Essex, England, pp. 355–356(1989).

*Primary Examiner*—Christopher D. Rodee

*Attorney, Agent, or Firm*—Byorick Judith L.

[57] ABSTRACT

Disclosed are dry and liquid developers suitable for the development of electrostatic latent images. The developers contain a colorant selected from the group consisting of: (a) those of Formula I

I wherein $R_1$ is an electron withdrawing group, $R_2$ is selected from the group consisting of hydrogen, alkyl, substituted alkyl, aryl, substituted aryl, arylalkyl, and substituted arylalkyl, $R_3$ is selected from the group consisting of hydrogen, alkyl, substituted alkyl, aryl, substituted aryl, arylalkyl, and substituted arylalkyl, and Ar is selected from the group consisting of aryl, substituted aryl, arylalkyl, and substituted arylalkyl; (b) those of Formula II

II wherein $R_1$ is selected from the group consisting of hydrogen, alkyl, substituted alkyl, aryl, substituted aryl, arylalkyl, and substituted arylalkyl, $R_2$ is selected from the group consisting of hydrogen, alkyl, substituted alkyl, aryl, substituted aryl, arylalkyl, and substituted arylalkyl, and Ar is selected from the group consisting of aryl, substituted aryl, arylalkyl, and substituted arylalkyl; (c) dimeric compounds containing two moieties of Formula I; (d) dimeric compounds containing two moieties of Formula II; (e) dimeric compounds containing one moiety of Formula I and one moiety of Formula II; (f) trimeric compounds containing three moieties of Formula I; (g) trimeric compounds containing three moieties of Formula II; (h) trimeric compounds containing two moieties of Formula I and one moiety of Formula II; (i) trimeric compounds containing one moiety of Formula I and two moieties of Formula II; (j) polymeric compounds containing at least four moieties selected from the group consisting of Formula I, Formula II, and mixtures thereof; and (k) mixtures thereof.

18 Claims, No Drawings

DEVELOPER COMPOSITIONS

This is a continuation of application Ser. No. 08/166,374 filed on Dec. 13, 1993, abandoned.

BACKGROUND OF THE INVENTION

The present invention is directed to developer compositions. More specifically, the present invention is directed to dry and liquid electrographic toners containing specific colorants. One embodiment of the present invention is directed to a toner composition for the development of electrostatic latent images comprising particles comprising a mixture of a resin and a colorant selected from the group consisting of: (a) those of Formula I

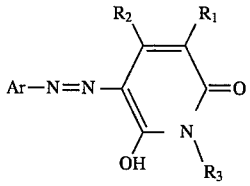

I wherein $R_1$ is an electron withdrawing group, $R_2$ is selected from the group consisting of hydrogen, alkyl, substituted alkyl, aryl, substituted aryl, arylalkyl, and substituted arylalkyl, $R_3$ is selected from the group consisting of hydrogen, alkyl, substituted alkyl, aryl, substituted aryl, arylalkyl, and substituted arylalkyl, and Ar is selected from the group consisting of aryl, substituted aryl, arylalkyl, and substituted arylalkyl; (b) those of Formula II

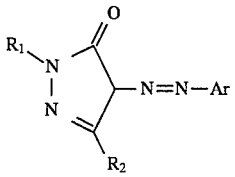

II wherein $R_1$ is selected from the group consisting of hydrogen, alkyl, substituted alkyl, aryl, substituted aryl, arylalkyl, and substituted arylalkyl, $R_2$ is selected from the group consisting of hydrogen, alkyl, substituted alkyl, aryl, substituted aryl, arylalkyl, and substituted arylalkyl, and Ar is selected from the group consisting of aryl, substituted aryl, arylalkyl, and substituted arylalkyl; (c) dimeric compounds containing two moieties of Formula I; (d) dimeric compounds containing two moieties of Formula II; (e) dimeric compounds containing one moiety of Formula I and one moiety of Formula II; (f) trimeric compounds containing three moieties of Formula I; (g) trimeric compounds containing three moieties of Formula II; (h) trimeric compounds containing two moieties of Formula I and one moiety of Formula II; (i) trimeric compounds containing one moiety of formula I and two moieties of Formula II; (j) polymeric compounds containing at least four moieties selected from the group consisting of Formula I, Formula II, and mixtures thereof; and (k) mixtures thereof.

Another embodiment of the present invention is directed to a liquid developer composition for the development of electrostatic latent images which comprises a nonaqueous liquid vehicle and a colorant selected from the group consisting of: (a) those of Formula I

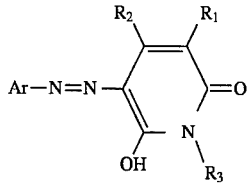

I wherein $R_1$ is an electron withdrawing group, $R_2$ is selected from the group consisting of hydrogen, alkyl, substituted alkyl, aryl, substituted aryl, arylalkyl, and substituted arylalkyl, $R_3$ is selected from the group consisting of hydrogen, alkyl, substituted alkyl, aryl, substituted aryl, arylalkyl, and substituted arylalkyl, and Ar is selected from the group consisting of aryl, substituted aryl, arylalkyl, and substituted arylalkyl; (b) those of Formula II wherein $R_1$ is selected from the group consisting of hydrogen, alkyl, substituted alkyl, aryl, substituted aryl, arylalkyl, and substituted arylalkyl, $R_2$ is selected from the group consisting of hydrogen, alkyl, substituted alkyl, aryl, substituted aryl, arylalkyl, and substituted arylalkyl, and Ar is selected from the group consisting of aryl, substituted aryl, arylalkyl, and substituted arylalkyl; (c) dimeric compounds containing two moieties of

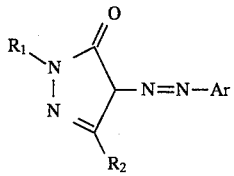

II

Formula I; (d) dimeric compounds containing two moieties of Formula II; (e) dimeric compounds containing one moiety of Formula I and one moiety of Formula II; (f) trimeric compounds containing three moieties of Formula I; (g) trimeric compounds containing three moieties of Formula II; (h) trimeric compounds containing two moieties of Formula I and one moiety of Formula II; (i) trimeric compounds containing one moiety of formula I and two moieties of Formula II; (j) polymeric compounds containing at least four moieties selected from the group consisting of Formula I, Formula II, and mixtures thereof; and (k) mixtures thereof, wherein the liquid developer has a resistivity of from about $10^8$ to about $10^{11}$ ohm-cm and a viscosity of from about 25 to about 500 centipoise.

Yet another embodiment of the present invention is directed to a liquid developer composition for the development of electrostatic latent images which comprises a nonaqueous liquid vehicle, a charge control agent, and toner particles comprising a mixture of a resin and a colorant selected from the group consisting of: (a) those of Formula I

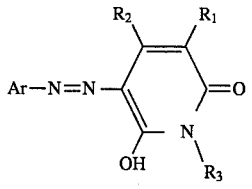

I wherein $R_1$ is an electron withdrawing group, $R_2$ is selected from the group consisting of hydrogen, alkyl, substituted alkyl, aryl, substituted aryl, arylalkyl, and substituted arylalkyl, $R_3$ is selected from the group consisting of hydrogen, alkyl, substituted alkyl, aryl, substituted aryl, arylalkyl, and substituted arylalkyl, and Ar is selected from the group consisting of aryl, substituted aryl, arylalkyl, and substituted arylalkyl; (b) those of Formula II

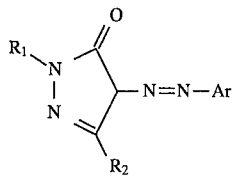

II wherein $R_1$ is selected from the group consisting of hydrogen, alkyl, substituted alkyl, aryl, substituted aryl, arylalkyl, and substituted arylalkyl, $R_2$ is selected from the group consisting of hydrogen, alkyl, substituted alkyl, aryl, substituted aryl, arylalkyl, and substituted arylalkyl, and Ar is selected from the group consisting of aryl, substituted aryl, arylalkyl, and substituted arylalkyl; (c) dimeric compounds containing two moieties of Formula I; (d) dimeric compounds containing two moieties of Formula II; (e) dimeric compounds containing one moiety of Formula I and one moiety of Formula II; (f) trimeric compounds containing three moieties of Formula I; (g) trimeric compounds containing three moieties of Formula II; (h) trimeric compounds containing two moieties of Formula I and one moiety of Formula II; (i) trimeric compounds containing one moiety of formula I and two moieties of Formula II; (j) polymeric compounds containing at least four moieties selected from the group consisting of Formula I, Formula II, and mixtures thereof; and (k) mixtures thereof.

The formation and development of images on the surface of photoconductive materials by electrostatic means is well known. The basic electrophotographic imaging process, as taught by C. F. Carlson in U.S. Pat. No. 2,297,691, entails placing a uniform electrostatic charge on a photoconductive insulating layer known as a photoconductor or photoreceptor, exposing the photoreceptor to a light and shadow image to dissipate the charge on the areas of the photoreceptor exposed to the light, and developing the resulting electrostatic latent image by depositing on the image a finely divided electroscopic material known as toner. Toner typically comprises a resin and a colorant. The toner will normally be attracted to those areas of the photoreceptor which retain a charge, thereby forming a toner image corresponding to the electrostatic latent image. This developed image may then be transferred to a substrate such as paper. The transferred image may subsequently be permanently affixed to the substrate by heat, pressure, a combination of heat and pressure, or other suitable fixing means such as solvent or overcoating treatment.

Another known process for forming electrostatic images is ionography. In ionographic imaging processes, a latent image is formed on a dielectric image receptor or electroreceptor by ion deposition, as described, for example, in U.S. Pat. No. 3,564,556, U.S. Pat. No. 3,611,419, U.S. Pat. No. 4,240,084, U.S. Pat. No. 4,569,584, U.S. Pat. No. 2,919,171, U.S. Pat. No. 4,524,371, U.S. Pat. No. 4,619,515, U.S. Pat. No. 4,463,363, U.S. Pat. No. 4,254,424, U.S. Pat. No. 4,538,163, U.S. Pat. No. 4,409,604, U.S. Pat. No. 4,408,214, U.S. Pat. No. 4,365,549, U.S. Pat. No. 4,267,556, U.S. Pat. No. 4,160,257, and U.S. Pat. No. 4,155,093, the disclosures of each of which are totally incorporated herein by reference. Generally, the process entails application of charge in an image pattern with an ionographic writing head to a dielectric receiver that retains the charged image. The image is subsequently developed with a developer capable of developing charge images.

Many methods are known for applying the electroscopic particles to the electrostatic latent image to be developed. One development method, disclosed in U.S. Pat. No. 2,618,552, the disclosure of which is totally incorporated herein by reference, is known as cascade development. Another technique for developing electrostatic images is the magnetic brush process, disclosed in U.S. Pat. No. 2,874,063. This method entails the carrying of a developer material containing toner and magnetic carrier particles by a magnet. The magnetic field of the magnet causes alignment of the magnetic carriers in a brushlike configuration, and this "magnetic brush" is brought into contact with the electrostatic image bearing surface of the photoreceptor. The toner particles are drawn from the brush to the electrostatic image by electrostatic attraction to the undischarged areas of the photoreceptor, and development of the image results. Other techniques, such as touchdown development, powder cloud development, and jumping development are known to be suitable for developing electrostatic latent images.

Liquid developers and liquid development processes for the development of electrostatic latent images are also known. In electrophoretic developers and processes, the liquid developers generally comprise a liquid vehicle and colored toner particles, and frequently also contain a charge control agent. The colored toner particles become charged, and upon contacting the electrostatic latent image with the liquid developer, the particles migrate through the liquid vehicle toward the charged image, thereby effecting development. Any residual liquid vehicle remaining on the image subsequent to development is evaporated or absorbed into the receiving sheet. Typically, liquid developers employ hydrocarbon liquid vehicles, most commonly high boiling aliphatic hydrocarbons that are relatively high in resistivity and nontoxic. Developers and processes of this type are disclosed in, for example, U.S. Pat. No. 4,476,210, U.S. Pat. No. 2,877,133, U.S. Pat. No. 2,890,174, U.S. Pat. No. 2,899,335, U.S. Pat. No. 2,892,709, U.S. Pat. No. 2,913,353, U.S. Pat. No. 3,729,419, U.S. Pat. No. 3,841,893, U.S. Pat. No. 3,968,044, U.S. Pat. No. 4,794,651, U.S. Pat. No. 4,762,764, U.S. Pat. No. 4,830,945, U.S. Pat. No. 4,686,936, U.S. Pat. No. 4,766,049, U.S. Pat. No. 4,707,429, U.S. Pat. No. 4,780,388, U.S. Pat. No. 3,976,808, U.S. Pat. No. 4,877,698, U.S. Pat. No. 4,880,720, U.S. Pat. No. 4,880,432, and copending application U.S. Ser. No. 07/300,395, the disclosures of each of which are totally incorporated herein by reference.

In polarizable liquid development processes, as disclosed in U.S. Pat. No. 3,084,043 (Gundlach), the disclosure of which is totally incorporated herein by reference, liquid developers having relatively low viscosity and low volatility and relatively high electrical conductivity (relatively low volume resistivity) are deposited on a gravure roller to fill the depressions in the roller surface. Excess developer is removed from the lands between the depressions, and as a receiving surface charged in image configuration passes near the gravure roller, liquid developer is attracted from the depressions onto the receiving surface in image configuration by the charged image. Developers and processes of this type are disclosed in, for example, U.S. Pat. No. 4,047,943, U.S. Pat. No. 4,059,444, U.S. Pat. No. 4,822,710, U.S. Pat. No. 4,804,601, U.S. Pat. No. 4,766,049, Canadian Patent 937,823, Canadian Patent 926,182, Canadian Patent 942,554, British Patent 1,321,286, and British Patent 1,312,844, the disclosures of each of which are totally incorporated herein by reference.

U.S. Pat. No. 4,284,782 (Schmidt), the disclosure of which is totally incorporated herein by reference, discloses a process for the manufacture of 6-hydroxypyrid-2-ones by reacting a cyanoacetamide with an acetoacetic acid ester at temperatures of 50° C. to 200° C. and a pressure of 0.5 to 50 bars in an aqueous solution or suspension in the presence of an amine in a molar amount at least equal to that of the cyanoacetamide reactant. The 6-hydroxypyrid-2-ones are of the general formula

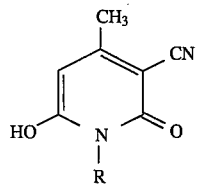

wherein R represents hydrogen or an optionally branched alkyl radical having 1 to 4 carbon atoms.

Japanese Patent Publication 04-180968-A discloses a dye represented by the general formula

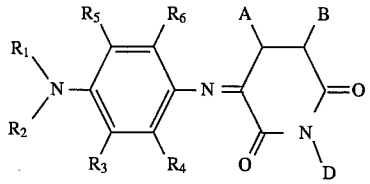

wherein $R_1$ and $R_2$ are hydrogen or optionally substituted alkyl and wherein $R_1$ and $R_2$ can be formed into a ring of 5 or 6 atoms by bonding with each other, $R_3$, $R_4$, $R_5$, and $R_6$ are halogen, optionally substituted alkyl, optionally substituted alkoxy, optionally substituted amido, or optionally substituted sulphonamide, A, B, and D are either the same or different and are carbon, nitrogen, oxygen, on an organic group or a hydrogen-atom bonding with the pyridone-ring through the sulphur atom. The dye is used for forming color images, such as a cyan colored filter dye used as an image forming medium for a photograph, heat-sensitive transfer printing, ink jet printing, or the like.

While known compositions and processes are useful for their intended purposes, a need remains for improved colorant compositions particularly suitable for use in developer compositions. In addition, a need remains for improved colorant compositions particularly suitable for use in dry toners for developing electrostatic latent images. Further, there is a need for improved colorant compositions particularly suitable for use in liquid developers for developing electrostatic latent images. Additionally, there is a need for toner compositions capable of generating images of high color quality. In addition, there is a need for toner compositions with dye colorants in which lower concentrations of dye are needed to obtain images of the desired color and intensity. Further, there is a need for toner compositions containing colorants which are capable of triboelectrically charging the toner. Additionally, there is a need for toner compositions containing colorants which do not affect the triboelectric charging characteristics of the toner. There is also a need for toner compositions containing dye colorants which do not adversely affect fusing temperatures or characteristics. Further, a need exists for toner compositions containing dye colorants wherein images generated with the toners are of archival quality in that the images are lightfast and permanent. Additionally, there is a need for toner compositions which generate on transparencies images of high projection efficiency and color quality.

SUMMARY OF THE INVENTION

It is an object of the present invention to provide colorant compositions with the above noted advantages.

It is another object of the present invention to provide dry toner compositions with the above noted advantages.

It is yet another object of the present invention to provide liquid developer compositions with the above noted advantages.

It is still another object of the present invention to provide improved colorant compositions particularly suitable for use in dry toners for developing electrostatic latent images.

Another object of the present invention is to provide improved colorant compositions particularly suitable for use in liquid developers for developing electrostatic latent images.

Yet another object of the present invention is to provide toner compositions capable of generating images of high color quality.

Still another object of the present invention is to provide toner compositions with dye colorants in which lower concentrations of dye are needed to obtain images of the desired color and intensity.

It is another object of the present invention to provide toner compositions containing colorants which are capable of triboelectrically charging the toner.

It is yet another object of the present invention to provide toner compositions containing colorants which do not affect the triboelectric charging characteristics of the toner.

It is still another object of the present invention to provide toner compositions containing dye colorants which do not adversely affect fusing temperatures or characteristics.

Another object of the present invention is to provide toner compositions containing dye colorants wherein images generated with the toners are of archival quality.

Yet another object of the present invention is to provide toner compositions which generate on transparencies images of high projection efficiency and color quality.

These and other objects of the present invention (or specific embodiments thereof) can be achieved by providing developer compositions containing the specific colorant materials disclosed herein. One embodiment of the present invention is directed to a toner composition for the development of electrostatic latent images comprising particles comprising a mixture of a resin and a colorant selected from the group consisting of: (a) those of Formula I

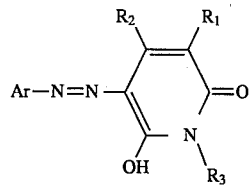

I wherein $R_1$ is an electron withdrawing group, $R_2$ is selected from the group consisting of hydrogen, alkyl, substituted alkyl, aryl, substituted aryl, arylalkyl, and substituted arylalkyl, $R_3$ is selected from the group consisting of hydrogen, alkyl, substituted alkyl, aryl, substituted aryl, arylalkyl, and substituted arylalkyl, and Ar is selected from the group consisting of aryl, substituted aryl, arylalkyl, and substituted arylalkyl; (b) those of Formula II

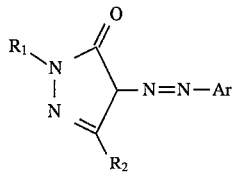

II wherein $R_1$ is selected from the group consisting of hydrogen, alkyl, substituted alkyl, aryl, substituted aryl, arylalkyl, and substituted arylalkyl, $R_2$ is selected from the group consisting of hydrogen, alkyl, substituted alkyl, aryl, substituted aryl, arylalkyl, and substituted arylalkyl, and Ar is selected from the group consisting of aryl, substituted aryl, arylalkyl, and substituted arylalkyl; (c) dimeric compounds containing two moieties of Formula I; (d) dimeric compounds containing two moieties of Formula II; (e) dimeric compounds containing one moiety of Formula I and one moiety of Formula II; (f) trimeric compounds containing three moieties of Formula I; (g) trimeric compounds containing three moieties of Formula II; (h) trimeric compounds containing two moieties of Formula I and one moiety of Formula II; (i) trimeric compounds containing one moiety of formula I and two moieties of Formula II; (j) polymeric compounds containing at least four moieties selected from the group consisting of Formula I, Formula II, and mixtures thereof; and (k) mixtures thereof.

Another embodiment of the present invention is directed to a liquid developer composition for the development of electrostatic latent images which comprises a nonaqueous liquid vehicle and a colorant selected from the group consisting of: (a) those of Formula I

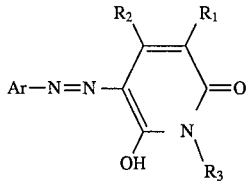

I wherein $R_1$ is an electron withdrawing group, $R_2$ is selected from the group consisting of hydrogen, alkyl, substituted alkyl, aryl, substituted aryl, arylalkyl, and substituted arylalkyl, $R_3$ is selected from the group consisting of hydrogen, alkyl, substituted alkyl, aryl, substituted aryl, arylalkyl, and substituted arylalkyl, and Ar is selected from the group consisting of aryl, substituted aryl, arylalkyl, and substituted arylalkyl; (b) those of Formula II

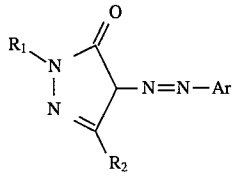

II wherein $R_1$ is selected from the group consisting of hydrogen, alkyl, substituted alkyl, aryl, substituted aryl, arylalkyl, and substituted arylalkyl, $R_2$ is selected from the group consisting of hydrogen, alkyl, substituted alkyl, aryl, substituted aryl, arylalkyl, and substituted arylalkyl, and Ar is selected from the group consisting of aryl, substituted aryl, arylalkyl, and substituted arylalkyl; (c) dimeric compounds containing two moieties of Formula I; (d) dimeric compounds containing two moieties of Formula II; (e) dimeric compounds containing one moiety of Formula I and one moiety of Formula II; (f) trimeric compounds containing three moieties of Formula I; (g) trimeric compounds containing three moieties of Formula II; (h) trimeric compounds containing two moieties of Formula I and one moiety of Formula II; (i) trimeric compounds containing one moiety of formula I and two moieties of Formula II; (j) polymeric compounds containing at least four moieties selected from the group consisting of Formula I, Formula II, and mixtures thereof; and (k) mixtures thereof, wherein the liquid developer has a resistivity of from about $10^8$ to about $10^{11}$ ohm-cm and a viscosity of from about 25 to about 500 centipoise.

Yet another embodiment of the present invention is directed to a liquid developer composition for the development of electrostatic latent images which comprises a nonaqueous liquid vehicle, a charge control agent, and toner particles comprising a mixture of a resin and a colorant selected from the group consisting of: (a) those of Formula I

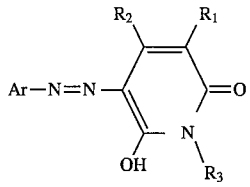

I wherein $R_1$ is an electron withdrawing group, $R_2$ is selected from the group consisting of hydrogen, alkyl, substituted alkyl, aryl, substituted aryl, arylalkyl, and substituted arylalkyl, $R_3$ is selected from the group consisting of hydrogen, alkyl, substituted alkyl, aryl, substituted aryl, arylalkyl, and substituted arylalkyl, and Ar is selected from the group consisting of aryl, substituted aryl, arylalkyl, and substituted arylalkyl; (b) those of Formula II

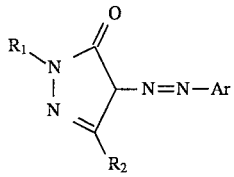

II wherein $R_1$ is selected from the group consisting of hydrogen, alkyl, substituted alkyl, aryl, substituted aryl, arylalkyl, and substituted arylalkyl, $R_2$ is selected from the group consisting of hydrogen, alkyl, substituted alkyl, aryl, substituted aryl, arylalkyl, and substituted arylalkyl, and Ar is selected from the group consisting of aryl, substituted aryl, arylalkyl, and substituted arylalkyl; (c) dimeric compounds containing two moieties of Formula I; (d) dimeric compounds containing two moieties of Formula II; (e) dimeric compounds containing one moiety of Formula I and one moiety of Formula II; (f) trimeric compounds containing three moieties of Formula I; (g) trimeric compounds containing three moieties of Formula II; (h) trimeric compounds containing two moieties of Formula I and one moiety of Formula II; (i) trimeric compounds containing one moiety of formula I and two moieties of Formula II; (j) polymeric compounds containing at least four moieties selected from the group consisting of Formula I, Formula II, and mixtures thereof; and (k) mixtures thereof.

DETAILED DESCRIPTION OF THE INVENTION

Marking materials of the present invention contain colorants of the structures indicated hereinabove. The colorant compositions can be prepared by any suitable process. For example, colorants of the formula

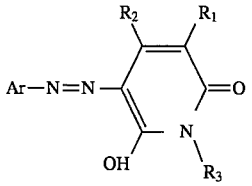

wherein $R_1$ is an electron withdrawing group, $R_2$ is selected from the group consisting of hydrogen, alkyl, substituted alkyl, aryl, substituted aryl, arylalkyl, and substituted arylalkyl, $R_3$ is selected from the group consisting of hydrogen, alkyl, substituted alkyl, aryl, substituted aryl, arylalkyl, and substituted arylalkyl, Ar is selected from the group consisting of aryl, substituted aryl, arylalkyl, and substituted arylalkyl, can be prepared by the diazo coupling of aromatic amines with pyridones. More specifically, these compounds can be prepared by first reacting a compound containing, in the following order, an ester group, a methylene group, and a carbonyl group (hereinafter referred to as an α,β-diketoester, either alkyl substituted, aryl substituted, or unsubstituted) and a compound containing, in the following order, an amide group and a methylene group (hereinafter referred to as an acetamide, either alkyl substituted, aryl substituted, or unsubstituted), typically in a 1:1 stoichiometric ratio, in the presence of a solvent, such as an alcohol, a glycol, a mixed solvent, or the like (methanol is one preferred solvent because of its ease of removal after completion of the reaction) and a base (such as potassium hydroxide, sodium hydroxide, lithium hydroxide, sodium hydride, potassium hydride, tertiary amines, hindered secondary amines (which can extract $H^+$ but will not react with the reactants), or the like) heated to the reflux temperature of the mixture (typically from about 70° to about 120° C.) and typically for from about 1 to about 4 hours to form a chromophore moiety. Thereafter, the resulting chromophore moiety can be reacted with an aromatic diazonium salt. Typically, the diazonium salt is prepared from the aromatic amine under acid conditions (preferably of pH<2) at chilled temperatures of from about 0° to about 5° C. for about 0.5 hour. The aromatic diazonium salt is then coupled with the chromophore moiety by heating a solution of the chromophore to dissolve it in the selected solvent (typically to about 70° C.), subsequently cooling the chromophore solution to a temperature just above where the chromophore would begin to precipitate (typically about 25° to 30° C.), followed by adding a cold solution of the aromatic diazonium salt, typically in about a 1:1 stoichiometric ratio with the chromophore. The general reaction scheme is as follows:

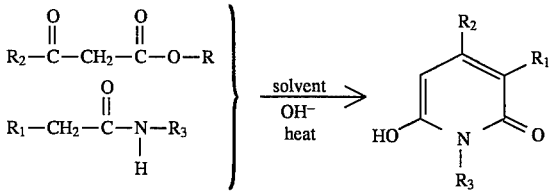

-continued

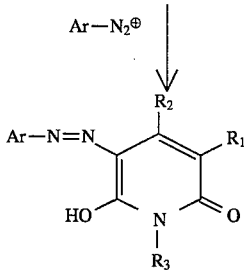

Specific colorants that can be made by this process include the following:

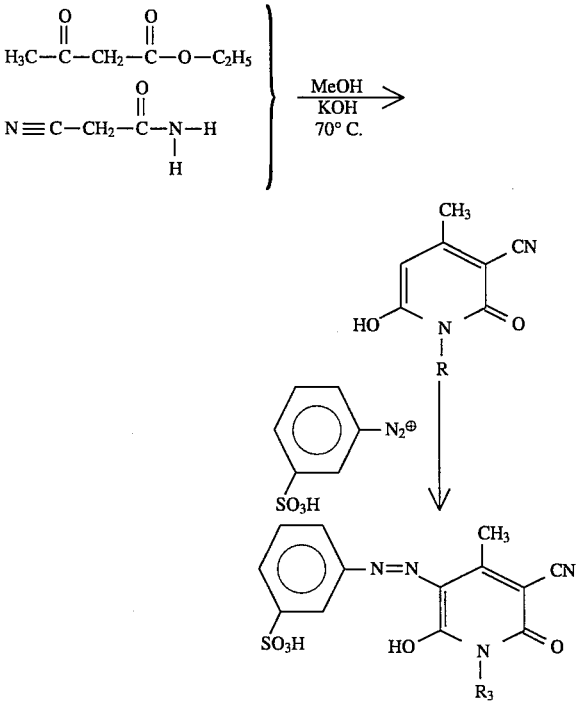

wherein R can be either H or methyl;

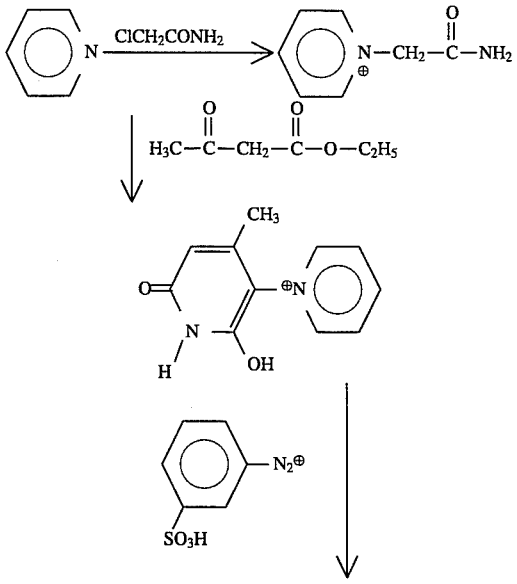

-continued

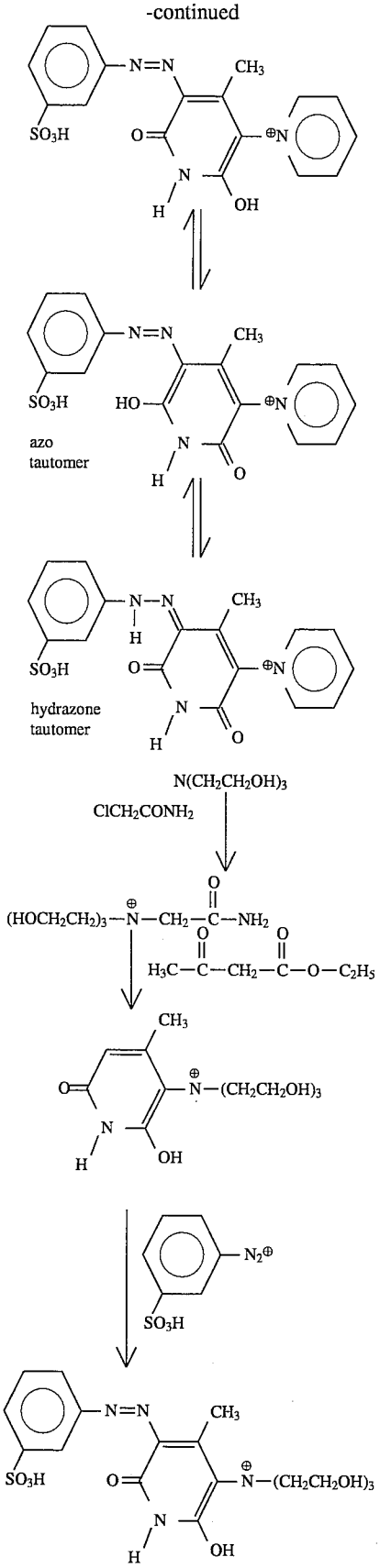

and the like.

These compounds can also be prepared as disclosed in U.S. Pat. No. 4,284,782, the disclosure of which is totally incorporated herein by reference.

Examples of aromatic amines suited to diazotization to generate aromatic diazonium salts for the above reactions include aniline, metanilic acid, sulfanilic acid (p-aminobenzenesulfonic acid), 2-methyl-5-aminobenzene sulfonic acid, 2,5-diaminobenzenesulfonic acid, 5,5'-diamino-biphenyl-2,2'-disulfonic acid, bis(p-4,4'-diamino-phenoxy)-propylene glycol, 4,4'-diaminodibenzyl-2,2'-disulfonic acid, 4,4'-diaminostilbene-2,2'-disulfonic acid, 5,5'-dimethyl-4,4'-diaminobiphenyl-2,2'-disulfonic acid, 4,4'-diaminobiphenyl-2,2'-disulfonic acid, 4,4'-diaminobiphenyl, and the like.

Colorants of the formula

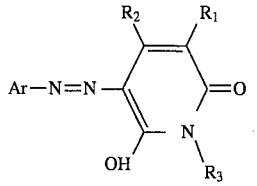

typically exist in tautomeric forms, as follows:

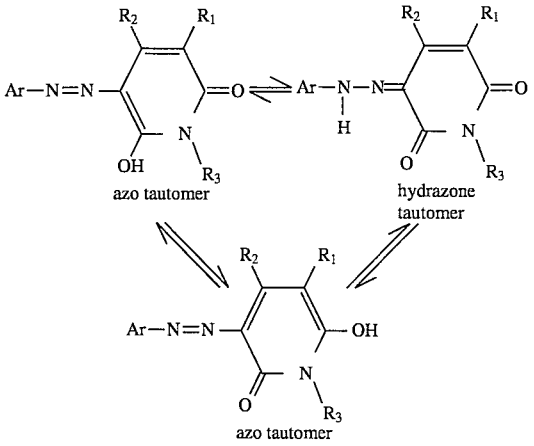

These structures generally exist in equilibrium. While, for the purposes of the present invention, generally only one tautomer will be drawn, it is to be understood that all three of these forms may be present in compositions of the present invention.

For colorants of the formula

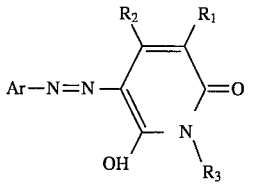

$R_1$ generally is an electron withdrawing group. Specific examples of suitable $R_1$ groups include a cationic pyridinium moiety, a cyano group, a nitro-aromatic group, an acid group, an amide group, an aldehyde or ketone group, or the like. $R_2$ generally is a relatively inactive moiety, such as hydrogen, alkyl, either saturated or unsaturated, preferably with from 1 to about 30 carbon atoms (with larger hydrocarbon chains imparting a surfactant or surface active character to the molecule), more preferably with from 1 to about 2 carbon atoms, substituted alkyl, either saturated or unsaturated, preferably with from 1 to about 30 carbon atoms, more preferably with from 1 to about 2 carbon atoms, aryl, preferably with from 6 to about 32 carbon atoms, substituted aryl, preferably with from 6 to about 32 carbon atoms, arylalkyl, preferably with from 7 to about 30 carbon atoms, substituted arylalkyl, preferably with from about 7 to about 30 carbon atoms, or a halogen atom, such as fluorine, chlorine, bromine, iodine, and astatine. $R_3$ is generally hydrogen, an alkyl group, either saturated or unsaturated, preferably with from 1 to about 30 carbon atoms, more preferably with from 1 to about 2 carbon atoms, substituted alkyl, either saturated or unsaturated, preferably with from 1 to about 30 carbon atoms, more preferably with from 1 to about 2 carbon atoms, aryl, preferably with from 6 to about 32 carbon atoms, substituted aryl, preferably with from 6 to about 32 carbon atoms, arylalkyl, preferably with from 7 to about 30 carbon atoms, substituted arylalkyl, preferably with from about 7 to about 30 carbon atoms, or a halogen atom, such as fluorine, chlorine, bromine, iodine, and astatine. Ar is an aryl, substituted aryl, arylalkyl, or substituted arylalkyl group, preferably with from 6 to about 32 carbon atoms, more preferably with from 6 to about 20 carbon atoms. Preferably, Ar is of a nature such that formation of the hydrazone tautomer is not hindered. Examples of suitable substituents include silyl groups, halide atoms, such as fluoride, chloride, bromide, iodide, and astatide, nitro groups, amine groups, including primary, secondary, and tertiary amines, hydroxy groups, alkoxy or ether groups, aldehyde groups, ketone groups, ester groups, amide groups, carboxylic acid groups, and the like.

Specific examples of colorants of this general formula include the following:

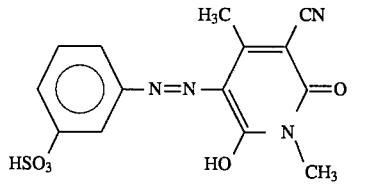

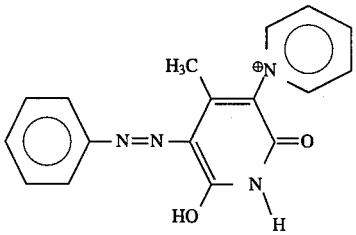

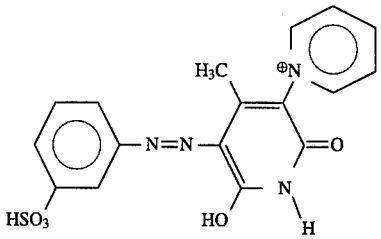

-continued

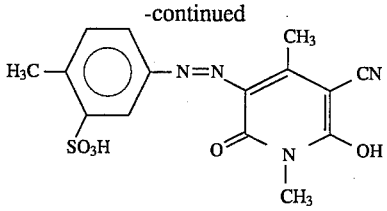

Colorants of the general formula

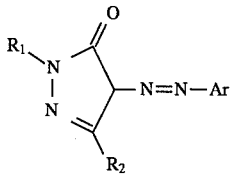

wherein $R_1$ is selected from the group consisting of hydrogen, alkyl, substituted alkyl, aryl, substituted aryl, arylalkyl, and substituted arylalkyl, $R_2$ is selected from the group consisting of hydrogen, alkyl, substituted alkyl, aryl, substituted aryl, arylalkyl, and substituted arylalkyl, and Ar is selected from the group consisting of aryl, substituted aryl, arylalkyl, and substituted arylalkyl, can be prepared by the diazo coupling of aromatic amines with pyrazolones. More specifically, these compounds can be prepared by first converting a primary amine to the corresponding diazonium salt, followed by reacting the diazonium salt with bisulfite to obtain the corresponding hydrazine, followed by reacting the hydrazine with an α,β-diketoester to obtain a chromophore moiety. Typically, the hydrazine and the diketoester are reacted in a 1:1 stoichiometric ratio at the reflux temperature of the selected solvent (water and methanol are among the suitable solvents), typically from about 80° to about 100° C., and typically for from about 3 to about 5 hours. Thereafter, the resulting chromophore moiety can be reacted with an aromatic diazonium salt under the reaction conditions set forth previously herein. The general reaction scheme is as follows:

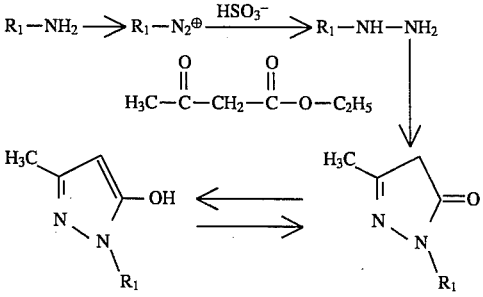

Specific examples of colorants that can be made by this process are as follows:

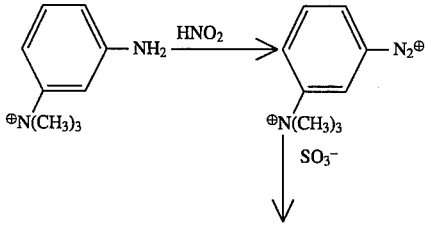

-continued

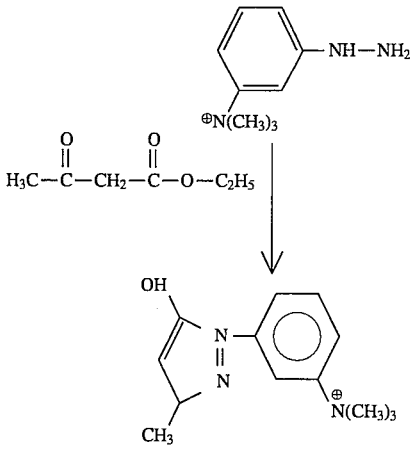

and the like.

These colorants can also be prepared as described by K. Venkataraman in The Chemistry of Synthetic Dyes, vol. 1, pages 607 and 628, Academic Press (New York 1952), the disclosure of which is totally incorporated herein by reference.

Colorants of the formula

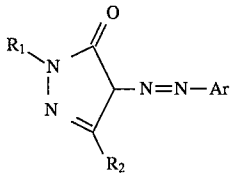

typically exist in tautomeric forms, as follows:

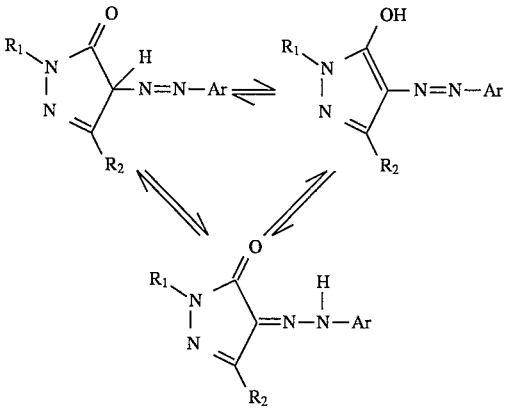

These structures generally exist in equilibrium. While, for the purposes of the present invention, generally only one tautomer will be drawn, it is to be understood that all three of these forms may be present in compositions of the present invention.

For colorants of the formula

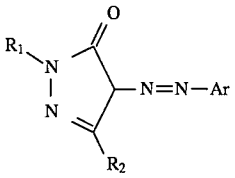

$R_1$ generally is selected from the group consisting of hydrogen, alkyl, substituted alkyl, aryl, substituted aryl, arylalkyl, and substituted arylalkyl. Specific examples of suitable $R_1$ groups include benzenesulfonic acid, benzenesulfonate salts, sulfonated stilbene derivatives, sulfonated bibenzyl derivatives, and the like. $R_2$ generally is selected from the group consisting of hydrogen, alkyl, substituted alkyl, aryl, substituted aryl, arylalkyl, and substituted arylalkyl. Specific examples of suitable $R_2$ groups include methyl, ethyl, carboxy-substituted alkyl, and the like. Ar is an aryl, substituted aryl, arylalkyl, or substituted arylalkyl group, preferably with from 6 to about 32 carbon atoms, more preferably with from 6 to about 30 carbon atoms. Preferably, Ar is of a nature such that formation of the hydrazone tautomer is not hindered. Specific examples of suitable Ar groups include toluenesulfonic acid, toluene sulfonate salts, sulfonated bibenzyl derivatives, and the like. Examples of suitable substituents on $R_1$, $R_2$, and Ar include silyl groups, halide atoms, such as fluoride, chloride, bromide, iodide, and astatide, nitro groups, amine groups, including primary, secondary, and tertiary amines, hydroxy groups, alkoxy or ether groups, aldehyde groups, ketone groups, ester groups, amide groups, carboxylic acid groups, and the like.

Specific examples of colorants of this formula include:

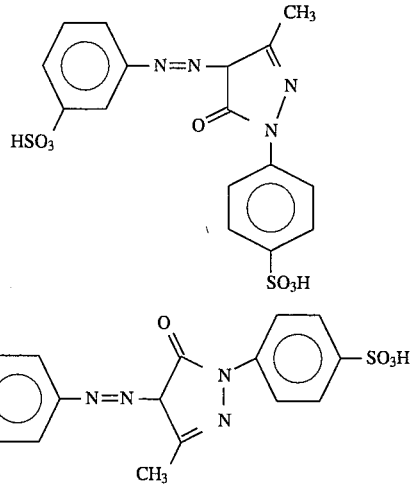

Colorant structures of the above formulae can be included in dimeric, trimeric, and polymeric compounds. (For the purposes of the present invention, polymeric compounds are defined as those containing at least four colorant moieties of Formula I and/or Formula II.) For dimeric, trimeric, and polymeric compounds containing moieties of Formula I, the attachment points can be through $R_1$, $R_2$, $R_3$, and/or Ar, provided that $R_1$ remains electron withdrawing. It is also preferred that if Ar is used as an attachment point, its nature remains such that formation of the hydrazone tautomer is not hindered. Similarly, for dimeric, trimeric, and polymeric compounds containing moieties of Formula II, the attachment points can be through $R_1$, $R_2$, and/or Ar. Both symmetric and unsymmetric dimers, trimers, and polymers can be formed. For example, in the case of unsymmetric dimers, two different moieties, both according to Formula I, can be linked together through $R_1$; or, two identical moieties of Formula II can be linked together, with the connection points being $R_2$ for one moiety and Ar for the other moiety; or two different moieties, one of Formula I and one of Formula H, can be linked together.

Specific examples of suitable bridging groups include alkyl groups, such as methyl, ethyl, propyl, and the like, substituted alkyl groups, such as alkyldiamines of the formula $H_2N—R—NH_2$, wherein R is an alkyl group, and alkyldiamines of the formula

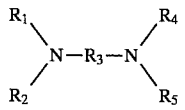

where $R_1$, $R_2$, $R_3$, $R_4$, and $R_5$ are alkyl groups, oxyalkyl groups, such as ethylene oxide and polyethylene oxide, aryl groups, such as biphenyl, 1,4-dipyridine, of the formula

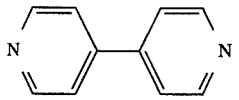

polyvinyl pyridine, substituted aryl groups, such as sulfonated biphenyl, benzenesulfonic acid, of the formula

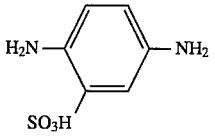

4,4'-methylene-dianiline, arylalkyl groups, such as stilbene, of the formula

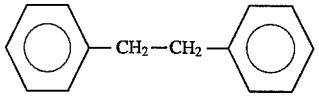

stilbene derivatives, such as hydrogenated stilbene, of the formula

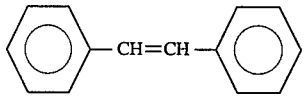

diaminostilbene disulfonate, of the formula

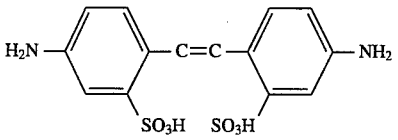

methylene bis dimethylaniline, of the formula

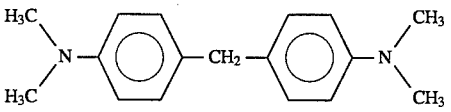

methylene dicyclohexylamine, poly-p-amino styrene, substituted arylalkyl groups, such as sulfonated stilbenes and sulfonated hydrogenated stilbenes, cyanuric acid (trichlorotriazine), of the formula

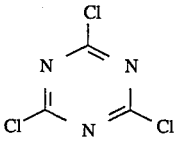

(wherein two of the chlorine atoms are removed and those sites become coupling sites to the ring), derivatives of trichlorotriazine couplers, such as those formed by the following reaction schemes:

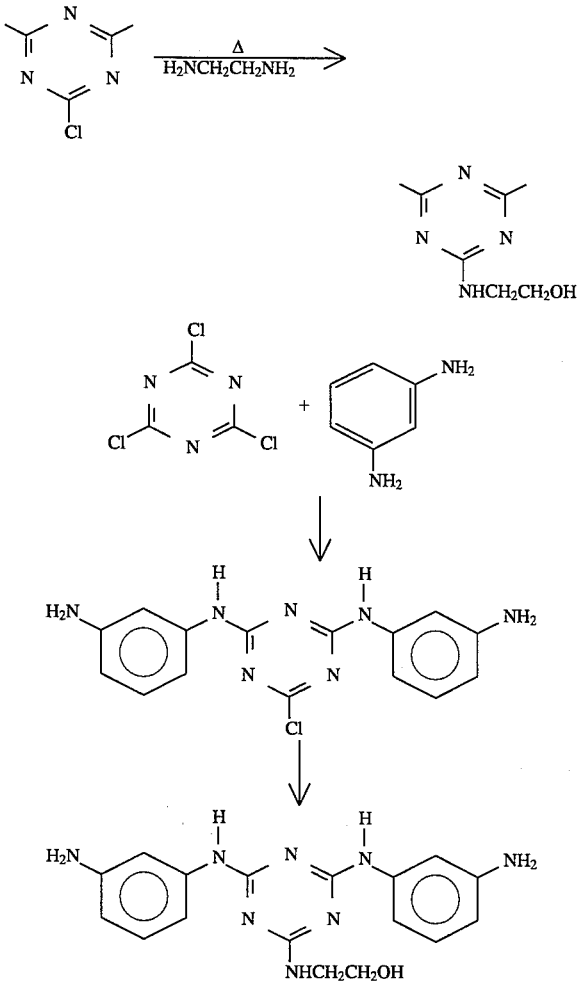

and the like.

When the bridging group is coupled to the chromophore by the reaction between a diazonium group and the chromophore, the bridging group generally is formed by selecting a bridging moiety having at least two amine groups and converting the amine groups to the corresponding diazonium salts, followed by reaction of the azotized material with the chromophore. In a preferred embodiment, the bridging group is relatively insulating in that electron flow through the bridging group between the two chromophores is inhibited so that the color of the chromophore is not affected. For example, in this embodiment, a hydrogenated stilbene would be preferred over a stilbene, since the double bond linking the two aromatic rings in the stilbene moiety allows electron flow through the entire stilbene moiety.

Some examples of dimeric colorants containing moieties of Formula I include the following:

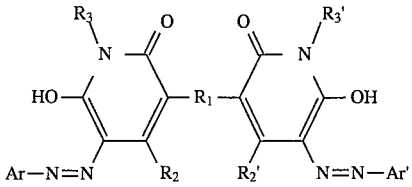

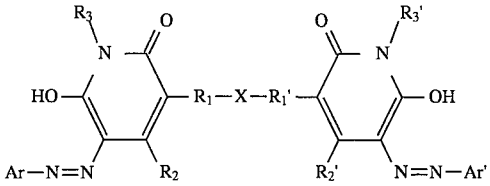

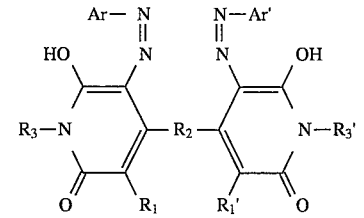

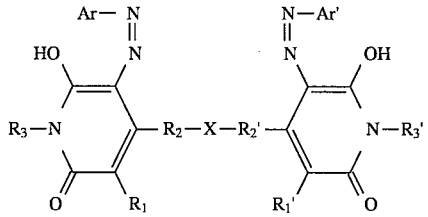

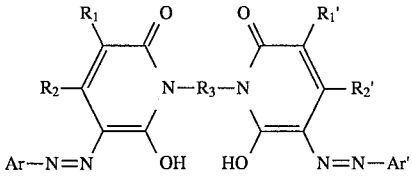

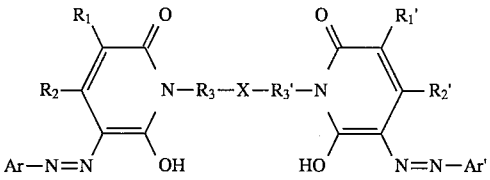

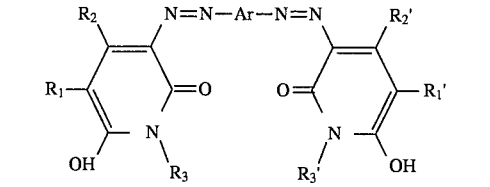

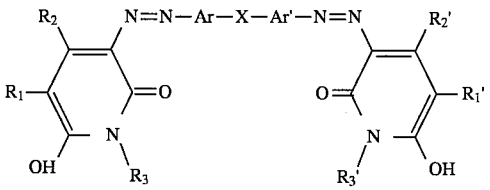

-continued

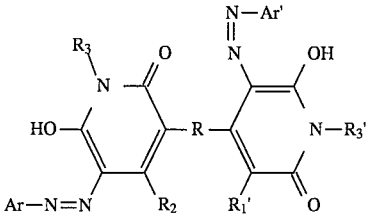

(R is a group that meets the definitions of both $R_1$ and $R'_2$)

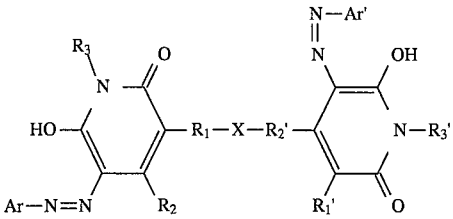

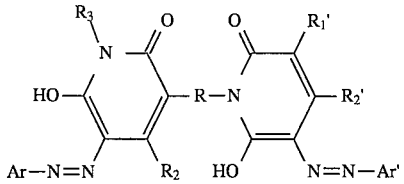

(R is a group that meets the definitions of both $R_1$ and $R'_3$)

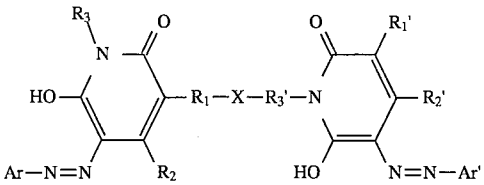

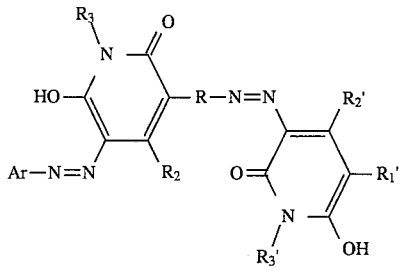

(R is a group that meets the definitions of both $R_1$ and Ar')

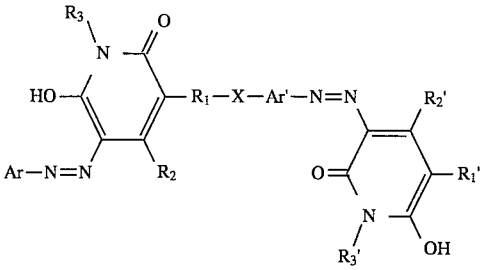

-continued

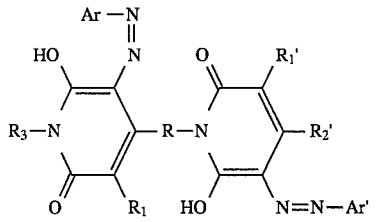

(R is a group that meets the definitions of both $R_2$ and $R'_3$)

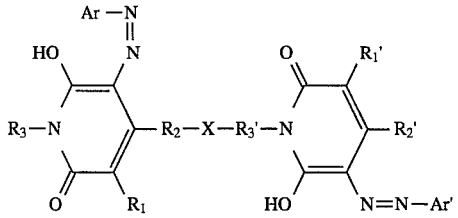

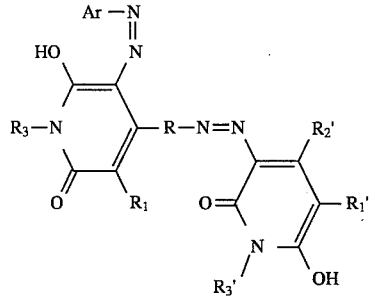

(R is a group that meets the definitions of both $R_2$ and Ar')

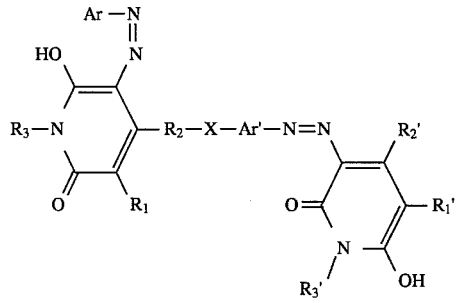

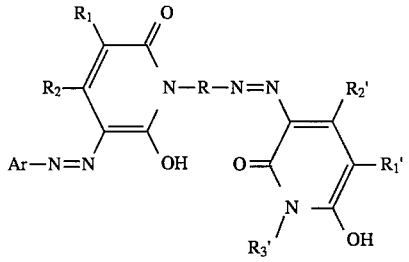

(R is a group that meets the definitions of both $R_3$ and Ar')

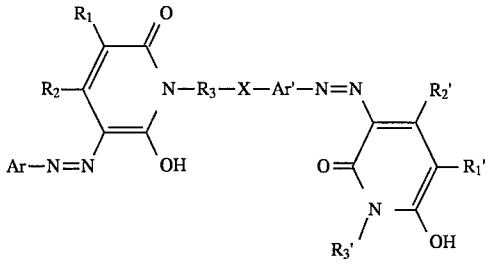

wherein $R_1$ and $R'_1$ are each electron withdrawing groups, $R_2$ and $R'_2$ are each independently selected from the group consisting of hydrogen, alkyl, substituted alkyl, aryl, substituted aryl, arylalkyl, and substituted arylalkyl, $R_3$ and $R'_3$ are each independently selected from the group consisting of hydrogen, alkyl, substituted alkyl, aryl, substituted aryl, arylalkyl, and substituted arylalkyl, Ar and Ar' are each independently selected from the group consisting of aryl, substituted aryl, arylalkyl, and substituted arylalkyl, and X is selected from the group consisting of alkyl, substituted alkyl, aryl, substituted aryl, arylalkyl, and substituted arylalkyl. These colorants and the corresponding trimeric compounds and polymeric compounds can be prepared by reacting a chromophore moiety and a bridging group, and, if desired, a terminal group, in any desired order to obtain the desired product. The synthetic processes are similar to those employed for preparing the monomeric colorants except that the reaction stoichiometry may vary. For example, an aryl or alkylaryl diamine can be selected as the bridging group, wherein the two amine groups are converted to diazonium groups, followed by reaction of the bridging group with the chromophore in a 1:2 stoichiometric ratio to couple two chromophore moieties to the bridging group.

Specific examples of dimeric colorants containing moieties of Formula I include the following:

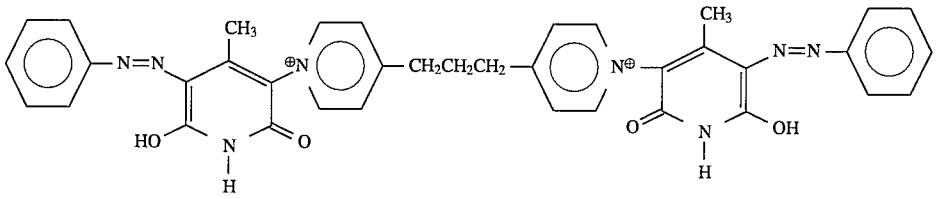
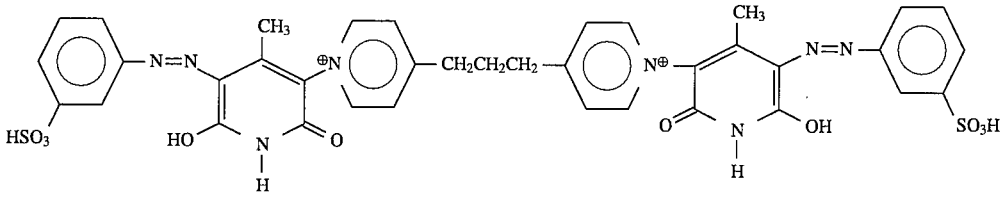
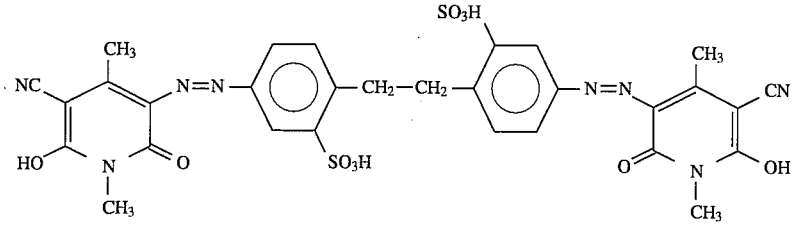
Examples of dimeric colorants containing moieties of Formula II include the following:
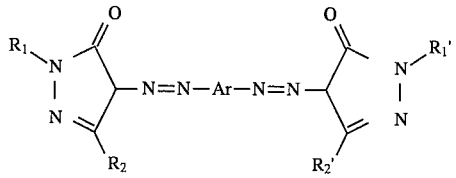
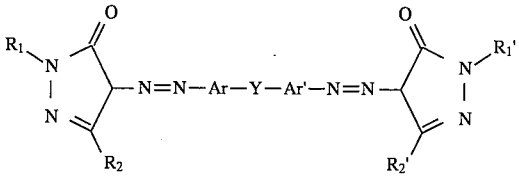
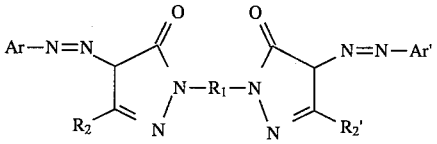
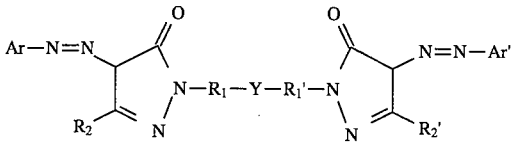
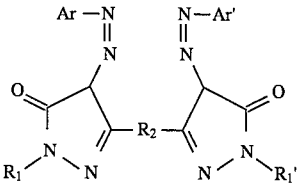
-continued
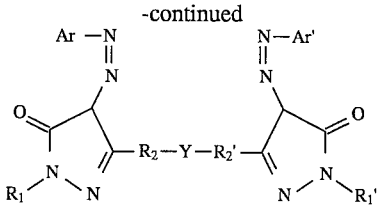
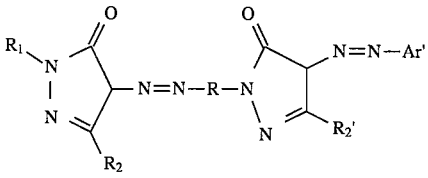
(R is a group that meets the definitions of both Ar and $R'_1$)
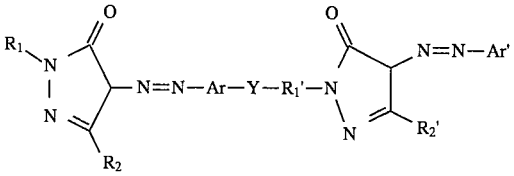
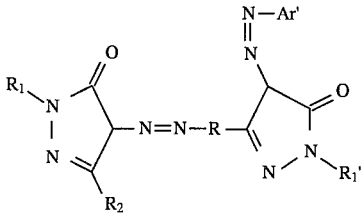

(R is a group that meets the definitions of both Ar and $R'_2$)

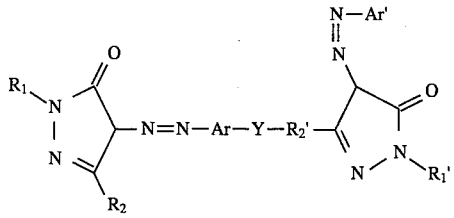

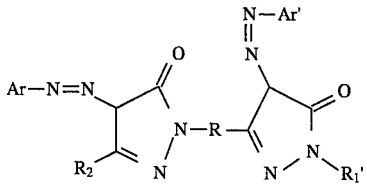

(R is a group that meets the definitions of both $R_1$ and $R'_2$)

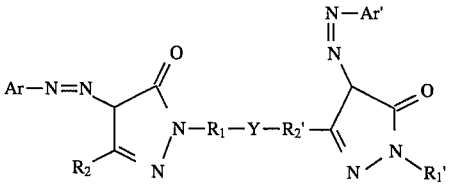

wherein $R_1$ and $R'_1$ are each independently selected from the group consisting of hydrogen, alkyl, substituted alkyl, aryl, substituted aryl, arylalkyl, and substituted arylalkyl, $R_2$ and $R'_2$ are each independently selected from the group consisting of hydrogen, alkyl, substituted alkyl, aryl, substituted aryl, arylalkyl, and substituted arylalkyl, Ar and Ar' are each independently selected from the group consisting of aryl, substituted aryl, arylalkyl, and substituted arylalkyl, and Y is selected from the group consisting of alkyl, substituted alkyl, aryl, substituted aryl, arylalkyl, and substituted arylalkyl. These colorants and the corresponding trimers and polymers can be prepared by reacting a chromophore moiety with a bridging group, and, if desired, with a terminal group in any desired order to obtain the desired product. The synthetic processes are similar to those employed for preparing the monomeric colorants except that the reaction stoichiometry may vary. For example, an aryl or alkylaryl diamine can be selected as the bridging group, wherein the two amine groups are converted to diazonium groups, followed by reaction of the bridging group with the chromophore in a 1:2 stoichiometric ratio to couple two chromophore moieties to the bridging group.

Specific examples of colorants of these general formulae include the following:

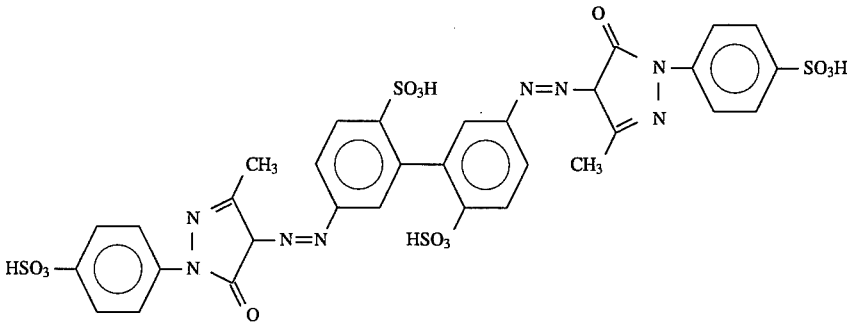

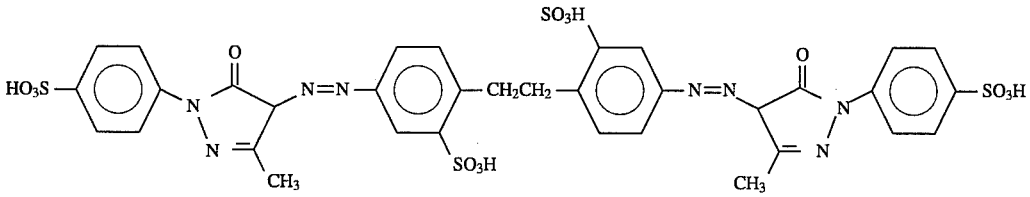

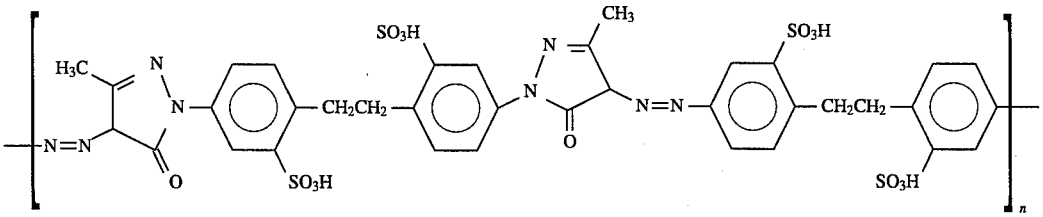

Examples of dimeric colorants containing moieties of Formula I and Formula II include the following:

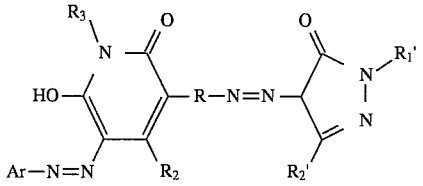

(R is a group that meets the definitions of both $R_1$ and Ar')

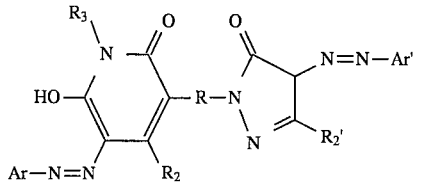

(R is a group that meets the definitions of both $R_1$ and $R'_1$)

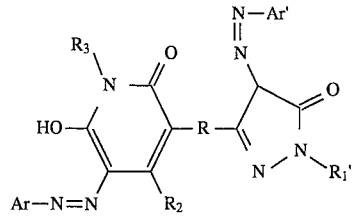

(R is a group that meets the definitions of both $R_1$ and $R'_2$)

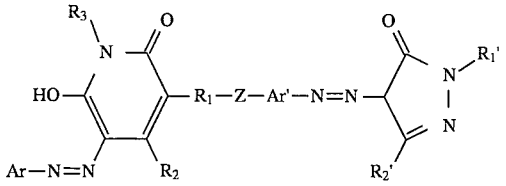

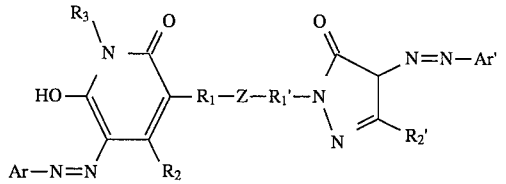

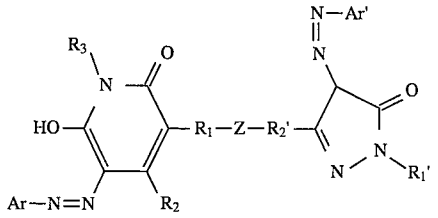

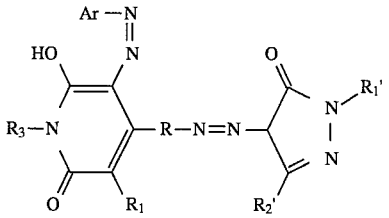

(R is a group that meets the definitions of both $R_2$ and Ar')

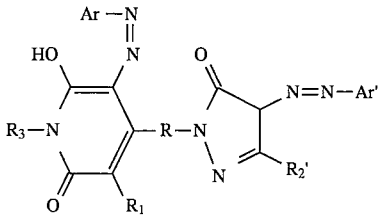

(R is a group that meets the definitions of both $R_2$ and $R'_1$)

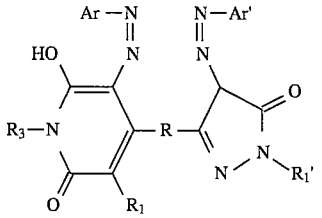

(R is a group that meets the definitions of both $R_2$ and $R'_2$)

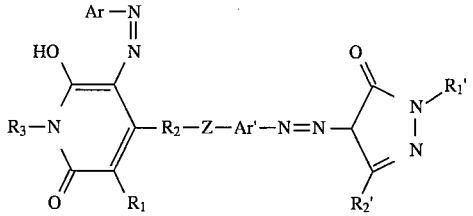

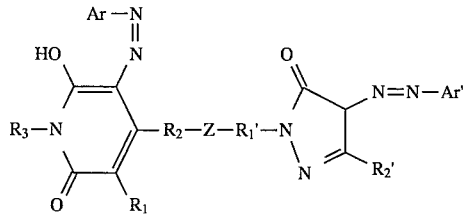

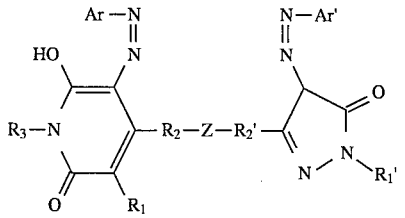

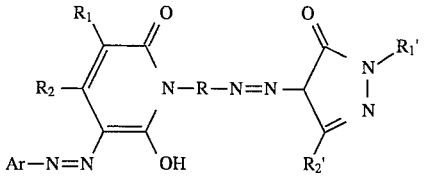

(R is a group that meets the definitions of both $R_3$ and Ar')

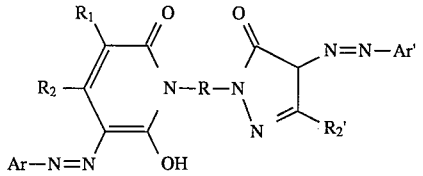

(R is a group that meets the definitions of both $R_3$ and $R'_1$)

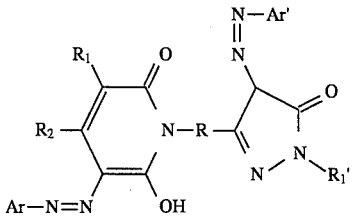

(R is a group that meets the definitions of both $R_3$ and $R'_2$)

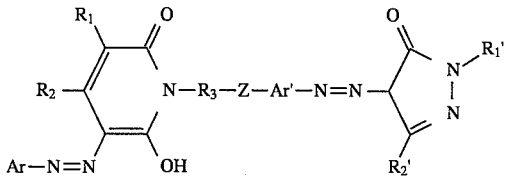

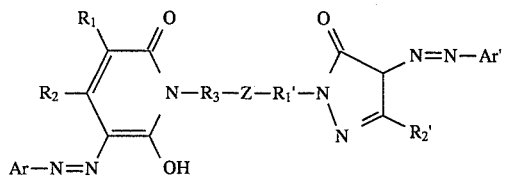

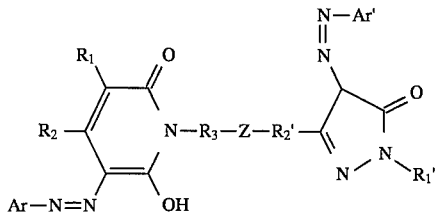

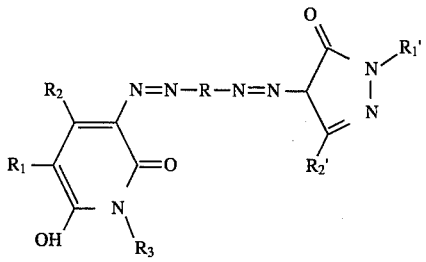

(R is a group that meets the definitions of both Ar and Ar')

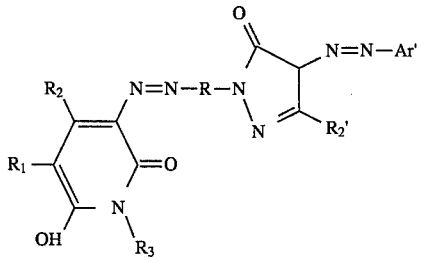

(R is a group that meets the definitions of both Ar and $R'_1$)

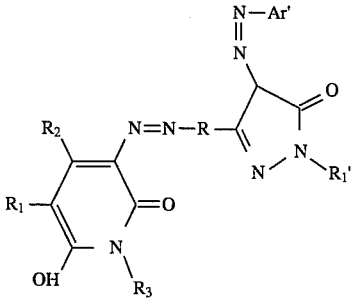

(R is a group that meets the definitions of both Ar and $R'_2$)

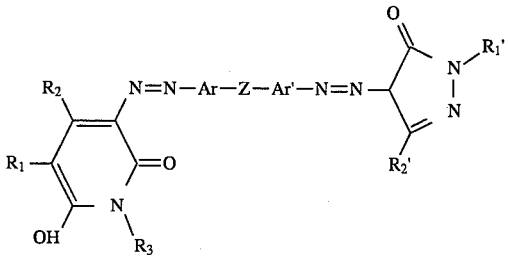

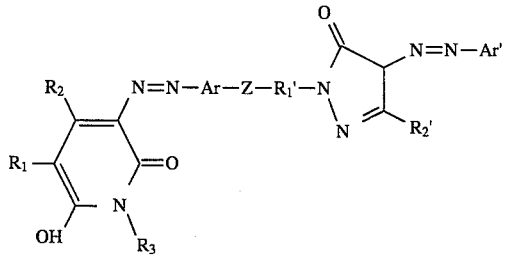

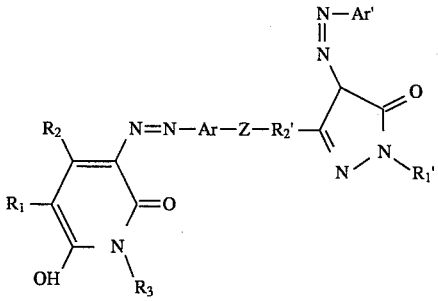

wherein $R_1$ is an electron withdrawing group, $R_2$ is selected from the group consisting of hydrogen, alkyl, substituted alkyl, aryl, substituted aryl, arylalkyl, and substituted arylalkyl, $R_3$ is selected from the group consisting of hydrogen, alkyl, substituted alkyl, aryl, substituted aryl, arylalkyl, and substituted arylalkyl, Ar is selected from the group consisting of aryl, substituted aryl, arylalkyl, and substituted arylalkyl, $R'_1$ is selected from the group consisting of hydrogen, alkyl, substituted alkyl, aryl, substituted aryl, arylalkyl, and substituted arylalkyl, $R'_2$ is selected from the group consisting of hydrogen, alkyl, substituted alkyl, aryl, substituted aryl, arylalkyl, and substituted arylalkyl, Ar' is selected from the group consisting of aryl, substituted aryl, arylalkyl, and substituted arylalkyl, and Z is selected from the group consisting of alkyl, substituted alkyl, aryl, substituted aryl, arylalkyl, and substituted arylalkyl. These colorants and the corresponding trimers and polymers can be prepared by reacting the chromophore moieties with a bridging group, and, if desired, with a terminal group in any desired order to obtain the desired product. The synthetic processes are similar to those employed for preparing the monomeric colorants except that the reaction stoichiometry may vary.

Further information regarding processes useful for the synthesis of colorants is disclosed in, for example, K. Venkataraman, "The Chemistry of Synthetic Dyes", Vol. 1, Academic Press (New York 1952); Organic and Biological Chemistry, A Series of Monographs, Academic Press, New York (1952); H. A. Lubs (editor), The Chemistry of Synthetic Dyes and Pigments, Robert E. Krieger Publishing Co., Inc., Malabar, Fla. (1982); H. R. Schwander, "Heterocyclic Azo Coupling Components," Dyes and Pigments, 3, 133–160 (1982); A. Ya. Zheltov, E. N. Avramenko, and B. I. Stepanov, "Investigations in the Regions of Aromatic Disulfides. X. Synthesis and Properties of Stilbene-2,2'-Disulfide and Its Derivatives," translated from Zhurnai Organicheskoi Khimii, 16, (2) 384–390, February, 1980; U.S. Pat. No. 4,284,782; N. R. Ayyangar, R. J. Lahoti, K. V. Srinivasan, Thomas Daniel and H. K. Venkataramaih, "Phenyl 3-aminobenzenesulphonates: New Intermediates for Arylazopyridone Disperse Dyes," Dyes and Pigments, 17, 279–286 (1991); Qinji Peng, Mujie, Li, Kunyu Gao and Lubai Cheng, "Hydrazone-Azo Tautomerism of Pyridone Azo Dyes. Part II: Relationship between Structure and pH Values," Dyes and Pigments, 15, 263–274 (1991); A. Cee, B. Horáková, and A. Lycka, "Structural Analysis of Substituted 3-Arylazo-2-hydroxy-6-pyridones," Dyes and Pigments, 9, 357–369 (1988); Ing Jing Wang, Yu Jen Hsu, and Jyn Hen Tian, "Synthesis and Properties of Some Pyridone Chromium Complex Azo Dyes," Dyes and Pigments, 16, 8391 (1991); P. Gregory, Dyes for Polyacrylonitrile, pp. 192–193, in Chemistry and Application of Dyes, D. R. Waring & G. Hallon, eds., Plenum Press (New York 1990); J. T. Guthrie, "Polymeric Colorants," Rev. Prog. Color, 20, 40 (1990); and Cheng Lubai, et al., "Colour and Constitution of Azo Dyes Derived from 2-Thioalkyl-4,6-diaminopyridines and 3-Cyano-1,4-dimethyl-6-hydroxy-2-pyridone as Coupling Components," Dyes and Pigments, 7, 373–388 (1986), the disclosures of each of which are totally incorporated herein by reference.

Dry toner compositions of the present invention generally comprise a resin, a colorant of one of the formulae set forth hereinabove, and an optional charge control agent. The colorant is present in any amount effective to impart to the toner the desired color and intensity. Typically, the colorant is present in the toner in an amount of from about 0.5 to about 15 percent by weight, preferably from about 1 to about 3 percent by weight, and more preferably from about 2 to about 3 percent by weight, although the amount can be outside these ranges.

Typical toner resins include polyesters, such as those disclosed in U.S. Pat. No. 3,590,000, the disclosure of which is totally incorporated herein by reference, polyamides, epoxies, polyurethanes, diolefins, vinyl resins and polymeric esterification products of a dicarboxylic acid and a diol comprising a diphenol. Examples of vinyl monomers include styrene, p-chlorostyrene, vinyl naphthalene, unsaturated mono-olefins such as ethylene, propylene, butylene, isobutylene and the like; vinyl halides such as vinyl chloride, vinyl bromide, vinyl fluoride, vinyl acetate, vinyl propionate, vinyl benzoate, and vinyl butyrate; vinyl esters such as esters of monocarboxylic acids, including methyl acrytate, ethyl acrylate, n-butyl acrylate, isobutyl acrylate, dodecyl acrylate, n-octyl acrylate, 2-chloroethyl acrylate, phenyl acrylate, methylalpha-chloroacrylate, methyl methacrylate, ethyl methacrylate, butyl methacrylate, and the like; acrylonitrile, methacrylonitrile, acrylamide, vinyl ethers, including vinyl methyl ether, vinyl isobutyl ether, and vinyl ethyl ether; vinyl ketones such as vinyl methyl ketone, vinyl hexyl ketone, and methyl isopropenyl ketone; N-vinyl indole and N-vinyl pyrrolidene; styrene butadienes, including those disclosed in U.S. Pat. No. 4,560,635, the disclosure of which is totally incorporated herein by reference; mixtures of these monomers; and the like. The resins are present in the toner in any effective amount, typically from about 75 to about 98 percent by weight, preferably from about 90 to about 98 percent by weight, and more preferably from about 95 to about 96 percent by weight, although the amount can be outside these ranges.

If desired or necessary, the toner compositions of the present invention can also contain a charge control agent. Any charge control agent suitable for charging dry toners can be employed, such as alkyl pyridinium halides, including cetyl pyridinium chloride and others as disclosed in U.S. Pat. No. 4,298,672, the disclosure of which is totally incorporated herein by reference, distearyl dimethyl ammonium methyl sulfate as disclosed in U.S. Pat. No. 4,560,635, the disclosure of which is totally incorporated herein by reference, charge control agents as disclosed in U.S. Pat. Nos. 4,464,452 and 4,480,021, the disclosures of each of which are totally incorporated herein by reference, distearyl dimethyl ammonium bisulfate as disclosed in U.S. Pat. No. 4,937,157, U.S. Pat. No. 4,560,635, and copending application Ser. No. 07/396,497, the disclosures of each of which are totally incorporated herein by reference, zinc 3,5-di-tert-butyl salicylate compounds, such as Bontron E-84, available from Orient Chemical Company of Japan, or zinc compounds as disclosed in U.S. Pat. No. 4,656,112, the disclosure of which is totally incorporated herein by reference, aluminum 3,5-di-tert-butyl salicylate compounds, such as Bontron E-88, available from Orient Chemical Company of Japan, or aluminum compounds as disclosed in U.S. Pat. No. 4,845,003, the disclosure of which is totally incorporated herein by reference, and the like, as well as mixtures thereof and/or any other charge control agent suitable for dry electrophotographic toners. The charge control agent, if present, is present in the toner in any amount effective to obtain the desired charging characteristics. Typically, the charge control agent is present in an amount of from about 0.5 to about 3 percent by weight, preferably from about 1 to about 2 percent by weight, and more preferably from about 1 to about 1.5 percent by weight, although the amount can be outside these ranges.

The toner compositions can be prepared by any suitable method. For example, the components of the dry toner particles can be mixed in a ball mill, to which steel beads for agitation are added in an amount of approximately five times the weight of the toner. The ball mill can be operated at about 120 feet per minute for about 30 minutes, after which time the steel beads are removed. Dry toner particles for two-component developers generally have an average particle size of from about 6 to about 20 microns.

Another method, known as spray drying, entails dissolving the appropriate polymer or resin in an organic solvent such as toluene or chloroform, or a suitable solvent mixture. The toner colorant is also added to the solvent. Vigorous agitation, such as that obtained by ball milling processes, assists in assuring good dispersion of the colorant. The solution is then pumped through an atomizing nozzle while using an inert gas, such as nitrogen, as the atomizing agent. The solvent evaporates during atomization, resulting in toner particles of a colored resin, which are then attrited and classified by particle size. Particle diameter of the resulting toner varies, depending on the size of the nozzle, and generally varies between about0.1 and about 100 microns.

Another suitable process is known as the Banbury method, a batch process wherein the dry toner ingredients are pre-blended and added to a Banbury mixer and mixed, at which point melting of the materials occurs from the heat energy generated by the mixing process. The mixture is then dropped into heated rollers and forced through a nip, which results in further shear mixing to form a large thin sheet of the toner material. This material is then reduced to pellet form and further reduced in size by grinding or jetting, after which the particles are classified by size.

Another suitable toner preparation process, extrusion, is a continuous process that entails dry blending the toner ingredients, placing them into an extruder, melting and mixing the mixture, extruding the material, and reducing the extruded material to pellet form. The pellets are further reduced in size by grinding or jetting, and are then classified by particle size.

Other similar blending methods may also be used. Subsequent to size classification of the toner particles, any external additives are blended with the toner particles. If desired, the resulting toner composition is then mixed with carrier particles.

Any suitable external additives can also be utilized with the dry toner particles. The amounts of external additives are measured in terms of percentage by weight of the toner composition, but are not themselves included when calculating the percentage composition of the toner. For example, a toner composition containing a resin, a colorant, and an external additive can comprise 80 percent by weight resin and 20 percent by weight colorant; the amount of external additive present is reported in terms of its percent by weight of the combined resin and colorant. External additives can include any additives suitable for use in electrostatographic toners, including straight silica, colloidal silica (e.g. Aerosil R972®, available from Degussa, Inc.), ferric oxide, Unilin®, polypropylene waxes, polymethylmethacrylate, zinc stearate, chromium oxide, aluminum oxide, stearic acid, polyvinylidene fluoride (e.g. Kynar®, available from Pennwalt Chemicals Corporation), and the like. External additives can be present in any desired or effective amount.

Dry toners of the present invention can be employed alone in single component development processes, or they can be employed in combination with carrier particles in two component development processes. Any suitable carrier particles can be employed with the toner particles. Typical carrier particles include granular zircon, steel, nickel, iron ferrites, and the like. Other typical carrier particles include nickel berry carriers as disclosed in U.S. Pat. No. 3,847,604, the entire disclosure of which is incorporated herein by reference. These carriers comprise nodular carrier beads of nickel characterized by surfaces of reoccurring recesses and protrusions that provide the particles with a relatively large external area. The diameters of the carrier particles can vary, but are generally from about 50 microns to about 1,000 microns, thus allowing the particles to possess sufficient density and inertia to avoid adherence to the electrostatic images during the development process.

Carrier particles can possess coated surfaces. Typical coating materials include polymers and terpolymers, including, for example, fluoropolymers such as polyvinylidene fluorides as disclosed in U.S. Pat. No. 3,526,533, U.S. Pat. No. 3,849,186, and U.S. Pat. No. 3,942,979, the disclosures of each of which are totally incorporated herein by reference. Coating of the carrier particles may be by any suitable process, such as powder coating, wherein a dry powder of the coating material is applied to the surface of the carrier particle and fused to the core by means of heat, solution coating, wherein the coating material is dissolved in a solvent and the resulting solution is applied to the carrier surface by tumbling, or fluid bed coating, in which the carrier particles are blown into the air by means of an air stream, and an atomized solution comprising the coating material and a solvent is sprayed onto the airborne carrier particles repeatedly until the desired coating weight is achieved. Carrier coatings may be of any desired thickness or coating weight. Typically, the carrier coating is present in an amount of from about 0.1 to about 1 percent by weight of the uncoated carrier particle, although the coating weight may be outside this range.

The toner is present in the two-component developer in any effective amount, typically from about 1 to about 5 percent by weight of the carrier, and preferably about 3 percent by weight of the carrier, although the amount can be outside these ranges.

Any suitable conventional electrophotographic development technique can be utilized to deposit toner particles of the present invention on an electrostatic latent image on an imaging member. Well known electrophotographic development techniques include magnetic brush development, cascade development, powder cloud development, electrophoretic development, and the like. Magnetic brush development is more fully described, for example, in U.S. Pat. No. 2,791,949, the disclosure of which is totally incorporated herein by reference; cascade development is more fully described, for example, in U.S. Pat. No. 2,618,551 and U.S. Pat. No. 2,618,552, the disclosures of each of which are totally incorporated herein by reference; powder cloud development is more fully described, for example, in U.S. Pat. No. 2,725,305, U.S. Pat. No. 2,918,910, and U.S. Pat. No. 3,015,305, the disclosures of each of which are totally incorporated herein by reference; and liquid development is more fully described, for example, in U.S. Pat. No. 3,084,043, the disclosure of which is totally incorporated herein by reference.

The deposited toner image can be transferred to a receiving member such as paper or transparency material by any suitable technique conventionally used in electrophotography, such as corona transfer, pressure transfer, adhesive transfer, bias roll transfer, and the like. Typical corona transfer entails contacting the deposited toner particles with a sheet of paper and applying an electrostatic charge on the side of the sheet opposite to the toner particles. A single wire corotron having applied thereto a potential of between about 5000 and about 8000 volts provides satisfactory transfer.

After transfer, the transferred toner image can be fixed to the receiving sheet. The fixing step can be also identical to that conventionally used in electrophotographic imaging. Typical, well known electrophotographic fusing techniques include heated roll fusing, flash fusing, oven fusing, laminating, adhesive spray fixing, and the like.

Liquid developers of the present invention suitable for polarizable liquid development processes can comprise a nonaqueous liquid vehicle and a colorant of one or more of the structures indicated hereinabove. When the liquid developer is intended for use in a polarizable liquid development system, the liquid developer is applied to an applicator such as a gravure roll and brought near an electrostatic latent image. The charged image polarizes the liquid developer in the depressions in the applicator, thereby drawing the developer from the depressions and causing it to flow to the image bearing member to develop the image. For this application, the liquid developer is somewhat more viscous than is the situation with electrophoretic development, since particle migration within the developer is generally not necessary and since the liquid developer must be sufficiently viscous to remain in the depressions in the applicator prior to development. The viscosity, however, remains significantly lower than that typically observed for many printing inks, since the liquid developer must be capable of being pulled from the depressions in the applicator roll by the force exerted by the electrostatic latent image. Thus, liquid developers for use in polar development systems typically have a viscosity of from about 25 to about 500 centipoise at the operating temperature of the copier or printer, and preferably from about 30 to about 300 centipoise at the machine operating temperature, although the viscosity can be outside these ranges. In addition, liquid developers intended for use in polarizable liquid development systems typically have a resistivity lower than liquid developers employed in electrophoretic development systems to enable the developer to become polarized upon entering proximity with the electrostatic latent image. The liquid developers of the present invention, however, generally have resistivities that are significantly higher than the resistivities of typical printing inks, for which resistivities generally are substantially less than about $10^9$ ohm-cm. Typically, liquid developers for polarizable liquid development systems have a resistivity of from about $10^8$ to about $10^{11}$ ohm-cm, and preferably from about $2\times10^9$ to about $10^{10}$ ohm-cm, although the resistivity can be outside these ranges.

In polarizable liquid developers of the present invention wherein the colorant is present directly dissolved or dispersed in the liquid vehicle, the colorant is present in any amount effective to impart to the developer the desired color and intensity. Typically, the colorant is present in the liquid developer in an amount of from about 1 to about 50 percent by weight, preferably from about 15 to about 30 percent by weight, and more preferably from about 20 to about 25 percent by weight, although the amount can be outside these ranges.

Typical liquid materials suitable as liquid vehicles for polarizable liquid developers include paraffinic and isoparaffinic hydrocarbons, such as Isopar® L, Norpar® 15, Norpar® 16, and the like, available from Exxon Corporation, mineral oil, pentadecane, hexadecane, and the like. The liquid vehicle is present in the liquid developer in a major amount, typically from about 50 to about 99 percent by weight, preferably from about 95 to about 99 percent by weight, and more preferably from about 98 to about 99 percent by weight, although the amount can be outside these ranges.

If desired, the polarizable liquid developers of the present invention can also contain various polymers added to modify the viscosity of the developer or to modify the mechanical properties of the developed or cured image such as adhesion or cohesion. In particular, when the liquid developer of the present invention is intended for use in polarizable liquid development processes, the developer can also include viscosity controlling agents. Examples of suitable viscosity controlling agents include thickeners such as alkylated polyvinyl pyrrolidones, such as Ganex V216, available from GAF; polyisobutylenes such as Vistanex, available from Exxon Corporation, Kalene 800, available from Hardman Company, N.J., ECA 4600, available from Paramins, Ontario, and the like; Kraton G-1701, a block copolymer of polystyrene-b-hydrogenated butadiene available from Shell Chemical Company, Polypale Ester 10, a glycol rosin ester available from Hercules Powder Company; and other similar thickeners. In addition, additives such as pigments, including silica pigments such as Aerosil 200, Aerosil 300, and the like available from Degussa, Bentone 500, a treated montmorillonite clay available from NL Products, and the like can be included to achieve the desired developer viscosity. Additives are present in any effective amount, typically from about 1 to about 40 percent by weight in the case of thickeners and from about 0.5 to about 5 percent by weight in the case of pigments and other particulate additives, although the amounts can be outside these ranges.

In addition, liquid developers of the present invention intended for use in polarizable liquid development processes can also contain conductivity enhancing agents. For example, the developers can contain additives such as quaternary ammonium compounds as disclosed in, for example, U.S. Pat. No. 4,059,444, the disclosure of which is totally incorporated herein by reference.

In another embodiment of the present invention, liquid developers comprise a nonaqueous liquid vehicle, a charge control agent, and toner particles comprising a mixture of a resin and a colorant of one or more of the formulas set forth hereinabove. Liquid developers of this embodiment of the present invention can be employed in either electrophoretic development processes or polarizable liquid development processes. When employed in polarizable liquid development processes, the developer generally has the characteristics set forth hereinabove with respect to liquid developers in which the colorant is dissolved or dispersed directly in the liquid vehicle, except that colored toner particles replace the dissolved or dispersed colorant. When the liquid developer is intended for use in electrophoretic development systems, the liquid vehicle must be capable of permitting the colored toner particles of the developer to migrate through the vehicle to develop electrostatic latent images. Thus, in electrophoretic developers, the liquid vehicle is sufficiently high in resistivity to enhance the development of particles over that of free ions, typically having a resistivity of more than about $5\times10^9$ ohm-cm and preferably more than about $10^{10}$ ohm-cm as measured by determining the average current flowing across a 1.5 millimeter gap at 5 hertz and 5 volts square wave applied potential, although the resistivity can be outside these ranges. In addition, the liquid vehicle is sufficiently low in viscosity to permit the toner particles to migrate toward the electrostatic latent image with sufficient rapidity to enable development of the image within the desired development time. Typically, the liquid vehicle has a viscosity of no more than about 20 centipoise at the operating temperature of the copier or printer, and preferably no more than about 3 centipoise at the machine operating temperature, although the viscosity can be outside these ranges.

Typical liquid materials suitable as liquid vehicles for electrophoretic liquid developers include high purity aliphatic hydrocarbons with, for example, from about 6 to about 25 carbon atoms and preferably with a viscosity of less than 2 centipoise, such as Norpar® 12, Norpar® 13, and Norpar® 15, available from Exxon Corporation, isoparaffinic hydrocarbons such as Isopar® G, H, K, L, M, and V, available from Exxon Corporation, Amsco® 460 Solvent, Amsco® OMS, available from American Mineral Spirits Company, Soltrol®, available from Phillips Petroleum Company, Pagasol®, available from Mobil Oil Corporation, Shellsol®, available from Shell Oil Company, and the like, as well as mixtures thereof. Isoparaffinic hydrocarbons are preferred liquid media, since they are colorless, environmentally safe, and possess a sufficiently high vapor pressure so that a thin film of the liquid evaporates from the contacting surface within seconds at ambient temperatures. The liquid vehicle is present in the liquid developer in a major amount, typically from about 50 to about 99 percent by weight, preferably from about 95 to about 99 percent by weight, and more preferably from about 98 to about 99 percent by weight, although the amount can be outside these ranges.

The toner particles generally comprise colored polymeric particles, wherein the colorant is of one or more of the structures indicated hereinabove. Generally, the polymer is relatively insoluble in the liquid vehicle. Typically, the polymer is soluble in the liquid vehicle in amounts of about 5 percent by weight or less of the liquid vehicle at ambient temperature (generally from about 20° to about 30° C.). Examples of suitable polymers include ethylene-vinyl acetate copolymers such as the Elvax® I resins and Elvax 5720 resin, available from E.I. Du Pont de Nemours & Company, copolymers of ethylene and an α,β-ethylenically unsaturated acid selected from acrylic or methacrylic acid, where the acid moiety is present in an amount of from 0.1 to 20 percent by weight, such as the Nucrel® II resins and Nucrel 589 and Nucrel 960 resins, available from E.I. Du Pont de Nemours & Company, polybutyl terephthalates, ethylene ethyl acrylate copolymers such as those available as Bakelite DPD 6169, DPDA 6182 Natural, and DTDA 9169 Natural from Union Carbide Company, ethylene vinyl acetate resins such as DQDA 6479 Natural 7 and DQDA 6832 Natural 7 avalable from Union Carbide Company, methacrylate resins such as polybutyl methacrylate, polyethyl methacrylate, and polymethyl methacrylate, available under the trade name Elvacite from E.I. Du Pont de Nemours & Company, and others as disclosed in, for example, British Patent 2,169,416, and U.S. Pat. No. 4,794,651, the disclosures of each of which are totally incorporated herein by reference.

The colored particles can be made by any suitable process, such as by a method employing an attritor, as disclosed in, for example, U.S. Pat. No. 5,123,962, U.S. Pat. No. 5,053,306, and U.S. Pat. No. 5,168,022, the disclosures of each of which are totally incorporated herein by reference, or a method employing a microfluidizer, as disclosed in, for example, U.S. Pat. No. 4,783,389, the disclosure of which is totally incorporated herein by reference, or a method employing a piston homogenizer, as disclosed in copending application U.S. Ser. No. 08/098,150, filed Jul. 28, 1993, entitled "Processes for the Preparation of Developer Compositions," with the named inventors Timothy J. Fuller, James R. Larson, and Frank J. Bonsignore, the disclosure of which is totally incorporated herein by reference, or the like.

In addition, the liquid developers of the present invention can contain toner particles comprising colored silica particles as disclosed in copending application U.S. Ser. No. 07/369,003, the disclosure of which is totally incorporated herein by reference. Colored silica particles can be prepared by the processes described in, for example, U.S. Pat. No. 4,566,908, U.S. Pat. No. 4,576,888, U.S. Pat. No. 4,877,451, and copending application U.S. Ser. No. 07/369,003, the disclosures of each of which are totally incorporated herein by reference.

The colorant is present in the toner particles, and the toner particles are contained in the developer, in any amount effective to impart to the developer the desired color and intensity. Typically, the colorant is present in the toner particles in an amount of from about 1 to about 30 percent by weight, preferably from about 10 to about 25 percent by weight, although the amount can be outside these ranges. Typically, the toner particles are present in the liquid developer in an amount of from about 1 to about 50 percent by weight, preferably from about 1 to about 7 percent by weight, and more preferably about 2 percent by weight, although the amount can be outside these ranges.

The liquid developers of the present invention generally can be prepared by any suitable method. For example, when the toner ingredients comprise colored silica particles, the developer can be prepared by heating and mixing the ingredients, followed by grinding the mixture in an attritor until homogeneity of the mixture has been achieved. When the liquid developer comprises a colorant dissolved or dispersed directly in the liquid vehicle, the developer can be prepared by simple mixing of the developer ingredients. When the liquid developer comprises colored polymeric particles dispersed in the liquid vehicle, the polymeric resin imbibes the colorant during the grinding process. In a typical procedure, colorant, resin, a charge control agent, and the liquid vehicle are charged into an attritor and the mixture is heated, typically to temperatures of from about 200° to about 212° F., typically for about 15 minutes. The heat source is then removed and grinding at ambient temperature is continued, typically for about 2 hours. Water cooling of the exterior of the vessel and continued grinding is then carried out, typically for about four hours, to result in particles ranging in average particle diameter of from about 1 to about 2 microns. Additional information regarding methods of preparing toner particles is disclosed in, for example, U.S. Pat. No. 4,476,210, U.S. Pat. No. 4,794,651, U.S. Pat. No. 4,877,698, U.S. Pat. No. 4,880,720, U.S. Pat. No. 4,880,432, U.S. Pat. No. 4,762,764, U.S. Pat. No. 3,729,419, U.S. Pat. No. 3,841,893, and U.S. Pat. No. 3,968,044, the disclosures of each of which are totally incorporated herein by reference.

The electrophoretic liquid developers of the present invention can also include a charge control agent to help impart a charge to the colored toner particles. A charge control additive is generally present in the electrophoretic liquid developers of the present invention to impart to the particles contained in the liquid a charge sufficient to enable them to migrate through the liquid vehicle to develop an image. Examples of suitable charge control agents for liquid developers include the lithium, cadmium, calcium, manganese, magnesium and zinc salts of heptanoic acid; the barium, aluminum, cobalt, manganese, zinc, cerium and zirconium salts of 2-ethyl hexanoic acid, (these are known as metal octoates); the barium, aluminum, zinc, copper, lead and iron salts of stearic acid; the calcium, copper, manganese, nickel, zinc and iron salts of naphthenic acid; and ammonium lauryl sulfate, sodium dihexyl sulfosuccinate, sodium dioctyl sulfosuccinate, aluminum diisopropyl salicylate, aluminum resinate, aluminum salt of 3,5 di-t-butyl gamma resorcylic acid. Mixtures of these materials may also be used. Particularly preferred charge control agents include lecithin (Fisher Inc.); OLOA 1200, a polyisobutylene succinimide available from Chevron Chemical Company; basic barium petronate (Witco Inc.); zirconium octoate (Nuodex); aluminum stearate; salts of calcium, manganese, magnesium and zinc with heptanoic acid; salts of barium, aluminum, cobalt, manganese, zinc, cerium, and zirconium octoates; salts of barium, aluminum, zinc, copper, lead, and iron with stearic acid; iron naphthenate; aluminum t-butyl salicylate; and the like, as well as mixtures thereof. The charge control additive may be present in an amount of from about 0.001 to about 3 percent by weight, and preferably from about 0.01 to about 0.8 percent by weight of the developer composition. Other additives, such as charge adjuvants added to improve charging characteristics of the developer, may be added to the developers of the present invention, provided that the objectives of the present invention are achieved. Charge adjuvants such as stearates, metallic soap additives, polybutylene succinimides, and the like are described in references such as U.S. Pat. No. 4,707,429, U.S. Pat. No. 4,702,984, and U.S. Pat. No. 4,702,985, the disclosures of each of which are totally incorporated herein by reference.

In general, images are developed with the liquid electrophoretic developers and the polarizable liquid developers of the present invention by generating an electrostatic latent image and contacting the latent image with the liquid developer, thereby causing the image to be developed. When a liquid electrophoretic developer of the present invention is employed, the process entails generating an electrostatic latent image and contacting the latent image with the developer comprising a liquid vehicle and charged toner particles, thereby causing the charged particles to migrate through the liquid and develop the image. Developers and processes of this type are disclosed in, for example, U.S. Pat. No. 4,804,601, U.S. Pat. No. 4,476,210, U.S. Pat. No. 2,877,133, U.S. Pat. No. 2,890,174, U.S. Pat. No. 2,899,335, U.S. Pat. No. 2,892,709, U.S. Pat. No. 2,913,353, U.S. Pat. No. 3,729,419, U.S. Pat. No. 3,841,893, U.S. Pat. No. 3,968,044, U.S. Pat. No. 4,794,651, U.S. Pat. No. 4,762,764, U.S. Pat. No. 4,830,945, U.S. Pat. No. 3,976,808, U.S. Pat. No. 4,877,698, U.S. Pat. No. 4,880,720, U.S. Pat. No. 4,880,432, and copending application U.S. Ser. No. 07/300,395, the disclosures of each of which are totally incorporated herein by reference. When a liquid developer of the present invention suitable for polarizable liquid development processes is employed, the process entails generating an electrostatic latent image on an imaging member, applying the liquid developer to an applicator, and bringing the applicator into sufficient proximity with the latent image to cause the image to attract the developer onto the imaging member, thereby developing the image. Developers and processes of this type are disclosed in, for example, U.S. Pat. No. 4,047,943, U.S. Pat. No. 4,059,444, U.S. Pat. No. 4,822,710, U.S. Pat. No. 4,804,601, U.S. Pat. No. 4,766,049, U.S. Pat. No. 4,686,936, U.S. Pat. No. 4,764,446, Canadian Patent 937,823, Canadian Patent 926,182, Canadian Patent 942,554, British Patent 1,321,286, and British Patent 1,312,844, the disclosures of each of which are totally incorporated herein by reference. In both of these embodiments, any suitable means can be employed to generate the image. For example, a photosensitive imaging member can be exposed by incident light or by laser to generate a latent image on the member, followed by development of the image and transfer to a substrate such as paper, transparency material, cloth, or the like. In addition, an image can be generated on a dielectric imaging member by electrographic or ionographic processes as disclosed, for example, in U.S. Pat. No. 3,564,556, U.S. Pat. No. 3,611,419, U.S. Pat. No. 4,240,084, U.S. Pat. No. 4,569,584, U.S. Pat. No. 2,919,171, U.S. Pat. No. 4,524,371, U.S. Pat. No. 4,619,515, U.S. Pat. No. 4,463,363, U.S. Pat. No. 4,254,424, U.S. Pat. No. 4,538,163, U.S. Pat. No. 4,409,604, U.S. Pat. No. 4,408,214, U.S. Pat. No. 4,365,549, U.S. Pat. No. 4,267,556, U.S. Pat. No. 4,160,257, U.S. Pat. No. 4,485,982, U.S. Pat. No. 4,731,622, U.S. Pat. No. 3,701,464, and U.S. Pat. No. 4,155,093, the disclosures of each of which are totally incorporated herein by reference, followed by development of the image and, if desired, transfer to a substrate. If necessary, transferred images can be fused to the substrate by any suitable means, such as by heat, pressure, exposure to solvent vapor or to sensitizing radiation such as ultraviolet light or the like as well as combinations thereof. Further, the liquid developers of the present invention can be employed to develop electrographic images wherein an electrostatic image is generated directly onto a substrate by electrographic or ionographic processes and then developed, with no subsequent transfer of the developed image to an additional substrate.

Specific embodiments of the invention will now be described in detail. These examples are intended to be illustrative, and the invention is not limited to the materials, conditions, or process parameters set forth in these embodiments. All parts and percentages are by weight unless otherwise indicated.

EXAMPLE I

Pyridinium acetamide chloride, of the formula

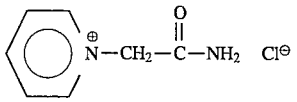

was prepared as described at page 192 in P. Gregory, Dyes for Polyacrylonitrile, Plenum Press (New York 1990), the disclosure of which is totally incorporated herein by reference. More specifically, chloroacetamide (93.5 g, obtained from Aldrich Chemical Co., Milwaukee, Wis.) and dimethyl formamide (200 mL, obtained from Aldrich Chemical Co., Milwaukee, Wis.) were heated to form a solution in a 1 liter, 3-neck flask equipped with a mechanical stirrer and reflux condenser. Pyridine (85 mL, obtained from Aldrich Chemical Co., Milwaukee, Wis.) was then added and the reaction was heated to 110° C. with continued stirring for 1 hour. The solid product was filtered, slurried in acetone (500 mL), and then refiltered. After vacuum drying at 40° C., pyridinium acetamide chloride (157.4 grams) was obtained.

EXAMPLE II

1-Hydrido-6-hydroxy-3-pyridinium-4-methyl-2-pyridone chloride, of the formula

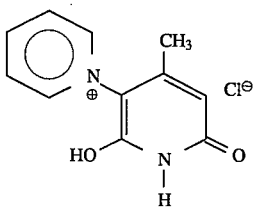

was prepared as described at page 192 in P. Gregory, Dyes for Polyacrylonitrile, Plenum Press (New York 1990), the disclosure of which is totally incorporated herein by reference. More specifically, ethyl acetoacetate (118 g, obtained from Aldrich Chemical Co., Milwaukee, Wis.), pyridium acetamide (157.4 g, obtained from Aldrich Chemical Co., Milwaukee, Wis.) and methanol (454 mL) were combined in a 1 liter, 3-neck flask equipped with a mechanical stirrer, an addition funnel, and a reflux condenser. Sodium hydroxide (36.3 g) in water (91 mL) was added. The reaction mixture was then boiled for 3 hours at reflux. After cooling to 25° C., the product was isolated by filtration and vacuum dried to yield 156.1 grams.

EXAMPLE III 1,4-Dimethyl-6-hydroxy-3-cyano-2-pyridone, of the formula

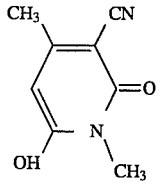

was prepared as described in U.S. Pat. No. 4,284,782, the disclosure of which is totally incorporated herein by reference. More specifically, methyl cyanoacetate (99 g, obtained from Aldrich Chemical Co., Milwaukee, Wis.) in a 1 liter, 3-neck flask equipped with an addition funnel and mechanical stirrer was cooled to between 5° and 10° C. using an ice bath. With stirring, an aqueous solution containing 40 percent by weight methylamine (178.6 grams, obtained from Aldrich Chemical Co., Milwaukee, Wis.) was added. After 1 hour, acetoacetic acid ethyl ester (149.6 grams, obtained from Aldrich Chemical Co., Milwaukee, Wis.) was added. The mixture was then heated in a pressure reaction vessel 4 hours at 85° C. An aqueous solution containing 27 percent by weight sodium hydroxide (296 g) was added, and then 33 grams of distillate were removed at 85° C. by simple distillation. The mixture was added to ice (100 g) and an aqueous solution containing 61 percent by weight sulfuric acid (21.7 g). Vigorous frothing took place. The prouct was isolated by filtration, washed with water, and then vacuum dried to yield 147.1 g. After recrystailization from ethanol, the product decomposed between 272° and 285° C.

EXAMPLE IV 4,4'-Trimethylene-bis(pyridium acetamide chloride), of the formula

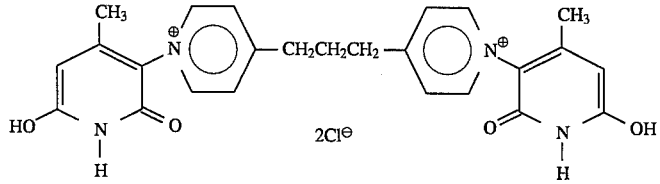

was prepared as follows. To a 1 liter, 3-neck flask equipped with a mechanical stirrer, reflux condenser, and addition funnel was added chloroacetamide (93.5 g, 1 mot, obtained from Aldrich Chemical Co., Milwaukee, Wis.) and dimethyl formamide (200 mL, obtained from Aldrich Chemical Co., Milwaukee, Wis.). The mixture was warmed to 45° C. to form a solution, and then 4,4'-trimethylenedipyridine (100 g, 0.504 mol, obtained from Aldrich Chemical Co., Milwaukee, Wis.) was added with stirring. The reaction was heated for 1 hour between 100° and 110° C. After the mixture was allowed to cool to 25° C, the product was isolated by filtration, slurried in acetone (500 mL), refiltered, and then vacuum dried at 40° C. to obtain 181.4 g of the product.

EXAMPLE V 4,4'-Trimethylene-bis(pyridium acetamide chloride), of the formula

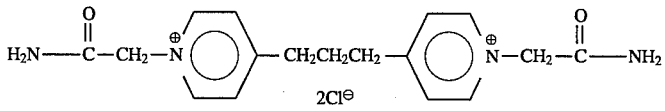

was prepared as follows. A 1 liter, 3-neck flask was equipped with a mechanical stirrer, reflux condenser, and addition funnel. To a rapidly stirring mixture of ethyl acetoacetate (130 g, 1 mol, obtained from Aldrich Chemical Co., Milwaukee, Wis.) and trimethylene-bis(pyridinium acetamide chloride) (166.5 g, prepared as described in Example IV) in methanol (500 mL) was added 80 g of an aqueous solution containing 50 percent by weight sodium hydroxide (1 mol)

diluted with water to 100 mL. After boiling at reflux for 3 hours, the mixture was cooled to 25° C. and the product was isolated by filtration and vacuum dried to obtain 59 grams.

EXAMPLE VI

A yellow colorant of the formula

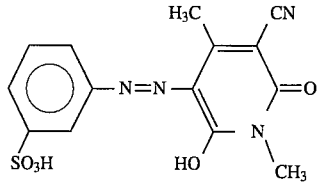

was prepared as follows. Metanilic acid (3.06 g, obtained from Fisher Scientific, Pittsburgh, Pa.) in water (50 mL) and concentrated hydrochloric acid (5 mL) at between 0° and 5° C. were combined with an aqueous solution containing sodium nitrite (97 percent by weight pure, 1.17 g) in water (15 mL) at between 0° and 5° C. with ice bath cooling for 30 minutes. This solution was added to the cyano-pyridone (2.8 g) prepared as described in Example III in water (200 mL) containing sodium acetate ( 1.8 g) and sodium hydroxide (0.89 g) with magnetic stirring and ice bath cooling for 4 hours at 5° C. Ethanol (200 mL) was added and the resultant crystals that formed were isolated by filtration and vacuum dried to yield the yellow colorant.

EXAMPLE VII

A yellow colorant of the formula

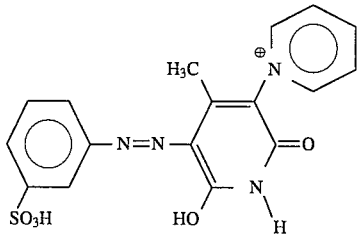

was prepared as follows. Metanilic acid (3.06 g, obtained from Fisher Scientific, Pittsburgh, Pa.) in water (50 mL) and concentrated hydrochloric acid (5 mL) at between 0° and 5° C. were combined with an aqueous solution containing sodium nitrite (97 percent by weight pure, 1.17 g) in water (15 mL) at between 0° and 5° C. with ice bath cooling for 30 minutes. This solution was added to the pyridinium-pyridone (4 g) prepared as described in Example II in water (200 mL) with magnetic stirring and ice bath cooling for 1 hour at 5° C. The crystals that formed were isolated by filtration and vacuum dried to yield the yellow colorant.

EXAMPLE VIII

A yellow colorant of the formula

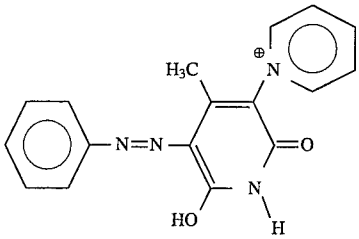

was prepared as follows. Aniline (1.58 g, obtained from Fisher Scientific, Pittsburgh, Pa.) in water (50 mL) and concentrated hydrochloric acid (5 mL) at between 0° and 5° C. were combined with an aqueous solution containing sodium nitrite (97 percent by weight pure, 1.17 g) in water (15 mL) at between 0° and 5° C. with ice bath cooling for 30 minutes. This solution was added to the pyridinium-pyridone (4 g) prepared as described in Example II in water (200 mL) with magnetic stirring and ice bath cooling for 1 hour at 5° C. The yellow colorant crystallized and was isolated by filtration and vacuum dried.

EXAMPLE IX

A colorant of the formula

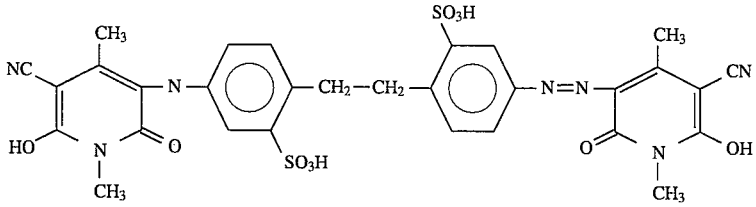

was prepared as follows. A solution of 4,4'-diaminostilbene-2,2'-disulfonic acid (3.2 g, obtained from Eastman Kodak Co., Rochester, N.Y.) in water (50 mL) and chopped ice (20 g) at 5° C. admixed with 2 mL of water containing 0.69 g of sodium hydroxide was combined with sodium nitrite (97 percent by weight pure, 1.44 g) in water (10 mL) at 5° C. Concentrated (10 molar) hydrochloric acid (5 mL) was added and the resultant mixture was stirred for 30 minutes. The above mixture was added to the cyano-pyridone (3.28 g) prepared as described in Example III in 100 mL water with sodium hydroxide (1.82 g) and sodium acetate (3.6 g) at 5° C. with ice bath cooling. After 1 hour the colorant product was salted out of solution with saturated aqueous potassium chloride and isolated by filtration.

EXAMPLE X

A greenish purple colorant of the formula

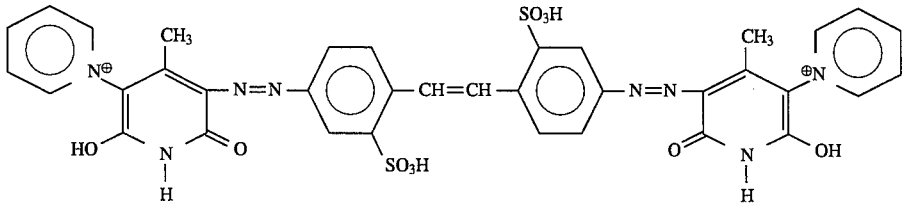

was prepared as follows. A solution of 4,4'-diaminostilbene-2,2'-disuifonic acid (3.2 g, obtained from Eastman Kodak Co., Rochester, N.Y.) in water (50 mL) and chopped ice (20 g) at 5° C. admixed with 2 mL of water containing 0.69 g sodium hydroxide was combined with sodium nitrite (97 percent by weight pure, 1.44 g) in water (10 mL) at 5° C. Concentrated (10 molar) hydrochloric acid ( 5 mL) was added and the resultant mixture was stirred for 30 minutes. The above mixture was added to the pyridinium pyridone (4.77 g) prepared as described in Example II in 100 mL water with sodium hydroxide (1.82 g) and sodium acetate (3.6 g) at 5° C. with ice bath cooling. After 1 hour the colorant product was salted out of solution with saturated aqueous potassium chloride and isolated by filtration.

EXAMPLE XI

A yellow colorant of the formula

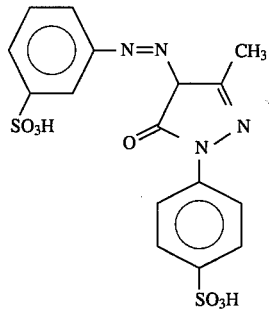

was prepared as follows. Metanilic acid (3.06 g, obtained from Eastman Kodak Co., Rochester, N.Y.)in water (50 mL) and concentrated hydrochloric acid (5 mL) at between 0° and 5° C. were combined with an aqueous solution containing sodium nitrite (97 percent by weight pure, 1.22 g) in water (15 mL) at between 0° and 5° C. with ice bath cooling for 30 minutes. This solution was added to 3-methyl-1-(p-sulfophenyl)-2-pyrazolin-5-one (4.49 g, obtained from Eastman Kodak Co., Rochester, N.Y.) in water (200 mL) containing sodium hydroxide (0.8 g) and sodium acetate (1.8 g) with magnetic stirring and ice bath cooling for 1 hour at 5° C. Ethanol was added until the solution became cloudy, and the resultant yellow colorant was isolated by filtration and vacuum dried.

EXAMPLE XII

A yellow colorant of the formula

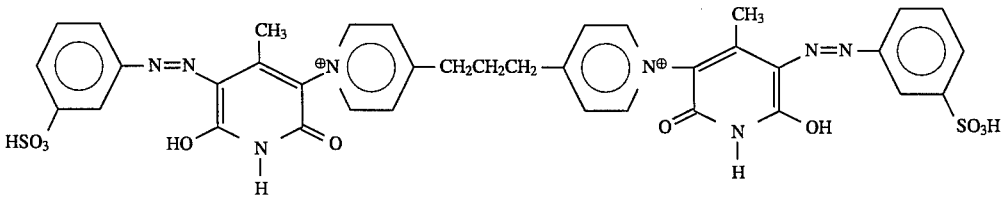

was prepared as follows. Metanilic acid (2.68 g, obtained from Eastman Kodak Co., Rochester, N.Y.) in water (50 mL) and concentrated hydrochloric acid (5 mL) at between 0° and 5° C. were combined with an aqueous solution containing sodium nitrite (97 percent by weight pure, 1.07 g) in water (15 mL) at between 0° and 5° C. with ice bath cooling for 30 minutes. This diazonium salt solution was rapidly added to an aqueous solution of a bis(pyridinium-pyridone) of the formula

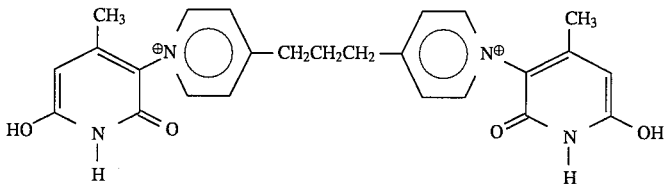

prepared as follows: a bis(pyridinium-pyridone) (4 g, 0.0155 mol) as prepared in Example V in water (350 mL) was heated to between 60° and 70° C. The resultant solution was then cooled using an ice bath until just before the first appearance of crystals (which would have formed somewhere between 25° and 30° C.). The combined diazonium salt and bis(pyridinium-pyridone) solutions were allowed to react with magnetic stirring for 1 hour at 5° C. The crystals that formed were isolated by filtration and vacuum dried to yield the yellow colorant.

EXAMPLE XIII

A yellow colorant of the formula

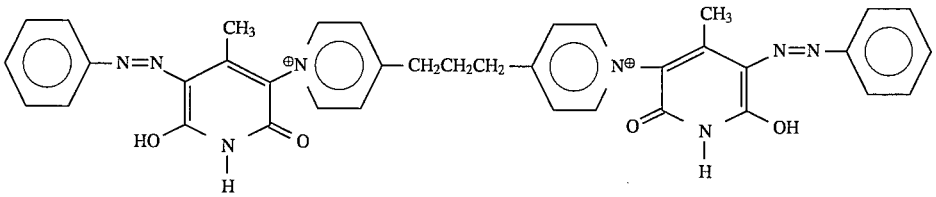

was prepared as follows. Aniline (1.44 g, obtained from Fisher Scientific, Pittsburgh, Pa.) in water (50 mL) and concentrated hydrochloric acid (5 mL) at between 0° and 5° C. were combined with an aqueous solution containing sodium nitrite (97 percent by weight pure, 1.07 g) in water (15 mL) at between 0° and 5° C. with ice bath cooling for 30 minutes. This diazonium salt solution was rapidly added to an aqueous solution of a bis(pyridinium-pyridone) of the formula

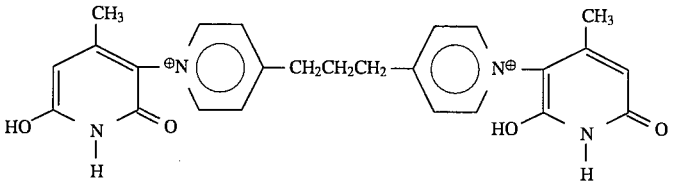

prepared as follows: a bis(pyridinium-pyridone) (4 g, 0.0155 mol) as prepared in Example V and water (350 mL) were heated between 60° and 70° C. and the resultant solution was then cooled using an ice bath until just before the first appearance of crystals (which would have formed somewhere between 25° and 30° C.). The combined diazonium salt and bis(pyridinium-pyridone) solutions were allowed to react with magnetic stirring for 1 hour at 5° C. The crystals that formed were isolated by filtration and vacuum dried to yield the yellow colorant.

EXAMPLE XIV

A yellow colorant of the formula

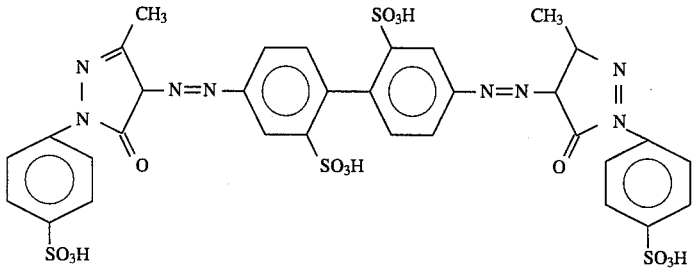

was prepared as follows. 4,4'-Diamino-2,2'-biphenyldisulfonic acid (3 g, 0.0087 mol, obtained from Pfaltz & Bauer, Waterbury, Conn.) in water (75 mL) and concentrated hydrochloric acid (5 mL) at between 0° and 5° C. were combined with an aqueous solution containing sodium nitrite (97 percent by weight pure, 1.20 g) in water ( 15 mL) at between 0° and 5° C. with ice bath cooling for 30 minutes. This solution was added to 3-methyl-l-(p-sulfophenyl)-2-pyrazolin-5-one (4.43 g, obtained from Eastman Kodak Co., Rochester, N.Y.) in water (300 mL) containing sodium hydroxide (0.8 g) and sodium acetate (1.8 g) with magnetic stirring and ice bath cooling for 1 hour at 5° C. Ethanol was added until the solution became cloudy and the resultant yellow colorant was isolated by filtration and vacuum dried.

EXAMPLE XV

An orange colorant of the formula

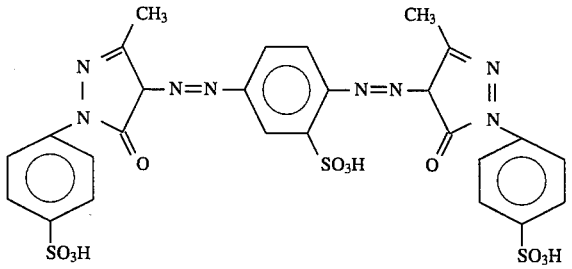

was prepared as follows. 2,5-Diamino-benzenesulfonic acid (1.5 g, 0.00795 mol, obtained from Pfaltz & Bauer, Waterbury, Conn.) in water (75 mL) and concentrated hydrochloric acid (5 mL) at between 0° and 5° C. were combined with an aqueous solution containing 97 percent by weight sodium nitrite (1.1 g) in water (15 mL) at between 0° and 5° C. with ice bath cooling for 30 minutes. This solution was added to 3-methyl-1-(p-sulfophenyl)-2-pyrazolin-5-one (4.05 g, 0.0160 mot, obtained from Eastman Kodak Co., Rochester, N.Y.) in water (200 mL) containing sodium hydroxide (0.8 g) and sodium acetate (1.8 g) with magnetic stirring and ice bath cooling for 1 hour at 5° C. Ethanol was added until the solution became cloudy, and the resultant orange colorant was isolated by filtration and vacuum dried.

EXAMPLE XVI

A green-yellow colorant of the formula

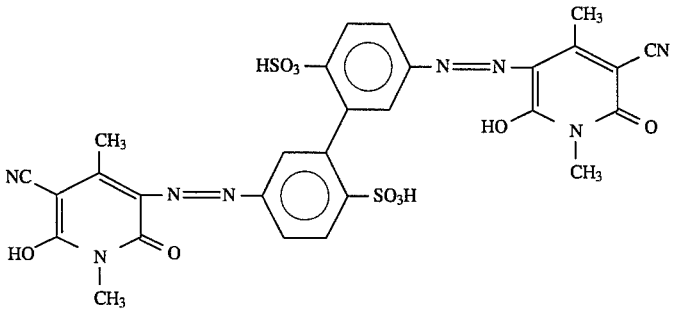

was prepared as follows. 4,4'-Diamino-2,2'biphenyldisulfonic acid (3 g, 0.0087 mol, obtained from Pfaltz & Bauer, Waterbury, Conn.) in water (75 mL) and concentrated hydrochloric acid (5 mL) at between 0° and 5° C. were combined with an aqueous solution containing 97 percent by weight sodium nitrite (1.23 g, 0.0174 mol) in water (15 mL) at between 0° and 5° C. with ice bath cooling for 20 minutes. This solution was added to a cyanopyridone (2.86 g) prepared as described in Example III in water (300 mL) containing sodium hydroxide (0.8 g) and sodium acetate (1.8 g) with magnetic stirring and ice bath cooling for 1 hour at 5° C. Ethanol was added until the solution became cloudy, and the resultant yellow colorant was isolated by filtration and vacuum dried.

EXAMPLE XVI

A yellow colorant of the formula

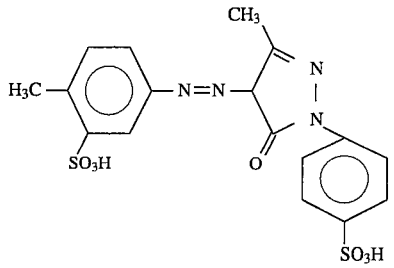

was prepared as follows. 5-Amino-2-methylbenzene sulfonic acid (3 g, 0.0160 mol, obtained from Pfaltz & Bauer, Waterbury, Conn.) in water (50 mL) and concentrated hydrochloric acid (5 mL) at between 0° and 5° C. were combined with an aqueous solution containing 97 percent by weight sodium nitrite (1.14 g, 0.0160 mol) in water (15 mL) at between 0 and 5° C with ice bath cooling for 30 minutes. This solution was added to 3-methyl-1-(p-sulfophenyl)-2-pyrazolin-5-one (4.07 g, 0.0160 mol, obtained from Eastman Kodak Co., Rochester, N.Y.) in water (200 mL) containing sodium hydroxide (0.8 g) and sodium acetate (1.8 g) with magnetic stirring and ice bath cooling for 1 hour at 5° C. Ethanol was added until the solution became cloudy, and the resultant yellow colorant was isolated by filtration and vacuum dried. An alcohol-soluble yellow colorant portion was also obtained by evaporation of the reaction mixture using a rotary evaporator.

EXAMPLE XVIII

A yellow colorant of the formula

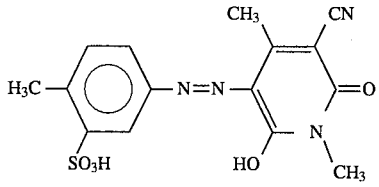

was prepared as follows. 5-Amino-2-methylbenzene sulfonic acid (3 g, 0.0160 mol, obtained from Pfaltz & Bauer, Waterbury, Conn.) in water (50 mL) and concentrated hydrochloric acid (5 mL) at between 0° and 5° C. were combined with an aqueous solution containing 97 percent by weight sodium nitrite (1.14 g, 0.0160 mol) in water (15 mL) at between 0 and 5° C with ice bath cooling for 30 minutes. This solution was added to a cyanopyridone (2.63 g, 0.0160 mol) prepared as described in Example III in water (200 mL) containing sodium hydroxide (0.8 g) and sodium acetate (1.8 g) with magnetic stirring and ice bath cooling for 1 hour at 5° C. The mixture turned into an orange-red jelly. Ethanol was added until the solution became cloudy, and the resultant yellow colorant was isolated by filtration and vacuum dried.

EXAMPLE XIX

A yellow colorant of the formula

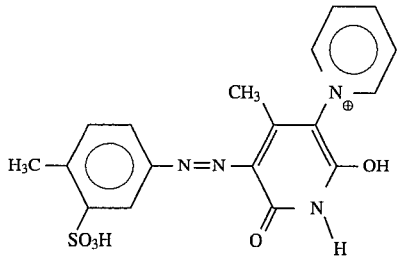

was prepared as follows. 5-Amino-2-methylbenzene sulfonic acid (3 g, 0.0160 mol, obtained from Pfaltz & Bauer, Waterbury, Conn.) in water (50 mL) and concentrated hydrochloric acid (5 mL) at between 0° and 5° C. were combined with an aqueous solution containing 97 percent by weight sodium nitrite (1.14 g, 0.0160 mol) in water (15 mL) at between 0° and 5° C. with ice bath cooling for 30 minutes. This solution was added to a pyridinium pyridone (3.82 g, 0.0160 tool) prepared as described in Example II in water (200 mL) containing sodium hydroxide (0.8 g) and sodium acetate ( 1.8 g) with magnetic stirring and ice bath cooling for 1 hour at 5° C. The mixture turned into an orange-red jelly. Ethanol was added until the solution became cloudy, and the resultant yellow colorant was isolated by filtration and vacuum dried.

EXAMPLE XX 4,4'-Dinitrobibenzyl-2,2'-disulfonate was prepared as described in A. Ya. Zheltov, E. N. Avramenko, and B. I. Stepanov, Zhurnel Organicheskoi Khimii, 16, (2) 384–390 (1980), the disclosure of which is totally incorporated herein by reference. More specifically, 4,4'-dinitrobibenzyl-2,2'-disulfonate was prepared as follows. A solution (220 mL) of NaOCl (17.8 g) was prepared by passing chlorine through sodium hydroxide (20 g) in water (100 mL) with crushed ice (120 g) at 1° to 3° C. until the weight of the solution increased by 17 grams. To a stirred solution of 4-nitrotoluene-2-sulfonic acid (90.4 g, obtained from Pfaltz & Bauer, Waterbury, Conn.) in water (1L) at 60° C. was added sodium hydroxide (16.8 g), NaOCl solution (50 mL), and gradually a solution of sodium hydroxide (200 g) in water (470 mL). To the resulting suspension was added NaOCl solution (120 mL). The reaction mixture was stirred 25 minutes at 65° C. More NaOCl solution (50 mL) was added and the mixture was transferred to a container containing 2 kg of ice. A 20 gram portion of finely ground sodium chloride was added, and the mixture was stirred for 20 minutes. The resulting white precipitate of disulfonic acid was filtered off, washed with saturated sodium chloride solution, and then dissolved in water (2L). An aqueous solution containing 6 percent by weight potassium permanganate was added to the solution at 20° C. until a permanent light pink color was achieved. The mixture was filtered, and sodium chloride (80 g) was added to the filtrate at 50° C. in portions. The mixture was then stirred at 10° C. for 2 hours. The resulting precipitate was filtered off, washed with acetone, and then dried. The yield of disodium 4.4'-dinitro-bibenzyl-2,2'-disulfonate was 64 grams.

EXAMPLE XXI 4,4'-Diamino-bibenzyl-2,2'-disulfonic acid was prepared as described in A. Ya. Zheltov, E. N. Avramenko, and B. I.

Stepanov, Zhurnel Organicheskoi Khimii, 16, (2) 384–390 (1980), the disclosure of which is totally incorporated herein by reference. More specifically, 4,4'-diamino-bibenzyl-2,2'-disulfonic acid was prepared as follows. To a solution of disodium 4,4'-bibenzyl-2,2'disulfonate (95.2 g, obtained as described in Example XX) in water (2L), was added 96% aqueous hydrazine hydrate (60 mL) and Raney nickel suspension (3 mL, obtained from Aldrich Chemical Co., Milwaukee, Wis.). The mixture was stirred at 35° to 40° C. for 40 minutes, and then more hydrazine hydrate (20 mL) and catalyst were added. The mixture was stirred until the release of nitrogen was completed. The mixture was filtered, washed with ice water and with acetone, then dried to obtain 4,4'-diaminobibenzyl-2,2'disuifonic acid (62 g).

EXAMPLE XXII 4,4'-bibenzyl-2,2'-disulfonic acid-bis(4-methyl-6-hydroxy-3-cyano-2-pyridone), of the formula

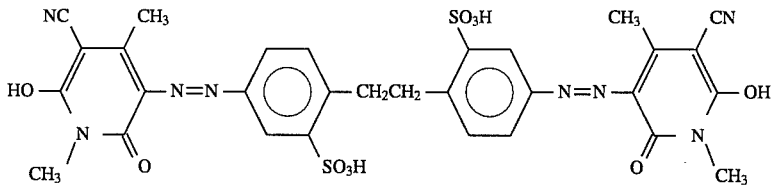

is prepared as follows. An aqueous solution containing 50 percent by weight sodium hydroxide (18.1 g) is added to 4,4'diamino-bibenzyl-2,2'disuifonic acid (37 g, 0.1 mol, prepared as described in Example XXI) in water (200 mL) to form a brown solution. To this is added methyl cyanoacetate (20 g, available from Aldrich Chemical Co., Milwaukee, Wis.) with stirring at 25° C. After 16 hours continued stirring at 25° C., some sediment is evident. More 50 wt. % sodium hydroxide solution (18 g) is added. Ethyl acetoacetate (26 g, available from Aldrich Chemical Co., Milwaukee, Wis.) is then added and the mixture is heated at 90° C. for 3.5 to 4 hours. The solution is added to 200 g ice and 27 g concentrated (61%) sulfuric acid. The product is isolated by filtration and then vacuum dried.

EXAMPLE XXIII 4,4'-Dihydrazinyl-bibenzyl-2,2'-disulfonic acid, of the formula

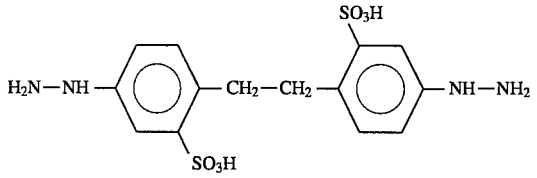

is prepared by a process similar to that used to prepare phenyl hydrazine according to G. H. Coleman, Organic Syntheses Coll., vol. 1, page 442, John Wiley & Sons (New York 1941) the disclosure of which is totally incorporated herein by reference. More specifically, 4,4'-dihydrazinyl-bibenzyl-2,2'-disulfonic acid is prepared as follows. To a 1 liter beaker are added 4,4'-diamino-bibenzyl-2,2'-disulfonic acid (74 g, 0.2 mol, prepared as described in Example XXI), ice (50 g), and concentrated hydrochloric acid (100 mL) with ice bath cooling. Sodium nitrite (27.6 g, 0.4 mol) in water (60 mL) is added with cracked ice (100 g) to maintain the reaction temperature near 0° C., and the solution is stirred 1 hour. Meanwhile, sulfur dioxide (available from Aldrich Chemical Co., Milwaukee, Wis.) is added to an aqueous solution containing 50 percent by weight sodium hydroxide (200 g, 0.24 mol) in an ice bath until the pH of the mixture is less than or equal to 7. The cold tetrazonium salt solution is added to the freshly prepared $NaHSO_3$ solution and the mixture is heated at 80° C. for 30 to 60 minutes. The orange red solution progressively becomes lighter in color. Three hours later, concentrated hydrochloric acid (30 to 40 mL) is added to acidify the mixture to litmus paper. Vigorous gasing is evident and the color becomes lighter with each passsing half hour. The mixture is heated to between 60° and 70° C. overnight (16 hours). Concentrated hydrochloric acid (400 mL) is then added with ice bath cooling. The mixture is then filtered to obtain the product.

EXAMPLE XXIV

To 36.4 grams of the bis(phenyhydrazine) product obtained in Example XXIII in methanol (600 mL) is added an aqueous solution containing 50 percent by weight sodium hydroxide (80.5 g) in a 1 liter, 3-neck flask equipped with a water cooled condenser and a mechanical stirrer. Ethyl acetoacetate (23.66 g, available from Aldrich Chemical Co., Milwaukee, Wis.) is added and the reaction is boiled between 3 and 5 hours. The product is precipitated by the addition of sulfuric acid, filtered, washed with water and then methanol, and then vacuum dried. Methyl and methylene protons characteristic of pyrazolone structures are expected to be observed in the complicated $^1H$ NMR spectra of the product, which is believed to be of the formula

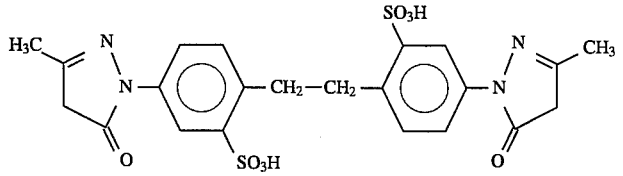

EXAMPLE XXV 4,4'-Dihydrazinyl-stilbene-2,2'-disulfonic acid, of the formula

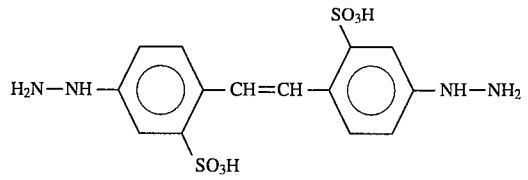

was prepared by a process similar to that used to prepare phenyl hydrazine according to G. H. Coleman, Organic Syntheses Coll., vol. 1, page 442, John Wiley & Sons (New York 1941) the disclosure of which is totally incorporated herein by reference. More specifically, 4,4'-dihydrazinyl-stilbene-2,2'-disulfonic acid was prepared as follows. To a 1 liter beaker were added 4,4'-diaminostilbene-2,2'-disulfonic acid (74 g, 0.2 mol, obtained from Eastman Kodak Co., Rochester, N.Y.), ice (50 g), and concentrated hydrochloric acid (100 mL) with ice bath cooling. Sodium nitrite (27.6 g, 0.4 mol) in water (60 mL) were added with cracked ice (100 g) to maintain the reaction temperature near 0° C., and the solution was stirred 1 hour. Meanwhile, sulfur dioxide (obtained from Aldrich Chemical Co., Milwaukee, Wis.) was added to an aqueous solution containing 50 percent by weight sodium hydroxide (200 g, 0.24 mol) in an ice bath until the pH of the mixture was less than or equal to 7. The cold tetrazonium salt solution was added to the freshly prepared $NaHSO_3$ solution and the mixture was heated at 80° C. for 30 to 60 minutes. The orange red solution progressively became lighter in color. Three hours later, concentrated hydrochloric acid (30 to 40 mL) was added to acidify the mixture to litmus paper. Vigorous gasing was evident and the color became lighter with each passsing half hour. The mixture was heated to between 60° and 70° C. overnight (16 hours). Concentrated hydrochloric acid (400 mL) was then added with ice bath cooling. The mixture was then filtered to obtain the product.

EXAMPLE XXVI

To 36.4 grams of the bis(phenyhydrazine) product obtained in Example XXV in methanol (600 mL) was added an aqueous solution containing 50 percent by weight sodium hydroxide (80.5 g) in a 1 liter, 3-neck flask equipped with a water cooled condenser and a mechanical stirrer. Ethyl acetoacetate (23.66 g, obtained from Aldrich Chemical Co., Milwaukee, Wis.) was added and the reaction was boiled between 3 and 5 hours. The product was precipitated by the addition of sulfuric acid, filtered, washed with water and then methanol, and then vacuum dried. Methyl and methylene protons characteristic of pyrazolone structures were observed in the complicated $^1H$ NMR spectra of the product, which was believed to be of the formula

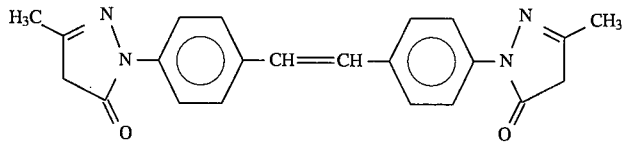

EXAMPLE XXVII

A brown colorant of the formula

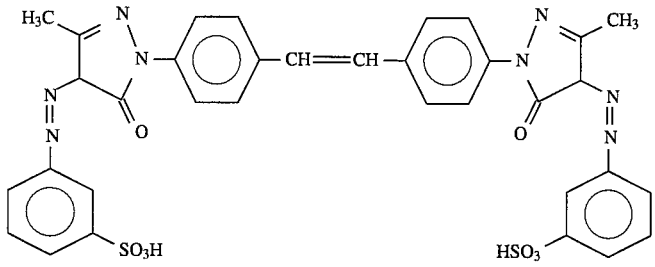

was prepared as follows. Metanilic acid (2.68 g, obtained from Fisher Scientific, Pittsburgh, Pa.) in water (50 mL) and concentrated hydrochloric acid (5 mL) at between 0° and 5° C. were combined with an aqueous solution containing 97 percent by weight sodium nitrite (1.07 g) in water (15 mL)

at between 0° and 5° C. with ice bath cooling for 30 minutes. This solution was added to the bis(pyrazolone) prepared as described in Example XXVI (4.11 g) in water (300 mL) containing sufficient sodium hydroxide added to form a solution with magnetic stirring and ice bath cooling for 1 hour at 5° C. Ethanol was added until the solution became cloudy, and the resultant brown colorant was isolated by filtration and then vacuum dried.

EXAMPLE XXVIII

Dry toners suitable for the development of electrostatic latent images were prepared as follows. To a CSI laboratory mixing extruder was added a styrene-butadiene copolymer containing 87 percent by weight styrene and 13 percent by weight butadiene (SB), prepared as disclosed in U.S. Pat. No. 4,560,635, the disclosure of which is totally incorporated herein by reference. To the copolymer was added an amount of a colorant prepared hereinabove as identified in the table below; the colorant was added to the polymer in an amount of 1 percent by weight and the colorant and copolymer were melt mixed at 130° C. The extruded mixtures were then chopped and micronized with a Trost Gem T jet mill (obtained from Garlock Industries) to yield toner particles with an average particle diameter of from about 8 to about 10 microns. The resultant toners were then admixed with carrier particles from a Xerox® 1075 copier to form two-component developers by roll milling for 15 minutes at 30 revolutions per minute, with the relative amount of toner and carrier being 2 parts by weight toner and 58 parts by weight carrier. An additional set of two-component developers was prepared by admixing 4 parts by weight of each toner with 56 parts by weight of Xerox® 1075 carrier particles.

The above procedure was repeated except that the styrene-butadiene copolymer was replaced with a bisphenol-A-fumarate-propyleneoxide copolymer (bis-A), obtained from Ashland Chemical Co., Columbus, Ohio.

For comparison purposes, a toner was made with the styrene butadiene resin containing 2 percent by weight of Novaperm Yellow pigment (obtained from American Hoechst Celanese, Coventry, R.I.), and a toner was made with the styrene butadiene resin containing 1.5 percent by weight cetyl pyridinium chloride charge control agent (CPC)

The triboelectric charging characteristics of the toners were measured with a Faraday cage apparatus. The blue reflection density for each toner was measured with a MacBeth model 1135 densitometer. The data were then normalized to a toner:carrier ratio of 2:100 (by weight). The actual toner concentration (by weight, with respect to the carrier, to be compared to calculated toner concentration) measured in the tribo blow-off process was also determined. The results were as follows:

| | | 2:58 toner:carrier | | 4:56 toner:carrier | | Tribo normalized to 2:100 | Blue |
|---|---|---|---|---|---|---|---|
| Colorant | Resin | tribo (μC/g) | % TC | tribo (μC/g) | % TC | ratio (μC/g) | Reflection Density |
| Ex. VII | SB | 53.26 | 2.28 | 25.64 | 4.84 | 46.7 | 0.65 |
| Ex. VII | bis-A | 42.19 | 1.90 | 20.98 | 4.59 | 44.4 | 0.80 |
| Ex. VI | SB | 24.82 | 2.81 | 17.66 | 5.23 | 17.7 | 0.63 |
| Ex. VIII | SB | 27.60 | 2.89 | 17.08 | 4.61 | 19.1 | 0.75 |
| Novaperm Yellow | SB | 29.21 | 2.77 | — | — | 21.1 | 0.78 |
| CPC | SB | 23.10 | 2.09 | — | — | 26.6 | — |
| none | SB | 26.63 | 1.99 | 26.29 | 5.77 | 22.1 | — |

— = not measured

As the data indicate, the colorants prepared in Examples VI and VIII appear to have little effect on the triboelectric charging charactistics of toners made with the styrene-butadiene resin, and behave similarly to the yellow pigment. The colorant prepared in Example VII, however, appears to behave as a positive charge control agent similar in effect to cetyl pyridinium chloride.

Each of the above toners was incorporated into a Xerox® Model D copier and images were generated and developed by a cascade development process using parallel plates with 1500 void DC bias, and transferring the developed images to paper. The resulting images were of excellent yellow color quality and fused well to the paper, as determined by creasing the paper in image areas and by rubbing the images with a pencil eraser.

EXAMPLE XXIX

A yellow liquid developer suitable for development of electrostatic latent images was prepared as follows. A copolymer of ethylene (90% by weight) and methacrylic acid (10% by weight) (Nucrel 599, obtained from E. I. Du Pont de Nemours & Co., Wilmington, Del., 3.90 g), an aluminum stearate charge control agent (Witco 22, obtained from Witco Chemical Co., Des Plaines, Ill., 0.1 g), a yellow colorant prepared as described in Example V]: (1.00 g), and an isoparaffinic hydrocarbon liquid (Isopar L, obtained from Noco Lubrication, Tonawanda, N.Y., 170 g) were heated in a Union Process 01 attritor containing 2,400 grams of stainless steel 3/16 inch chrome-coated shot until 200° F. was achieved. After 10 minutes, heating was discontinued and ambient temperature stirring was maintained for 2 hours. Water cooling and stirring was then continued for 4 more hours. The ink was then washed from the shot with 63.1 g of Isopar L using a strainer and the calculated solids percent content of the resultant ink was 2.10 percent by weight. The actual measured percent solids content by weight was 1.91, as determined by loss on drying using a sun lamp heat source for 24 hours. This ink at 1 percent by weight solids and with suitable charge director (lecithin added dropwise until a conductivity of 12 picomhos per centimeter is achieved) can be used for the development of liquid immersion images by incorporating the ink into a Savin 870 photocopier and generating and developing images.

EXAMPLE XXX

A yellow liquid developer suitable for development of electrostatic latent images was prepared as follows. A copolymer of ethylene (90% by weight) and methacrylic acid (10% by weight) (Nucrel 599, obtained from E. I. Du Pont de Nemours & Co., Wilmington, Del., 3.90 g), a yellow colorant prepared as described in Example VIII (1.00 g), and an isoparaffinic hydrocarbon liquid (Isopar L, obtained from Noco Lubrication, Tonawanda, N.Y., 170 g) were heated in a Union Process 01 attritor containing 2,400 grams of stainless steel 3/16 inch chrome-coated shot until 200° F. was achieved. After 10 minutes, heating was discontinued and ambient temperature stirring was maintained for 2 hours. Water cooling and stirring was then continued for 4 more hours. The ink was then washed from the shot with 136.8 g of Isopar L using a strainer and the calculated percent solids content by weight of the resultant ink was 1.57 percent by weight. The actual measured percent solids content by weight was 1.24, as determined by loss on drying using a sun lamp heat source for 24 hours. This ink at 1 percent by weight solids and with suitable charge director (lecithin added dropwise until a conductivity of 12 picomhos per centimeter is achieved) can be used for the development of liquid immersion images by incorporating the ink into a Savin 870 photocopier and generating and developing images.

EXAMPLE XXXI

A yellow liquid developer suitable for development of electrostatic latent images was prepared as follows. A copolymer of ethylene (90% by weight) and methacrylic acid (10% by weight) (Nucrel 599, obtained from E. I. Du Pont de Nemours & Co., Wilmington, Del., 4.50 g), a yellow colorant prepared as described in Example VII (0.50 g), and an isoparaffinic hydrocarbon liquid (Isopar L, obtained from Noco Lubrication, Tonawanda, N.Y., 170 g) were heated in a Union Process 01 attritor containing 2,400 grams of stainless steel 3/16 inch chrome-coated shot until 200° F. was achieved. After 10 minutes, heating was discontinued and ambient temperature stirring was maintained for 2 hours. Water cooling and stirring was then continued for 4 more hours. The ink was then washed from the shot with 117.7 g of Isopar L using a strainer and the calculated percent solids content by weight of the resultant ink was 1.70 percent by weight. The actual measured percent solids content by weight was 1.68, as determined by loss on drying using a sun lamp heat source for 24 hours. This ink at 1 percent by weight solids and with suitable charge director (lecithin added dropwise until a conductivity of 12 picomhos per centimeter is achieved) can be used for the development of liquid immersion images by incorporating the ink into a Savin 870 photocopier and generating and developing images.

Other embodiments and modifications of the present invention may occur to those skilled in the art subsequent to a review of the information presented herein, these embodiments and modifications, as well as equivalents thereof, are also included within the scope of this invention.

What is claimed is:

1. A toner composition for the development of electrostatic latent images comprising particles comprising a mixture of a resin and a colorant selected from the group consisting of: (a) dimeric compounds containing one moiety of Formula I

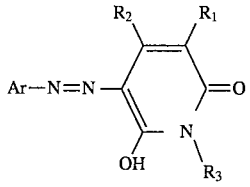

I wherein $R_1$ is an electron withdrawing group, $R_2$ is selected from the group consisting of hydrogen, alkyl, substituted alkyl, aryl, substituted aryl, arylalkyl, and substituted arylalkyl, $R_3$ is selected from the group consisting of hydrogen, alkyl, substituted alkyl, aryl, substituted aryl, arylalkyl, and substituted arylalkyl, and Ar is selected from the group consisting of aryl, substituted aryl, arylalkyl, and substituted arylalkyl, wherein the substituents on the substituted alkyl, substituted aryl, and substituted arylalkyl groups are selected from the group consisting of silyl groups, halide atoms, nitro groups, amine groups, hydroxy groups, alkoxy groups, ether groups, aldehyde groups, ketone groups, amide groups, ester groups, and carboxylic acid groups; and one moiety of Formula II

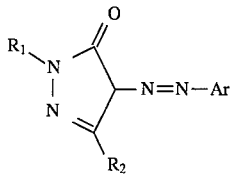

II wherein $R_1$ is selected from the group consisting of hydrogen, alkyl, substituted alkyl, aryl, substituted aryl, arylalkyl, and substituted arylalkyl, $R_2$ is selected from the group consisting of hydrogen, alkyl, substituted alkyl, aryl, substituted aryl, arylalkyl, and substituted arylalkyl, and Ar is selected from the group consisting of aryl, substituted aryl, arylalkyl, and substituted arylalkyl, wherein the substituents on the substituted alkyl, substituted aryl, and substituted arylalkyl groups are selected from the group consisting of silyl groups, halide atoms, nitro groups, amine groups, hydroxy groups, alkoxy groups, ether groups, aldehyde groups, ketone groups, ester groups, and carboxylic acid groups; (b) trimeric compounds containing three moieties of Formula I; (c) trimeric compounds containing two moieties of Formula I and one moiety of Formula II; (d) trimeric compounds containing one moiety of Formula I and two moieties of Formula II; and (e) mixtures thereof.

2. A toner according to claim 1 wherein the colorant is present in an amount of from about 0.5 to about 15 percent by weight.

3. A toner according to claim 1 wherein the colorant is present in an amount of from about 1 to about 3 percent by weight.

4. An imaging process which comprises generating an electrostatic latent image on an imaging member and developing the latent image by contacting the imaging member with a toner according to claim 1.

5. A toner composition for the development of electrostatic latent images comprising particles comprising a mixture of a resin and a colorant selected from the group consisting of: (a) the following formulae, wherein $R_1$ and $R'_1$ are each electron withdrawing groups, $R_2$ and $R'_2$ are each independently selected from the group consisting of hydrogen, alkyl, substituted alkyl, aryl, substituted aryl, arylalkyl, and substituted arylalkyl, $R_3$ and $R'_3$ are each independently selected from the group consisting of hydrogen, alkyl, substituted alkyl, aryl, substituted aryl, arylalkyl, and substituted arylalkyl, Ar and Ar' are each independently selected from the group consisting of aryl, substituted aryl, arylalkyl, and substituted arylalkyl, and X is selected from the group consisting of alkyl, substituted alkyl, aryl, substituted aryl, arylalkyl, and substituted arylalkyl, wherein the substituents on the substituted alkyl, substituted aryl, and substituted arylalkyl groups are selected from the group consisting of silyl groups, halide atoms, nitro groups, amine groups, hydroxy groups, alkoxy groups, ether groups, aldehyde groups, ketone groups, ester groups, amide groups, and carboxylic acid groups:

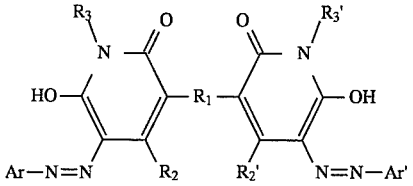

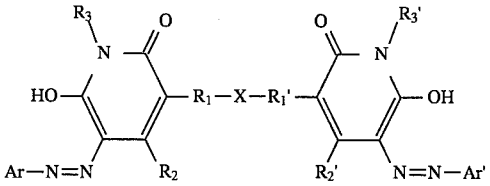

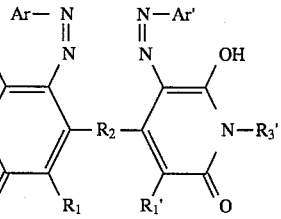

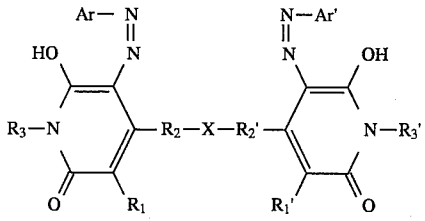

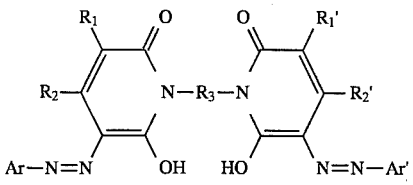

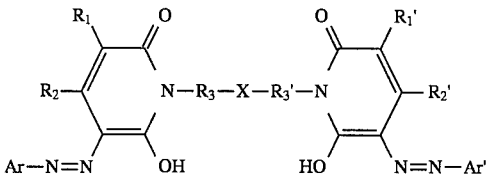

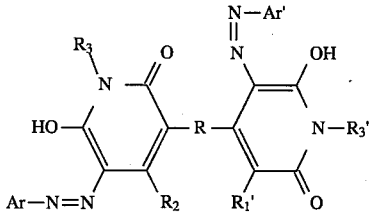

wherein R is a group that meets the definitions of both $R_1$ and $R'_2$

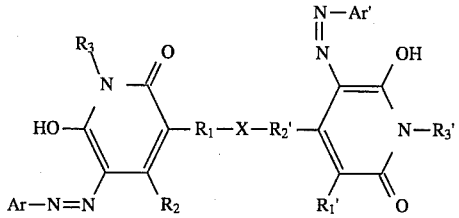

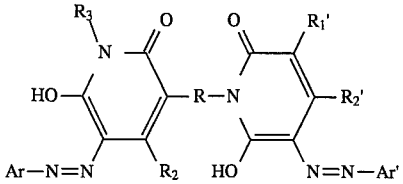

wherein R is a group that meets the definitions of both $R_1$ and $R'_3$

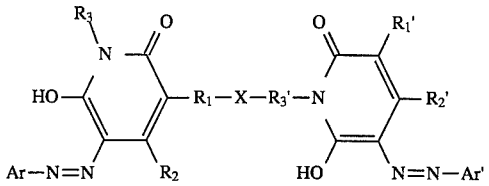

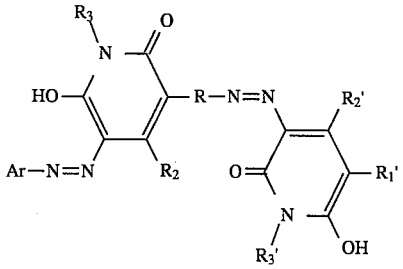

wherein R is a group that meets the definitions of both $R_1$ and Ar'

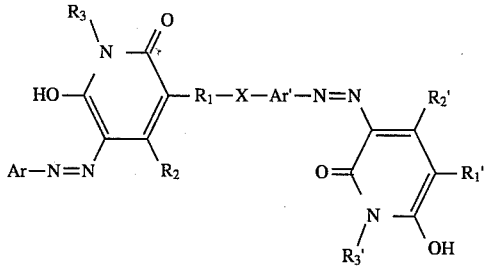

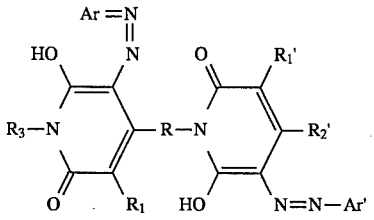

wherein R is a group that meets the definitions of both $R_2$ and $R'_3$

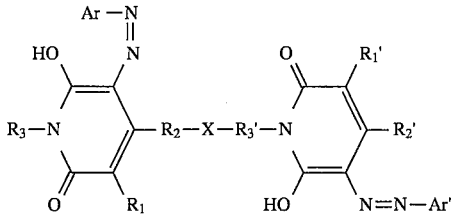

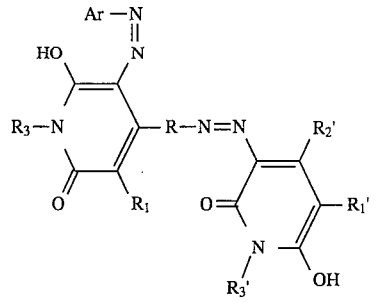

wherein R is a group that meets the definitions of both $R_2$ and Ar'

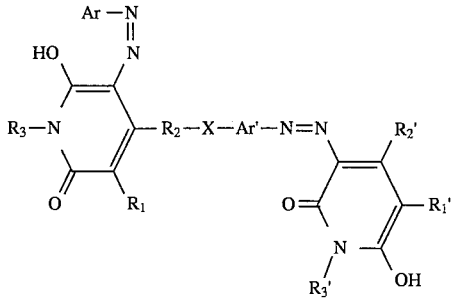

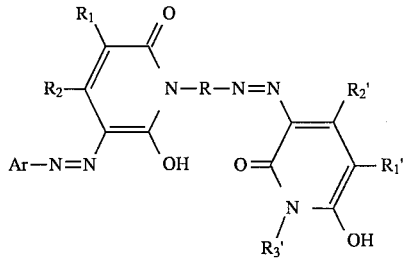

wherein R is a group that meets the definitions of both $R_3$ and Ar'

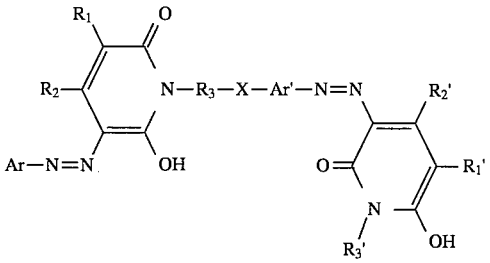

(b) those of the following formulae, wherein $R_1$ and $R'_1$ are each independently selected from the group consisting of hydrogen, alkyl, and substituted alkyl, $R_2$ and $R'_2$ are each independently selected from the group consisting of hydrogen, alkyl, substituted alkyl, aryl, substituted aryl, arylalkyl, and substituted arylalkyl, Ar and Ar' are each independently selected from the group consisting of aryl, substituted aryl, arylalkyl, and substituted arylalkyl, and Y is selected from the group consisting of alkyl, substituted alkyl, aryl, substituted aryl, arylalkyl, and substituted arylalkyl, wherein the substituents on the substituted alkyl, substituted aryl, and substituted arylalkyl groups are selected from the group consisting of silyl groups, halide atoms, nitro groups, amine groups, hydroxy groups, alkoxy groups, ether groups, aldehyde groups, ketone groups, ester groups, and carboxylic acid groups:

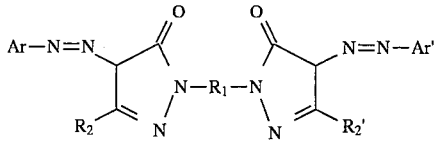

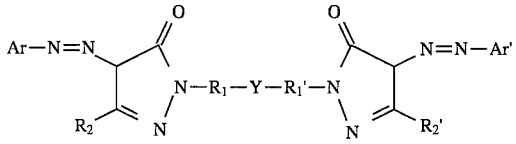

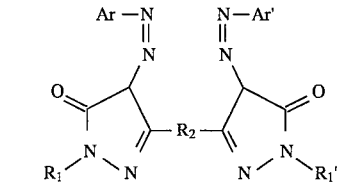

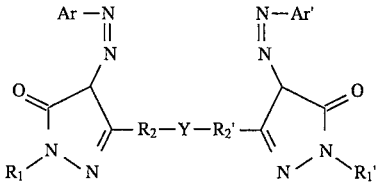

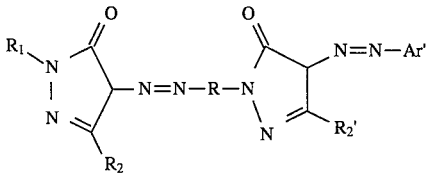

wherein R is a group that meets the definitions of both Ar and $R'_1$

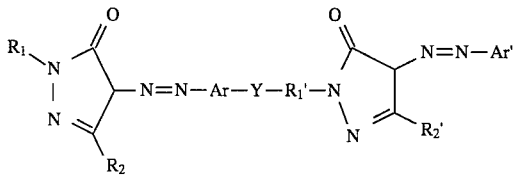

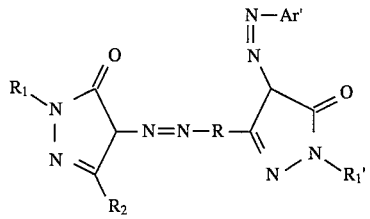

wherein R is a group that meets the definitions of both Ar and $R'_2$

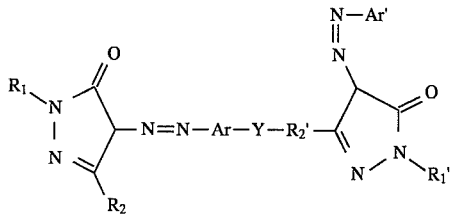

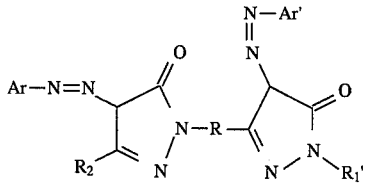

wherein R is a group that meets the definitions of both $R_1$ and $R'_2$

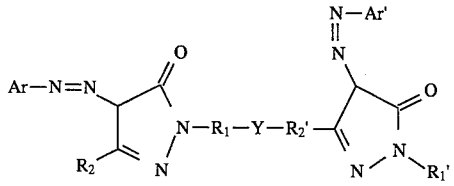

(c) those of the following formulae, wherein $R_1$ and $R'_1$ are each independently selected from the group consisting of hydrogen, alkyl, substituted alkyl, aryl, substituted aryl, arylalkyl, and substituted arylalkyl, $R_2$ and $R'_2$ are each independently selected from the group consisting of aryl, substituted aryl, arylalkyl, and substituted arylalkyl, Ar and Ar' are each independently selected from the group consisting of aryl, substituted aryl, arylalkyl, and substituted arylalkyl, and Y is selected from the group consisting of alkyl, substituted alkyl, aryl, substituted aryl, arylalkyl, and substituted arylalkyl, wherein the substituents on the substituted alkyl, substituted aryl, and substituted arylalkyl groups are selected from the group consisting of silyl groups, halide atoms, nitro groups, amine groups, hydroxy groups, alkoxy groups, ether groups, aldehyde groups, ketone groups, ester groups, and carboxylic acid groups:

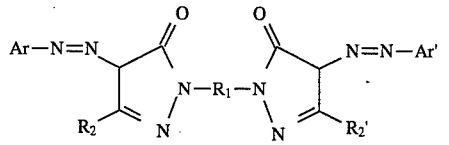

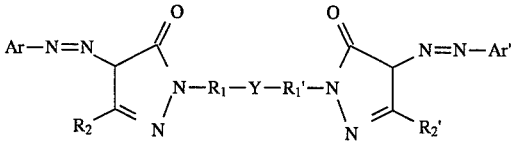

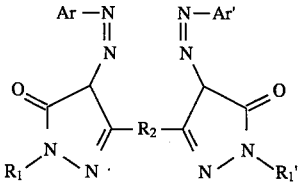

-continued

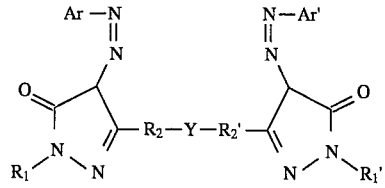

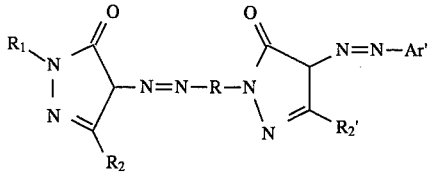

wherein R is a group that meets the definitions of both Ar and $R'_1$

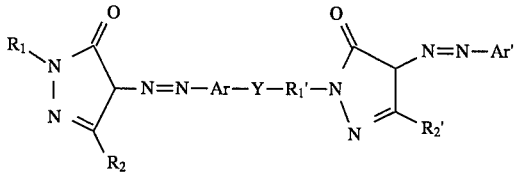

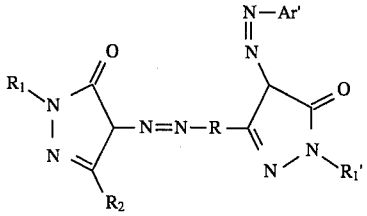

wherein R is a group that meets the definitions of both Ar and $R'_2$

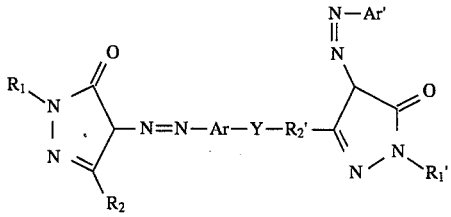

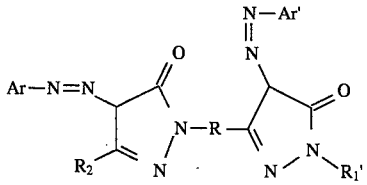

wherein R is a group that meets the definitions of both $R_1$ and $R'_2$

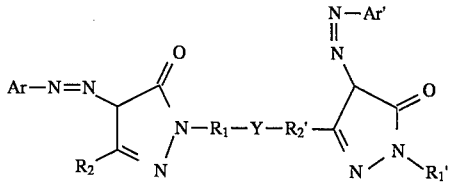

(d) those of the following formulae, wherein $R_1$ is an electron withdrawing group, $R_2$ is selected from the group consisting of hydrogen, alkyl, substituted alkyl, aryl, substituted aryl, arylalkyl, and substituted arylalkyl, R3 is selected from the group consisting of hydrogen, alkyl, substituted alkyl, aryl, substituted aryl, arylalkyl, and substituted arylalkyl, Ar is selected from the group consisting of aryl, substituted aryl, arylalkyl, and substituted arylalkyl, $R'_1$ is selected from the group consisting of hydrogen, alkyl, substituted alkyl, aryl, substituted aryl, arylalkyl, and substituted arylalkyl, $R'_2$ is selected from the group consisting of hydrogen, alkyl, substituted alkyl, aryl, substituted aryl, arylalkyl, and substituted arylalkyl, Ar' is selected from the group consisting of aryl, substituted aryl, arylalkyl, and substituted arylalkyl, and Z is selected from the group consisting of alkyl, substituted alkyl, aryl, substituted aryl, arylalkyl, and substituted arylalkyl, wherein the substituents on the substituted alkyl, substituted aryl, and substituted arylalkyl groups are selected from the group consisting of silyl groups, halide atoms, nitro groups, amine groups, hydroxy groups, alkoxy groups, ether groups, aldehyde groups, ketone groups, ester groups, amide groups, and carboxylic acid groups:

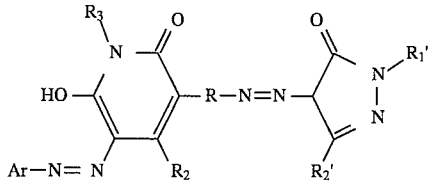

wherein R is a group that meets the definitions of both $R_1$ and Ar'

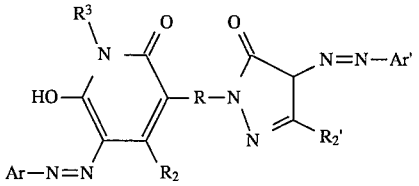

wherein R is a group that meets the definitions of both $R_1$ and $R'_1$

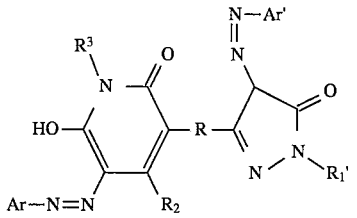

wherein R is a group that meets the definitions of both $R_1$ and $R'_2$

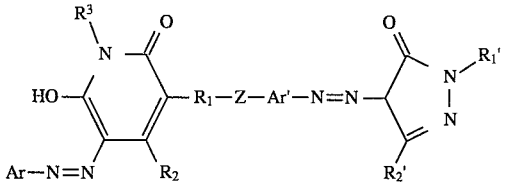

-continued

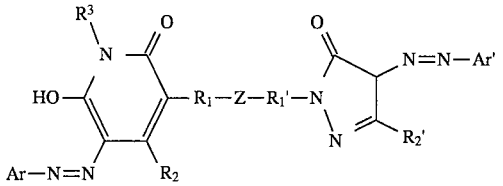

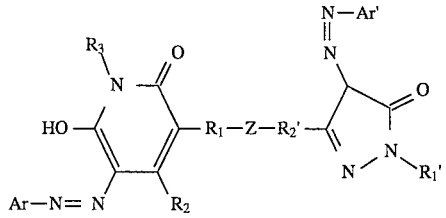

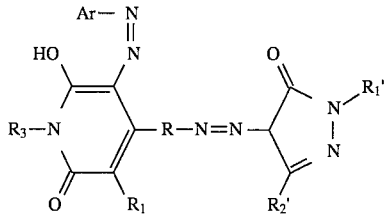

wherein R is a group that meets the definitions of both $R_2$ and Ar'

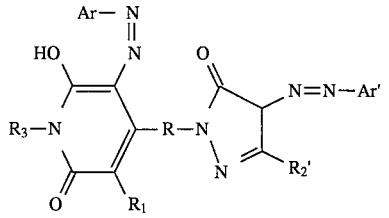

wherein R is a group that meets the definitions of both $R_2$ and $R'_1$

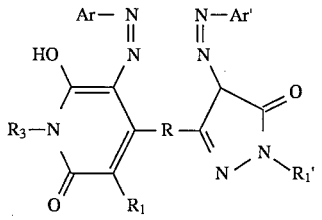

wherein R is a group that meets the definitions of both $R_2$ and $R'_2$

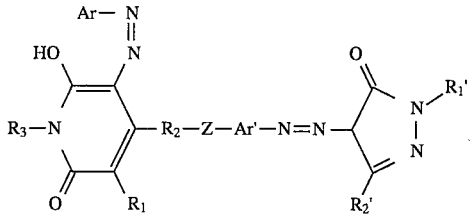

-continued

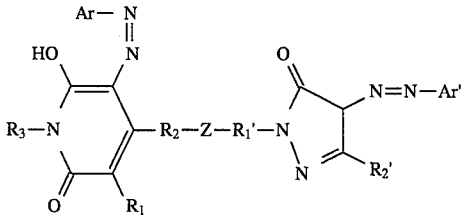

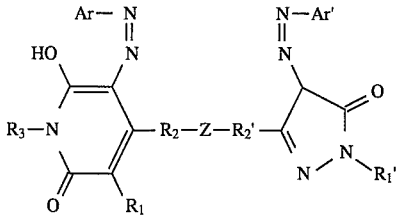

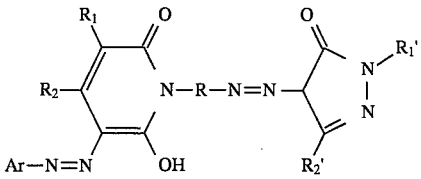

wherein R is a group that meets the definitions of both $R_3$ and Ar'

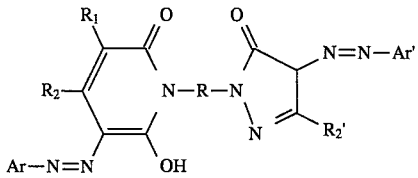

wherein R is a group that meets the definitions of both $R_3$ and $R'_1$

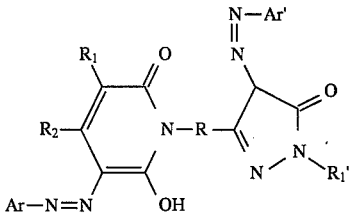

wherein R is a group that meets the definitions of both $R_3$ and $R'_2$

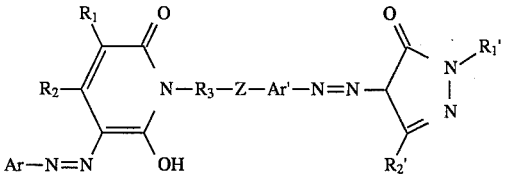

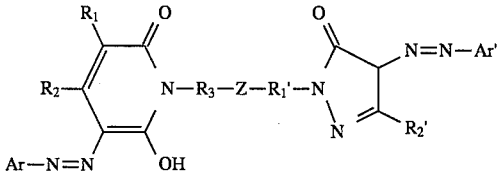

-continued

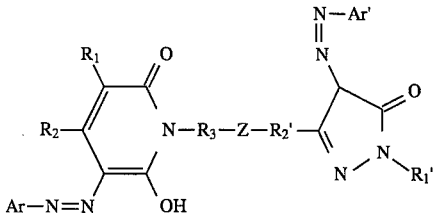

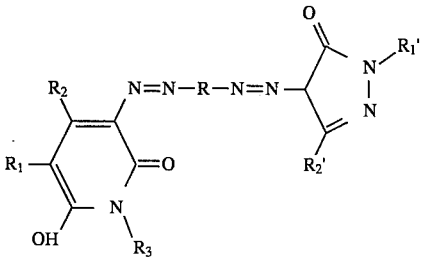

wherein R is a group that meets the definitions of both Ar and Ar'

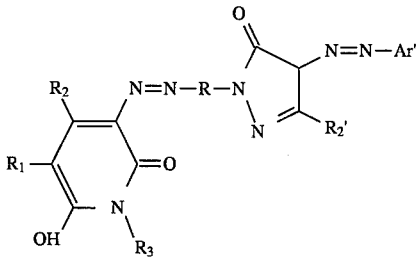

wherein R is a group that meets the definitions of both Ar and $R'_1$

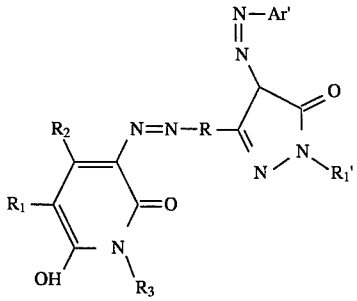

wherein R is a group that meets the definitions of both Ar and $R'_2$

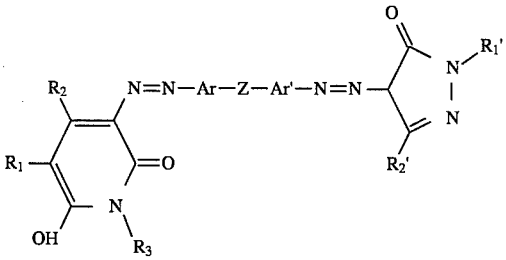

-continued

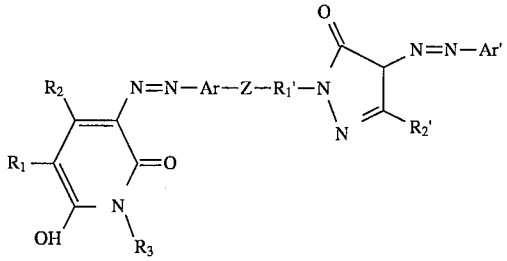

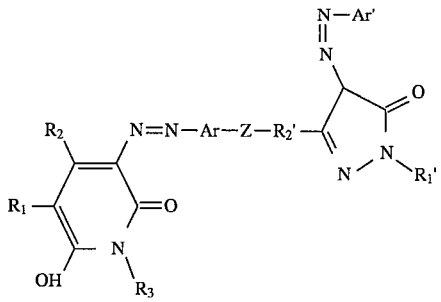

and (e) mixtures thereof.

6. A liquid developer composition for the development of electrostatic latent images which comprises a nonaqueous liquid vehicle and a colorant selected from the group consisting of: (a) dimeric compounds containing one moiety of Formula I

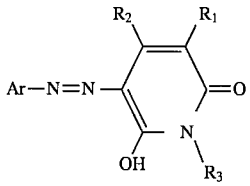

I wherein $R_1$ is an electron withdrawing group, $R_2$ is selected from the group consisting of hydrogen, alkyl, substituted alkyl, aryl, substituted aryl, arylalkyl, and substituted arylalkyl, $R_3$ is selected from the group consisting of hydrogen, alkyl, substituted alkyl, aryl, substituted aryl, arylalkyl, and substituted arylalkyl, and Ar is selected from the group consisting of aryl, substituted aryl, arylalkyl, and substituted arylalkyl, wherein the substituents on the substituted alkyl, substituted aryl, and substituted arylalkyl groups are selected from the group consisting of silyl groups, halide atoms, nitro groups, amine groups, hydroxy groups, alkoxy groups, ether groups, aldehyde groups, ketone groups, ester groups, amide groups, and carboxylic acid groups; and one moiety of Formula II

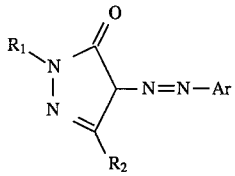

II wherein $R_1$ is selected from the group consisting of hydrogen, alkyl, substituted alkyl, aryl, substituted aryl, arylalkyl, and substituted arylalkyl, $R_2$ is selected from the group consisting of hydrogen, alkyl, substituted alkyl, aryl, substituted aryl, arylalkyl, and substituted arylalkyl, and Ar is selected from the group consisting of aryl, substituted aryl, arylalkyl, and substituted arylalkyl, wherein the substituents on the substituted alkyl, substituted aryl, and substituted arylalkyl groups are selected from the group consisting of silyl groups, halide atoms, nitro groups, amine groups, hydroxy groups, alkoxy groups, ether groups, aldehyde groups, ketone groups, ester groups, and carboxylic acid groups; (b) trimeric compounds containing three moieties of Formula I; (c) trimeric compounds containing two moieties of Formula I and one moiety of Formula II; (d) trimeric compounds containing one moiety of Formula I and two moieties of Formula II; and (e) mixtures thereof, wherein the liquid developer has a resistivity of from about $10^8$ to about $10^{11}$ ohm-cm and a viscosity of from about 25 to about 500 centipoise.

7. A liquid developer according to claim 6 wherein in colorant is present in an amount of from about 1 to about 50 percent by weight.

8. A liquid developer according to claim 6 wherein the colorant is present in an amount of from about 15 to about 30 percent by weight.

9. An imaging process which comprises generating an electrostatic latent image on an imaging member and developing the latent image by contacting the imaging member with a liquid developer according to claim 6.

10. A liquid developer composition for the development of electrostatic latent images which comprises a nonaqueous liquid vehicle and a colorant selected from the group consisting of: (a) the following formulae, wherein $R_1$ and $R'_1$ are each electron withdrawing groups, $R_2$ and $R'_2$ are each independently selected from the group consisting of hydrogen, alkyl, substituted alkyl, aryl, substituted aryl, arylalkyl, and substituted arylalkyl, $R_3$ and $R'_3$ are each independently selected from the group consisting of hydrogen, alkyl, substituted alkyl, aryl, substituted aryl, arylalkyl, and substituted arylalkyl, Ar and Ar' are each independently selected from the group consisting of aryl, substituted aryl, arylalkyl, and substituted arylalkyl, and X is selected from the group consisting of alkyl, substituted alkyl, aryl, substituted aryl, arylalkyl, and substituted arylalkyl, wherein the substituents on the substituted alkyl, substituted aryl, and substituted arylalkyl groups are selected from the group consisting of silyl groups, halide atoms, nitro groups, amine groups, hydroxy groups, alkoxy groups, ether groups, aldehyde groups, ketone groups, ester groups, amide groups, and carboxylic acid groups:

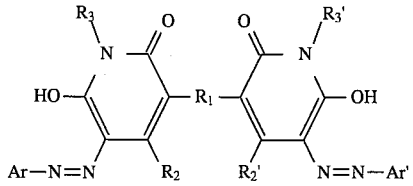

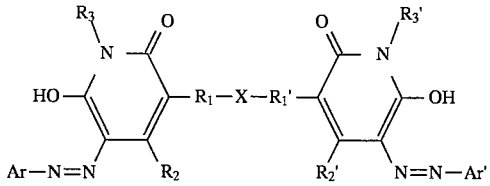

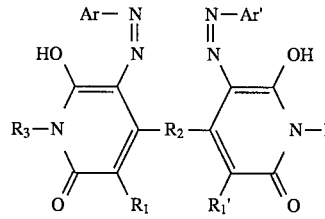

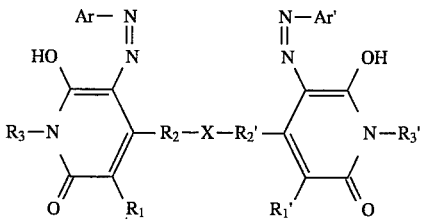
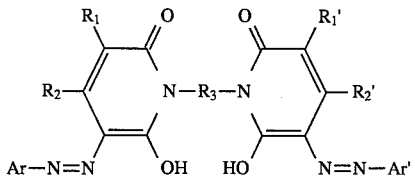
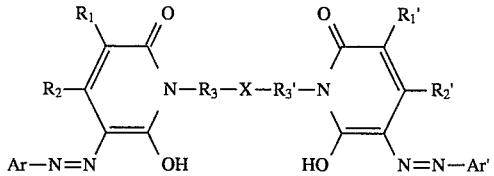
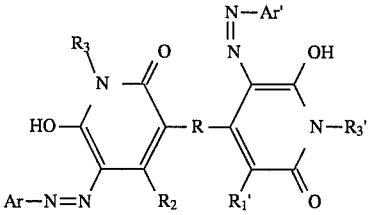
wherein R is a group that meets the definitions of both $R_1$ and $R'_2$
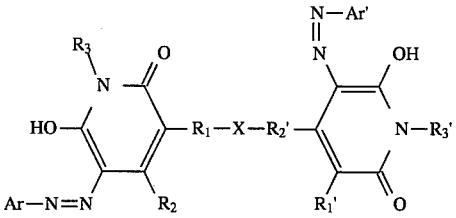
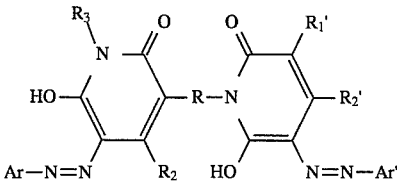
wherein R is a group that meets the definitions of both $R_1$ and $R'_3$
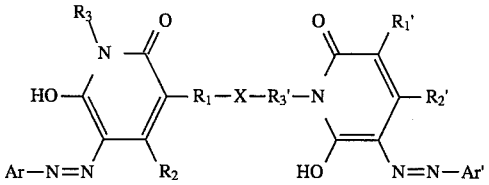
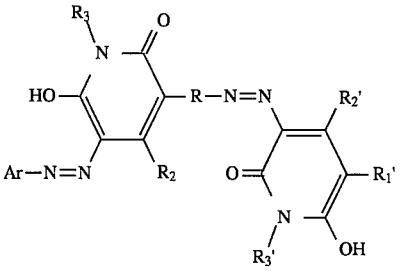
wherein R is a group that meets the definitions of both $R_1$ and Ar'
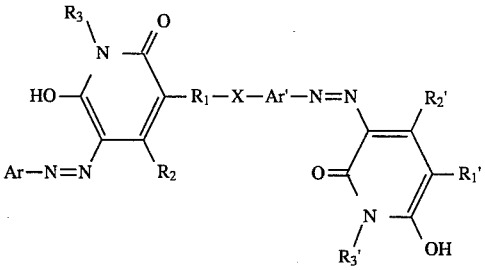
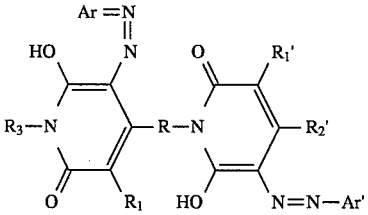
wherein R is a group that meets the definitions of both $R_2$ and $R'_3$
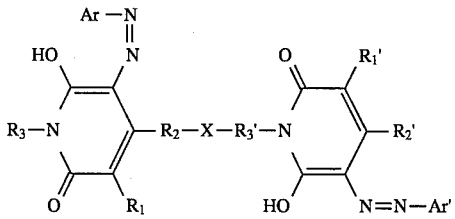
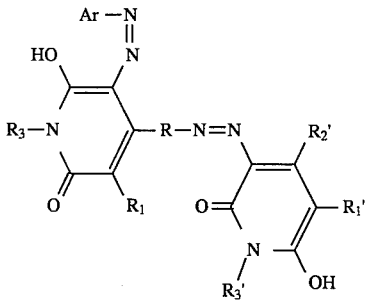
wherein R is a group that meets the definitions of both $R_2$ and Ar'

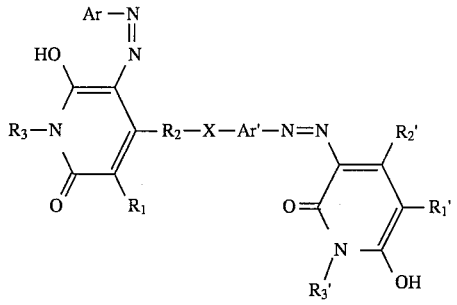

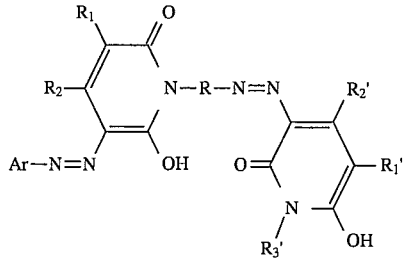

wherein R is a group that meets the definitions of both $R_3$ and Ar'

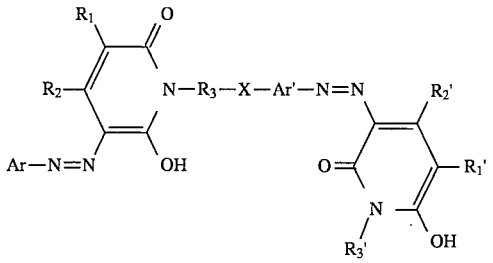

(b) those of the following formulae, wherein $R_1$ and $R'_1$ are each independently selected from the group consisting of hydrogen, alkyl, and substituted alkyl, $R_2$ and $R'_2$ are each independently selected from the group consisting of hydrogen, alkyl, substituted alkyl, aryl, substituted aryl, arylalkyl, and substituted arylalkyl, Ar and Ar' are each independently selected from the group consisting of aryl, substituted aryl, arylalkyl, and substituted arylalkyl, and Y is selected from the group consisting of alkyl, substituted alkyl, aryl, substituted aryl, arylalkyl, and substituted arylalkyl, wherein the substituents on the substituted alkyl, substituted aryl, and substituted arylalkyl groups are selected from the group consisting of silyl groups, halide atoms, nitro groups, amine groups, hydroxy groups, alkoxy groups, ether groups, aldehyde groups, ketone groups, ester groups, and carboxylic acid groups:

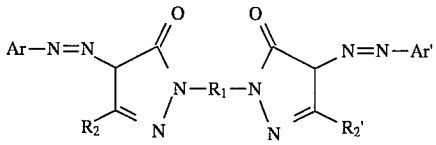

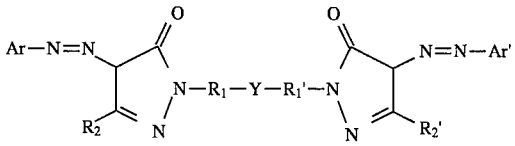

-continued

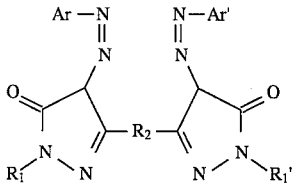

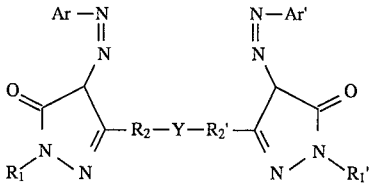

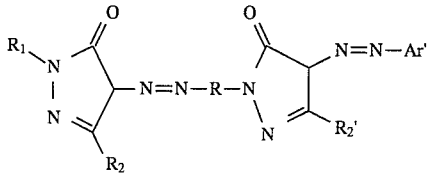

wherein R is a group that meets the definitions of both Ar and $R'_1$

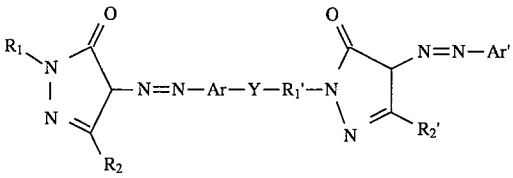

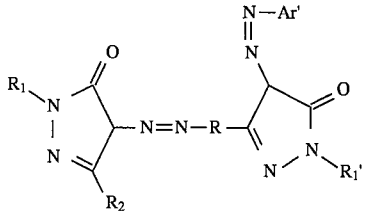

wherein R is a group that meets the definitions of both Ar and $R'_2$

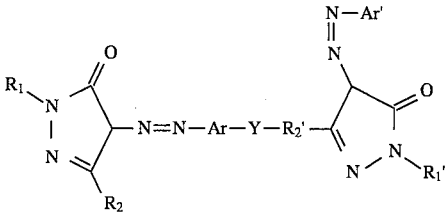

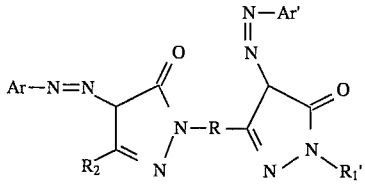

wherein R is a group that meets the definitions of both $R_1$ and $R'_2$

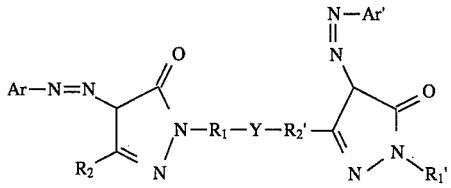

(c) those of the following formulae, wherein $R_1$ and $R'_1$ are each independently selected from the group consisting of hydrogen, alkyl, substituted alkyl, aryl, substituted aryl, arylalkyl, and substituted arylalkyl, $R_2$ and $R'_2$ are each independently selected from the group consisting of aryl, substituted aryl, arylalkyl, and substituted arylalkyl, Ar and Ar' are each independently selected from the group consisting of aryl, substituted aryl, arylalkyl, and substituted arylalkyl, and Y is selected from the group consisting of alkyl, substituted alkyl, aryl, substituted aryl, arylalkyl, and substituted arylalkyl, wherein the substituents on the substituted alkyl, substituted aryl, and substituted arylalkyl groups are selected from the group consisting of silyl groups, halide atoms, nitro groups, amine groups, hydroxy groups, alkoxy groups, ether groups, aldehyde groups, ketone groups, ester groups, and carboxylic acid groups:

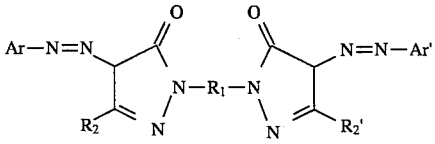

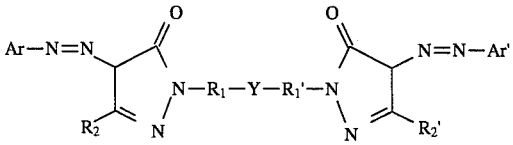

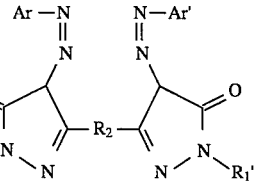

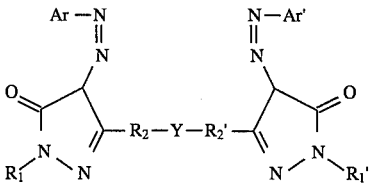

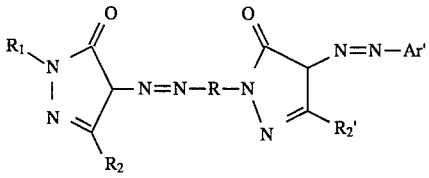

wherein R is a group that meets the definitions of both Ar and $R'_1$

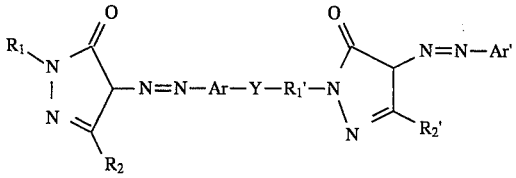

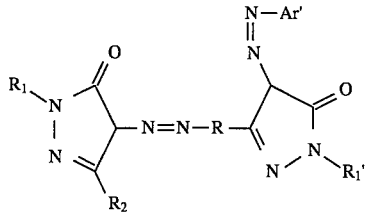

wherein R is a group that meets the definitions of both Ar and $R'_2$

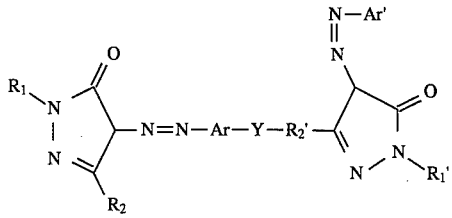

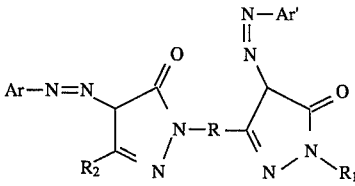

wherein R is a group that meets the definitions of both $R_1$ and $R'_2$

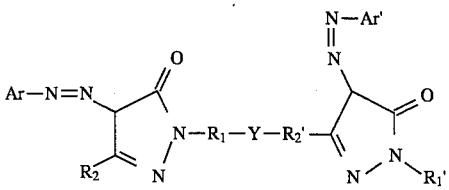

(d) those of the following formulae, wherein $R_1$ is an electron withdrawing group, $R_2$ is selected from the group consisting of hydrogen, alkyl, substituted alkyl, aryl, substituted aryl, arylalkyl, and substituted arylalkyl, $R_3$ is selected from the group consisting of hydrogen, alkyl, substituted alkyl, aryl, substituted aryl, arylalkyl, and substituted arylalkyl, Ar is selected from the group consisting of aryl, substituted aryl, arylalkyl, and substituted arylalkyl, $R'_1$ is selected from the group consisting of hydrogen, alkyl, substituted alkyl, aryl, substituted aryl, arylalkyl, and substituted arylalkyl, $R'_2$ is selected from the group consisting of hydrogen, alkyl, substituted alkyl, aryl, substituted aryl, arylalkyl, and substituted arylalkyl, Ar' is selected from the group consisting of aryl, substituted aryl, arylalkyl, and substituted arylalkyl, and Z is selected from the group consisting of alkyl, substituted alkyl, aryl, substituted aryl, arylalkyl, and substituted arylalkyl, wherein the substituents on the substituted alkyl, substituted aryl, and substituted arylalkyl groups are selected from the group consisting of silyl groups, halide atoms, nitro groups, amine groups, hydroxy groups, alkoxy groups, ether groups, aldehyde groups, ketone groups, ester groups, amide groups, and carboxylic acid groups:

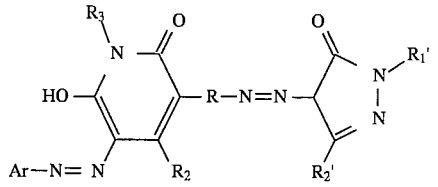

wherein R is a group that meets the definitions of both $R_1$ and Ar'

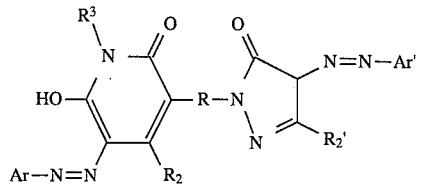

wherein R is a group that meets the definitions of both $R_1$ and $R'_1$

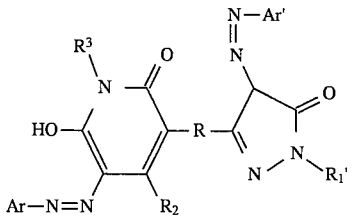

wherein R is a group that meets the definitions of both $R_1$ and $R'_2$

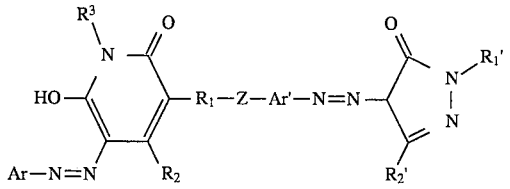

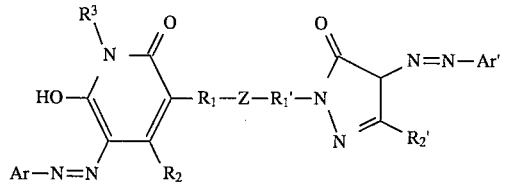

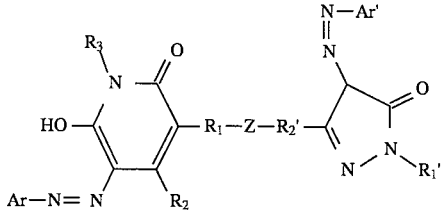

-continued

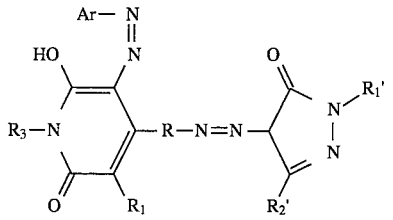

wherein R is a group that meets the definitions of both $R_2$ and Ar'

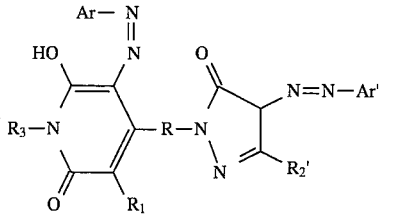

wherein R is a group that meets the definitions of both $R_2$ and $R'_1$

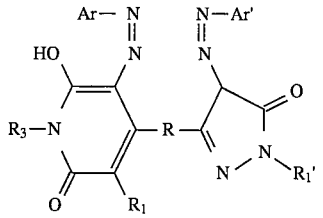

wherein R is a group that meets the definitions of both $R_2$ and $R'_2$

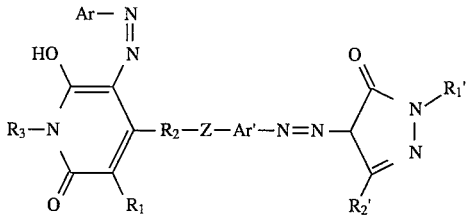

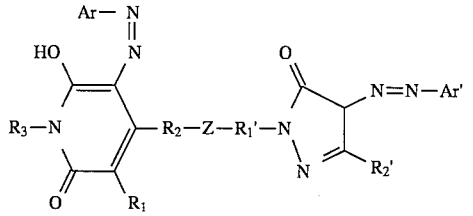

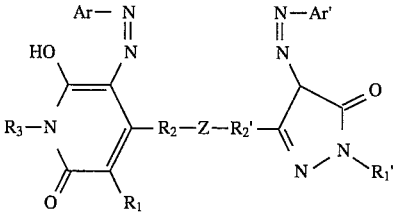

-continued

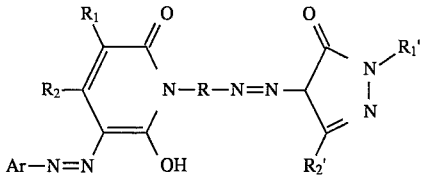

wherein R is a group that meets the definitions of both $R_3$ and Ar'

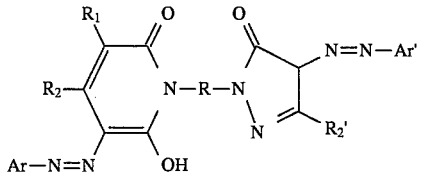

wherein R is a group that meets the definitions of both $R_3$ and $R'_1$

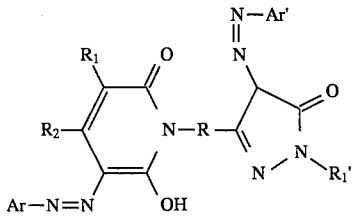

wherein R is a group that meets the definitions of both $R_3$ and $R'_2$

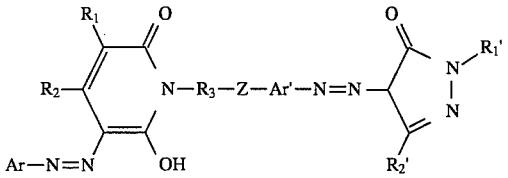

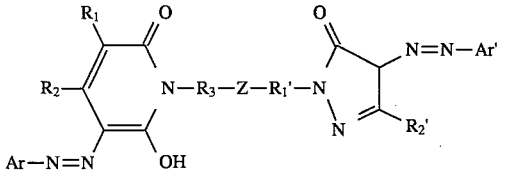

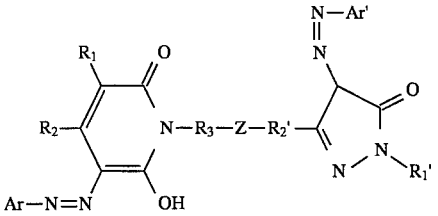

-continued

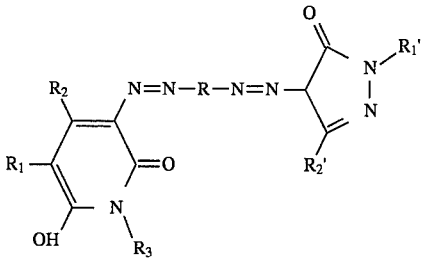

wherein R is a group that meets the definitions of both Ar and Ar'

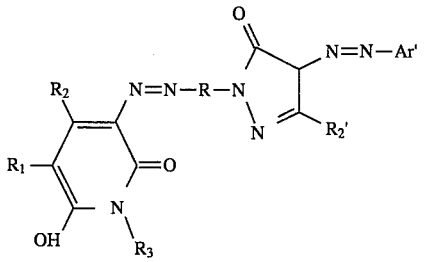

wherein R is a group that meets the definitions of both Ar and $R'_1$

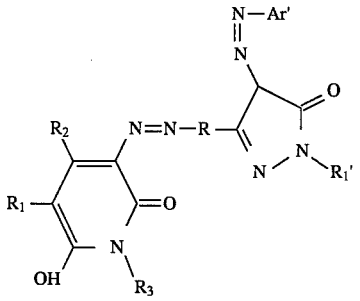

wherein R is a group that meets the definitions of both Ar and $R'_2$

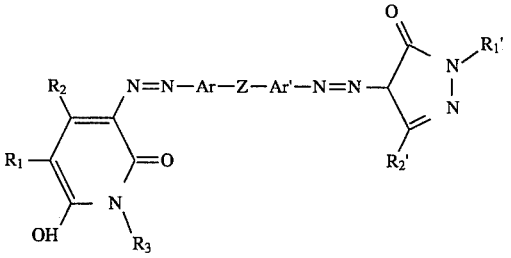

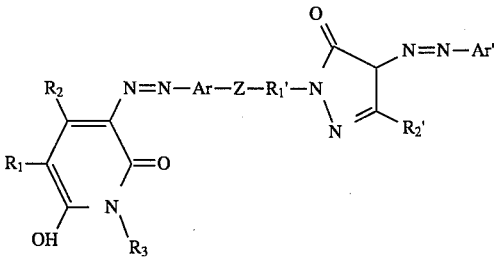

-continued

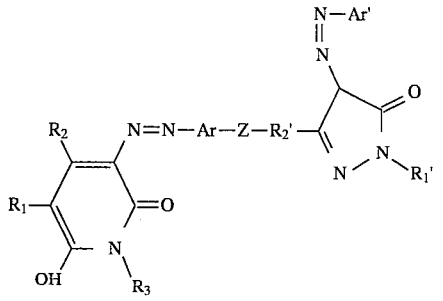

and (e) mixtures thereof, wherein the liquid developer has a resistivity of from about $10^8$ to about $10^{11}$ ohm-cm and a viscosity of from about 25 to about 500 centipoise.

11. A liquid developer composition for the development of electrostatic latent images which comprises a nonaqueous liquid vehicle, a charge control agent, and toner particles comprising a mixture of a resin and a colorant selected from the group consisting of: (a) dimeric compounds containing one moiety of Formula I

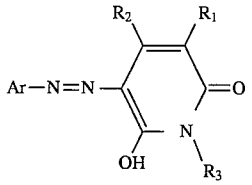

I wherein $R_1$ is an electron withdrawing group, $R_2$ is selected from the group consisting of hydrogen, alkyl, substituted alkyl, aryl, substituted aryl, arylalkyl, and substituted arylalkyl, $R_3$ is selected from the group consisting of hydrogen, alkyl, substituted alkyl, aryl, substituted aryl, arylalkyl, and substituted arylalkyl, and Ar is selected from the group consisting of aryl, substituted aryl, arylalkyl, and substituted arylalkyl, wherein the substituents on the substituted alkyl, substituted aryl, and substituted arylalkyl groups are selected from the group consisting of silyl groups, halide atoms, nitro groups, amine groups, hydroxy groups, alkoxy groups, ether groups, aldehyde groups, ketone groups, ester groups, amide groups, and carboxylic acid groups; and one moiety of Formula II

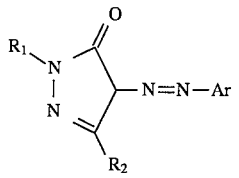

II wherein $R_1$ is selected from the group consisting of hydrogen, alkyl, substituted alkyl, aryl, substituted aryl, arylalkyl, and substituted arylalkyl, $R_2$ is selected from the group consisting of hydrogen, alkyl, substituted alkyl, aryl, substituted aryl, arylalkyl, and substituted arylalkyl, and Ar is selected from the group consisting of aryl, substituted aryl, arylalkyl, and substituted arylalkyl, wherein the substituents on the substituted alkyl, substituted aryl, and substituted arylalkyl groups are selected from the group consisting of silyl groups, halide atoms, nitro groups, amine groups, hydroxy groups, alkoxy groups, ether groups, aldehyde groups, ketone groups, ester groups, and carboxylic acid groups; (b) trimeric compounds containing three moieties of Formula I; (c) trimeric compounds containing two moieties of Formula I and one moiety of Formula II; (d) trimeric compounds containing one moiety of Formula I and two moieties of Formula II; and (e) mixtures thereof.

12. A liquid developer according to claim 11 wherein the colorant is present in the toner particles in an amount of from about 1 to about 30 percent by weight and the toner particles are present in the developer in an amount of from about 1 to about 50 percent by weight.

13. A liquid developer according to claim 11 wherein the colorant is present in the toner particles in an amount of from about 10 to about 25 percent by weight and the toner particles are present in the developer in an amount of from about 1 to about 7 percent by weight.

14. An imaging process which comprises generating an electrostatic latent image on an imaging member and developing the latent image by contacting the imaging member with a liquid developer according to claim 11.

15. A liquid developer composition for the development of electrostatic latent images which comprises a nonaqueous liquid vehicle, a charge control agent, and toner particles comprising a mixture of a resin and a colorant selected from the group consisting of: (a) the following formulae, wherein $R_1$ and $R'_1$ are each electron withdrawing groups, $R_2$ and $R'_2$ are each independently selected from the group consisting of hydrogen, alkyl, substituted alkyl, aryl, substituted aryl, arylalkyl, and substituted arylalkyl, $R_3$ and $R'_3$ are each independently selected from the group consisting of hydrogen, alkyl, substituted alkyl, aryl, substituted aryl, arylalkyl, and substituted arylalkyl, Ar and Ar' are each independently selected from the group consisting of aryl, substituted aryl, arylalkyl, and substituted arylalkyl, and X is selected from the group consisting of alkyl, substituted alkyl, aryl, substituted aryl, arylalkyl, and substituted arylalkyl, wherein the substituents on the substituted alkyl, substituted aryl, and substituted arylalkyl groups are selected from the group consisting of silyl groups, halide atoms, nitro groups, amine groups, hydroxy groups, alkoxy groups, ether groups, aldehyde groups, ketone groups, ester groups, amide groups, and carboxylic acid groups:

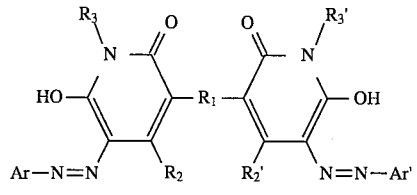

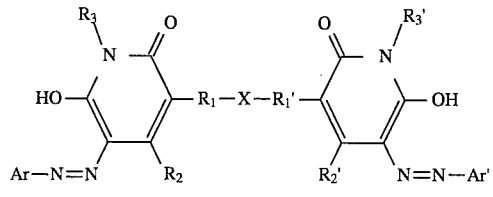

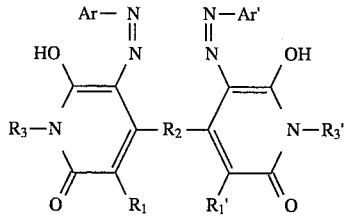

-continued
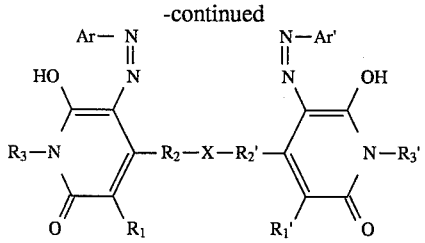
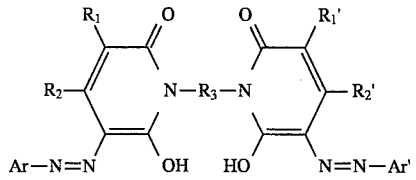
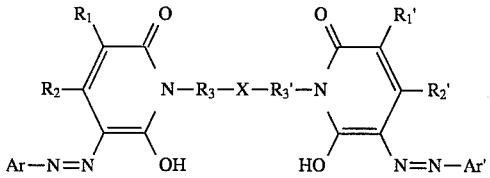
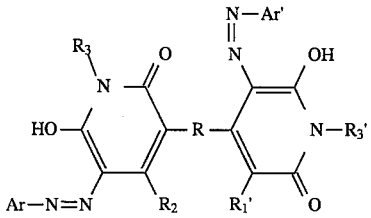
wherein R is a group that meets the definitions of both $R_1$ and $R'_2$
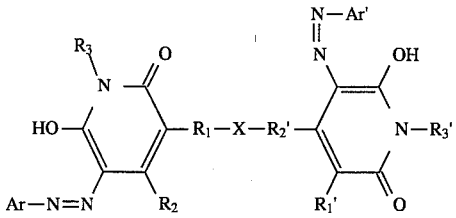
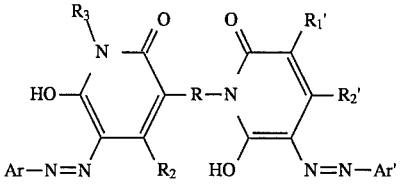
wherein R is a group that meets the definitions of both $R_1$ and $R'_3$
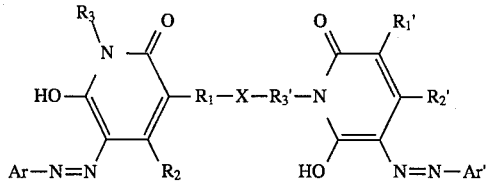
-continued
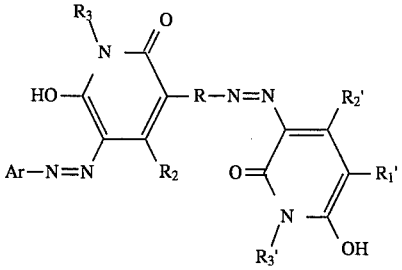
wherein R is a group that meets the definitions of both $R_1$ and Ar'
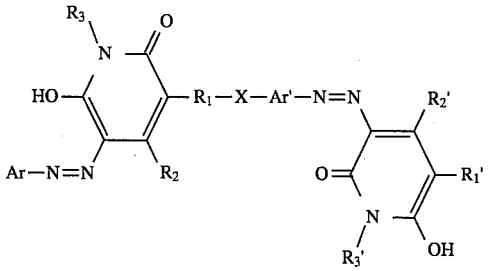
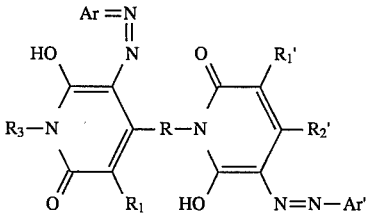
wherein R is a group that meets the definitions of both $R_2$ and $R'_3$
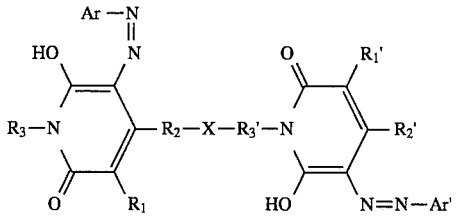
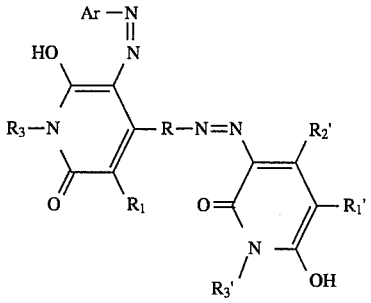
wherein R is a group that meets the definitions of both $R_2$ and Ar'

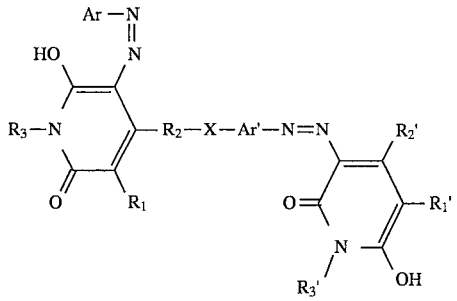

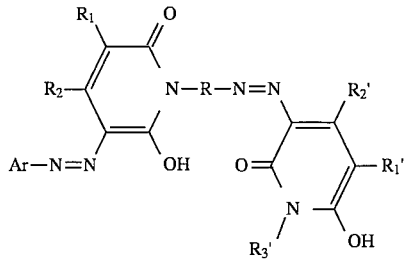

wherein R is a group that meets the definitions of both $R_3$ and Ar'

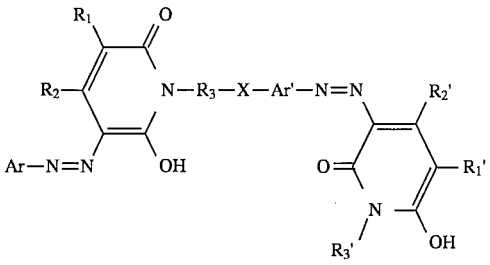

(b) those of the following formulae, wherein $R_1$ and $R'_1$ are each independently selected from the group consisting of hydrogen, alkyl, and substituted alkyl, $R_2$ and $R'_2$ are each independently selected from the group consisting of hydrogen, alkyl, substituted alkyl, aryl, substituted aryl, arylalkyl, and substituted arylalkyl, Ar and Ar' are each independently selected from the group consisting of aryl, substituted aryl, arylalkyl, and substituted arylalkyl, and Y is selected from the group consisting of alkyl, substituted alkyl, aryl, substituted aryl, arylalkyl, and substituted arylalkyl, wherein the substituents on the substituted alkyl, substituted aryl, and substituted arylalkyl groups are selected from the group consisting of silyl groups, halide atoms, nitro groups, amine groups, hydroxy groups, alkoxy groups, ether groups, aldehyde groups, ketone groups, ester groups, amide groups, and carboxylic acid groups:

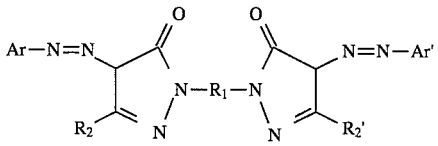

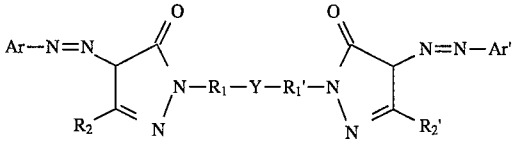

-continued

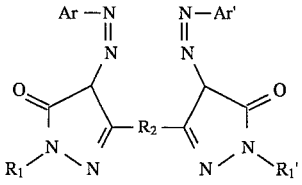

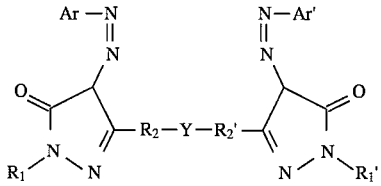

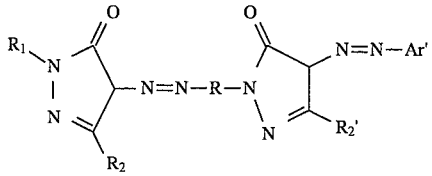

wherein R is a group that meets the definitions of both Ar and $R'_1$

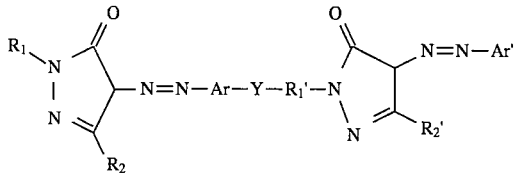

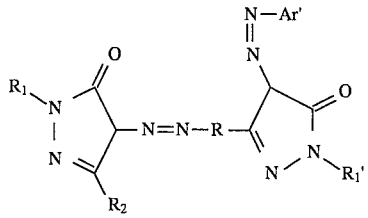

wherein R is a group that meets the definitions of both Ar and $R'_2$

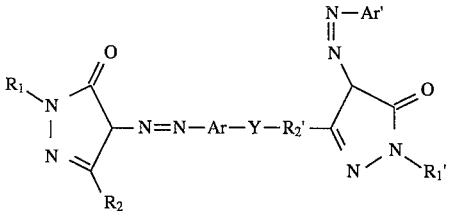

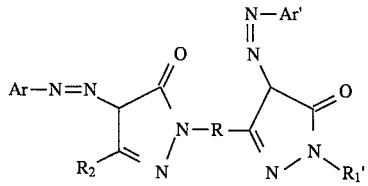

wherein R is a group that meets the definitions of both $R_1$ and $R'_2$

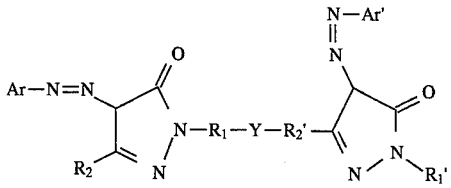

(c) those of the following formulae, wherein $R_1$ and $R'_1$ are each independently selected from the group consisting of hydrogen, alkyl, substituted alkyl, aryl, substituted aryl, arylalkyl, and substituted arylalkyl, $R_2$ and $R'_2$ are each independently selected from the group consisting of aryl, substituted aryl, arylalkyl, and substituted arylalkyl, Ar and Ar' are each independently selected from the group consisting of aryl, substituted aryl, arylalkyl, and substituted arylalkyl, and Y is selected from the group consisting of alkyl, substituted alkyl, aryl, substituted aryl, arylalkyl, and substituted arylalkyl, wherein the substituents on the substituted alkyl, substituted aryl, and substituted arylalkyl groups are selected from the group consisting of silyl groups, halide atoms, nitro groups, amine groups, hydroxy groups, alkoxy groups, ether groups, aldehyde groups, ketone groups, ester groups, and carboxylic acid groups:

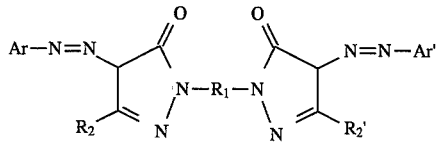

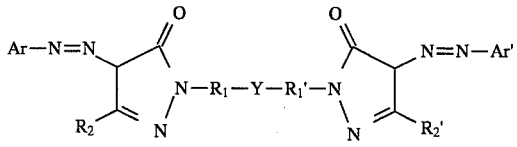

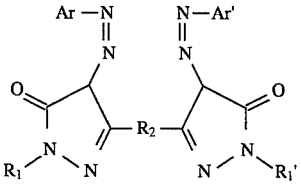

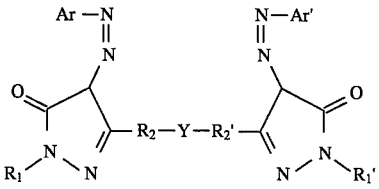

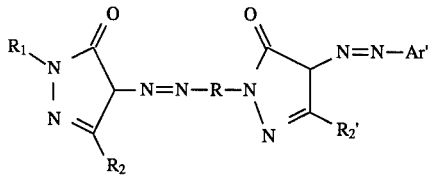

wherein R is a group that meets the definitions of both Ar and $R'_1$

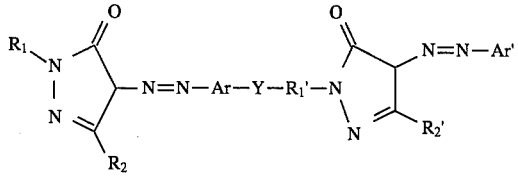

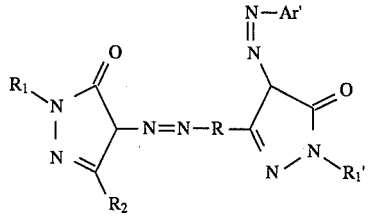

wherein R is a group that meets the definitions of both Ar and $R'_2$

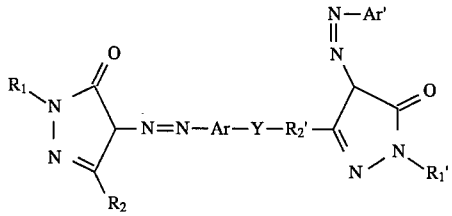

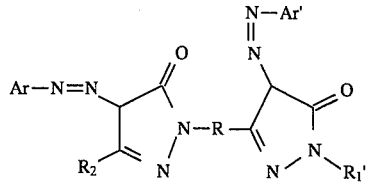

wherein R is a group that meets the definitions of both $R_1$ and $R'_2$

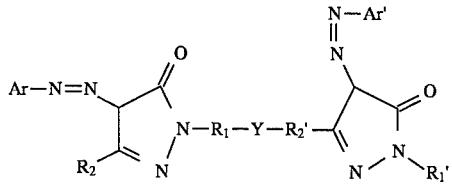

(d) those of the following formulae, wherein $R_1$ is an electron withdrawing group, $R_2$ is selected from the group consisting of hydrogen, alkyl, substituted alkyl, aryl, substituted aryl, arylalkyl, and substituted arylalkyl, R3 is selected from the group consisting of hydrogen, alkyl, substituted alkyl, aryl, substituted aryl, arylalkyl, and substituted arylalkyl, Ar is selected from the group consisting of aryl, substituted aryl, arylalkyl, and substituted arylalkyl, $R'_1$ is selected from the group consisting of hydrogen, alkyl, substituted alkyl, aryl, substituted aryl, arylalkyl, and substituted arylalkyl, $R'_2$ is selected from the group consisting of hydrogen, alkyl, substituted alkyl, aryl, substituted aryl, arylalkyl, and substituted arylalkyl, Ar' is selected from the group consisting of aryl, substituted aryl, arylalkyl, and substituted arylalkyl, and Z is selected from the group consisting of alkyl, substituted alkyl, aryl, substituted aryl, arylalkyl, and substituted arylalkyl, wherein the substituents on the substituted alkyl, substituted aryl, and substituted arylalkyl groups are selected from the group consisting of silyl groups, halide atoms, nitro groups, amine groups, hydroxy groups, alkoxy groups, ether groups, aldehyde groups, ketone groups, ester groups, amide groups, and carboxylic acid groups:

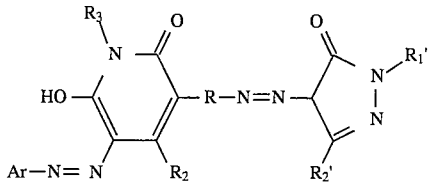

wherein R is a group that meets the definitions of both $R_1$ and Ar'

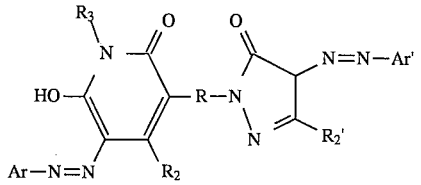

wherein R is a group that meets the definitions of both $R_1$ and $R'_1$

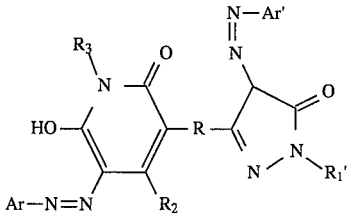

wherein R is a group that meets the definitions of both $R_1$ and $R'_2$

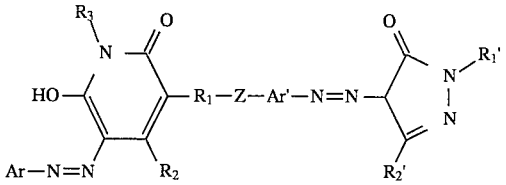

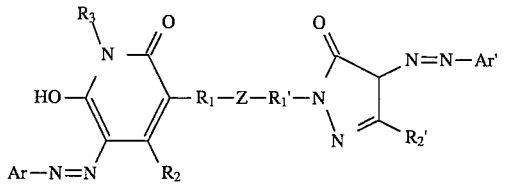

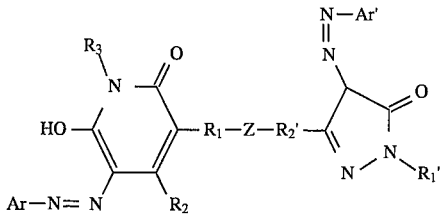

-continued

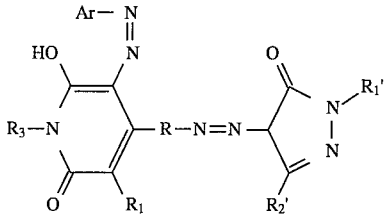

wherein R is a group that meets the definitions of both $R_2$ and Ar'

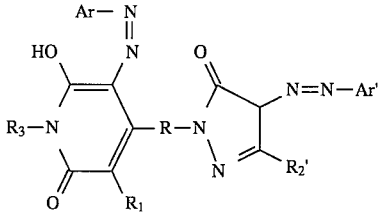

wherein R is a group that meets the definitions of both $R_2$ and $R'_1$

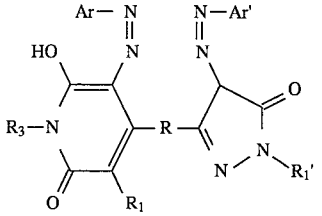

wherein R is a group that meets the definitions of both $R_2$ and $R'_2$

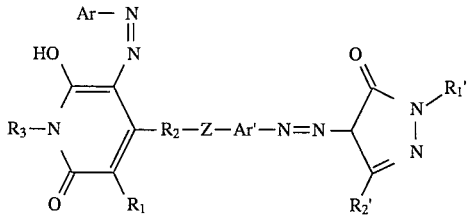

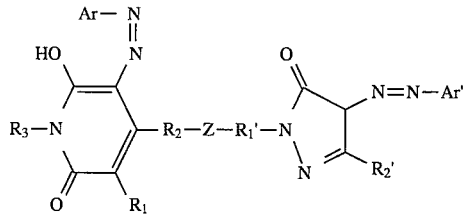

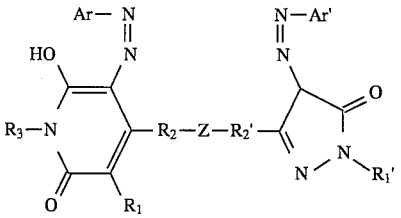

-continued

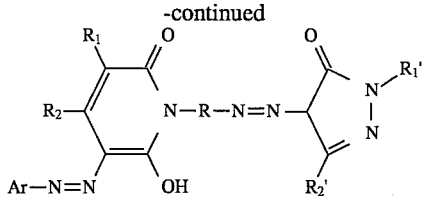

wherein R is a group that meets the definitions of both $R_3$ and Ar'

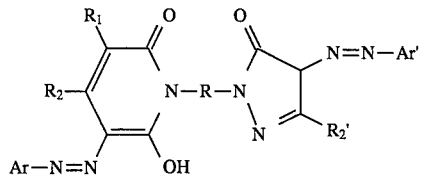

wherein R is a group that meets the definitions of both $R_3$ and $R'_1$

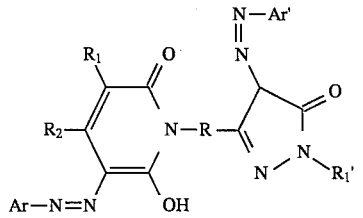

wherein R is a group that meets the definitions of both $R_3$ and $R'_2$

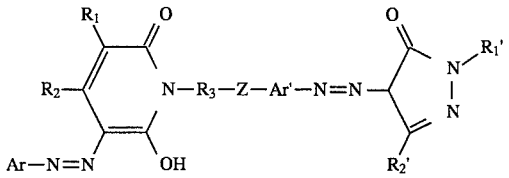

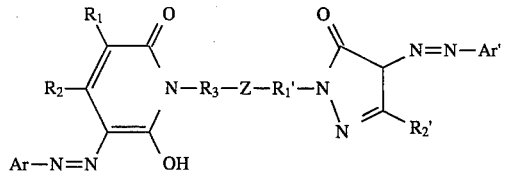

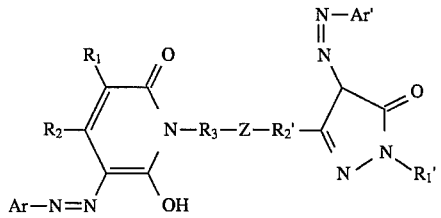

-continued

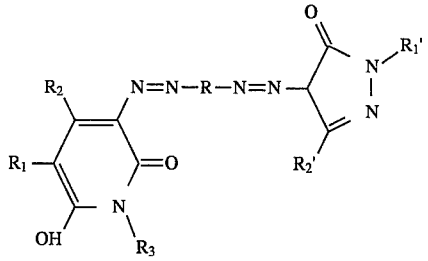

wherein R is a group that meets the definitions of both Ar and Ar'

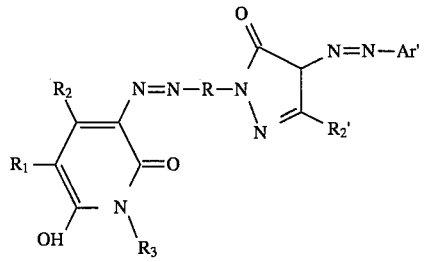

wherein R is a group that meets the definitions of both Ar and $R'_1$

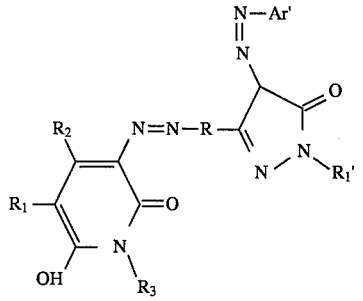

wherein R is a group that meets the definitions of both Ar and $R'_2$

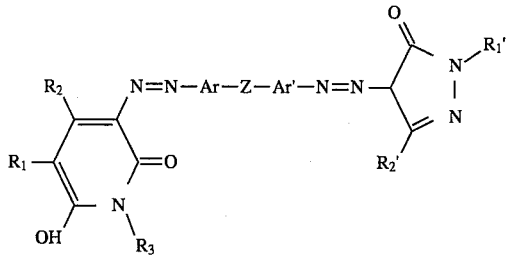

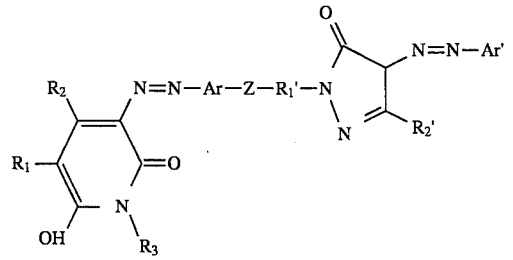

-continued
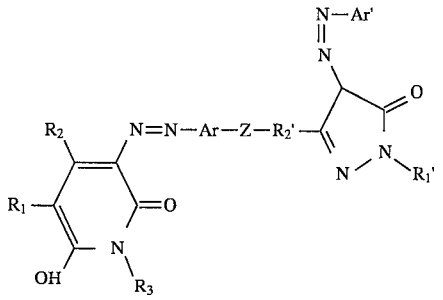
and (e) mixtures thereof.
16. A toner composition for the development of electrostatic latent images comprising particles comprising a mixture of a resin and a colorant selected from the group consisting of
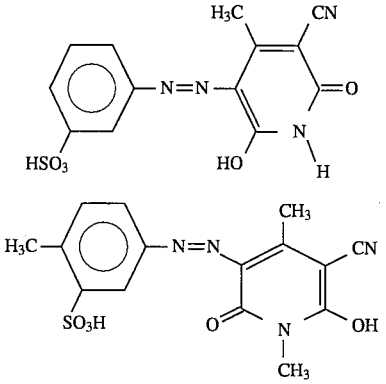
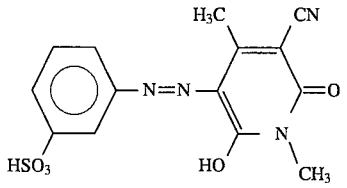
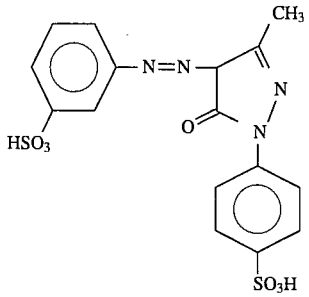
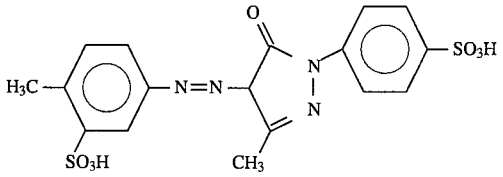
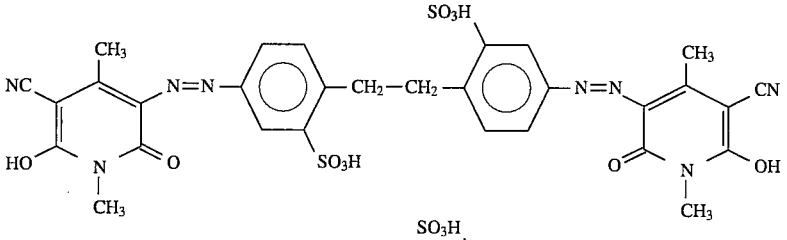
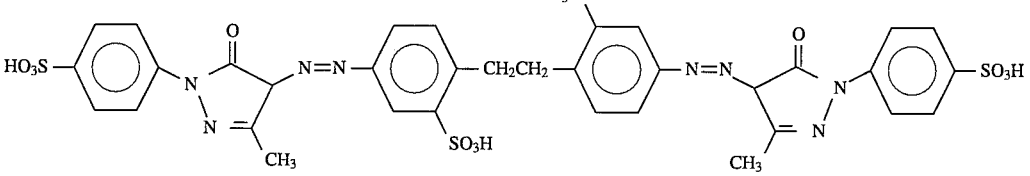

-continued
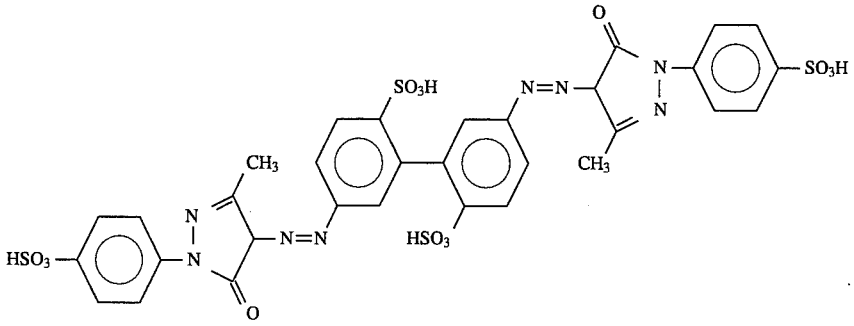
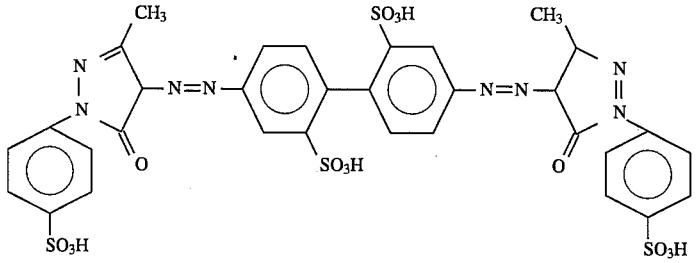
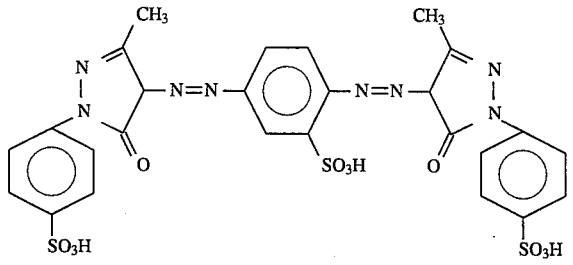
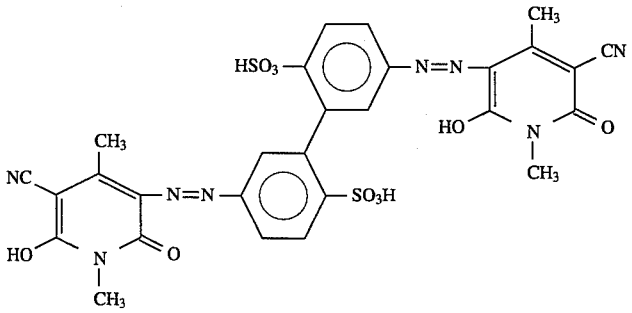
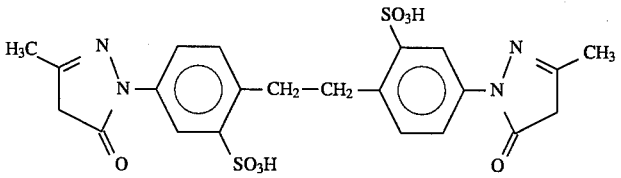
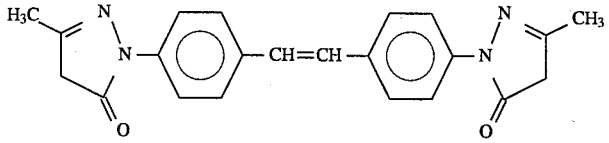

-continued
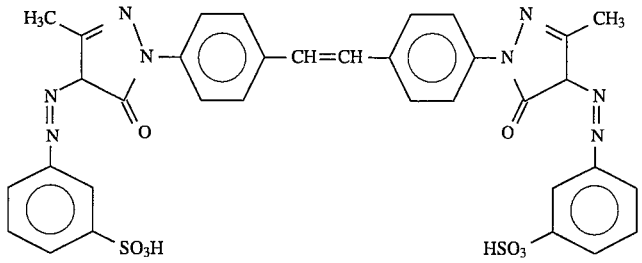
and mixtures thereof.
17. A liquid developer composition for the development of electrostatic latent images which comprises a nonaqueous liquid vehicle and a colorant selected from the group consisting of
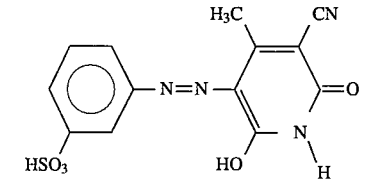
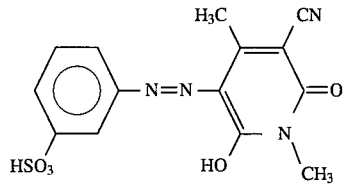
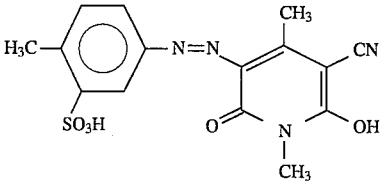
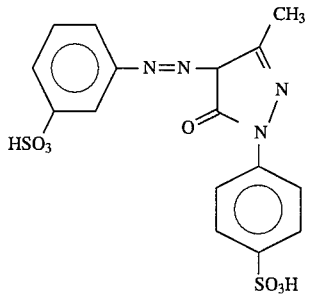
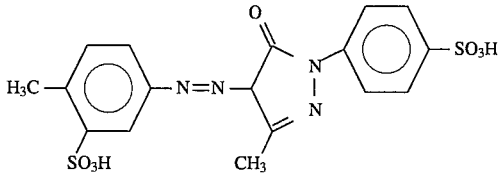
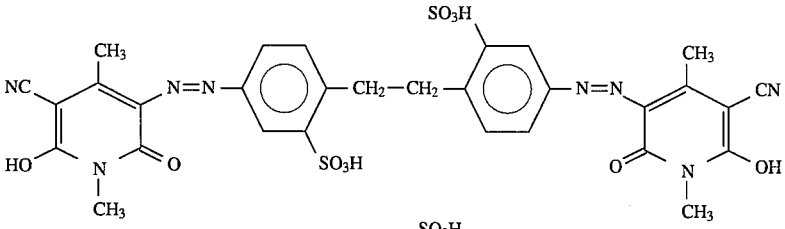
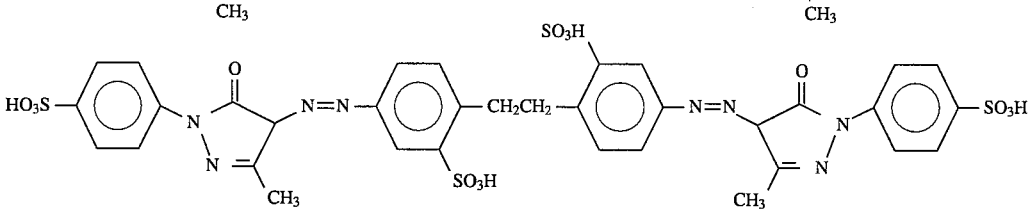

-continued
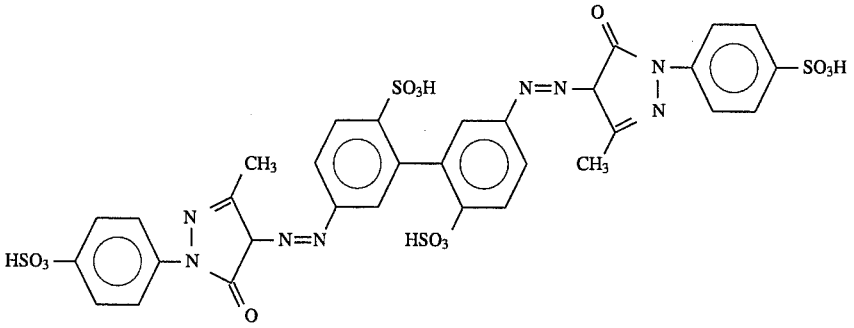
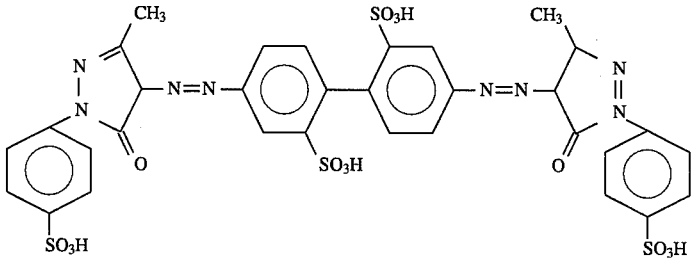
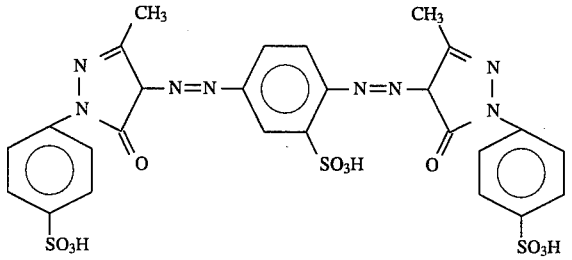
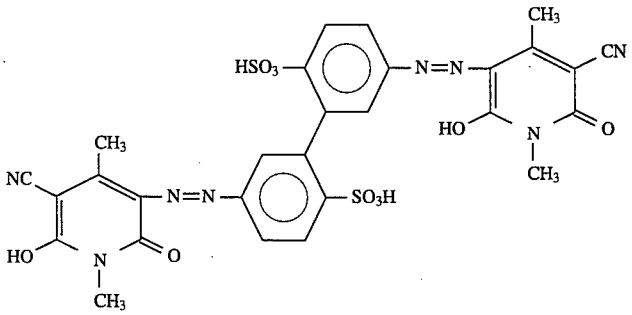
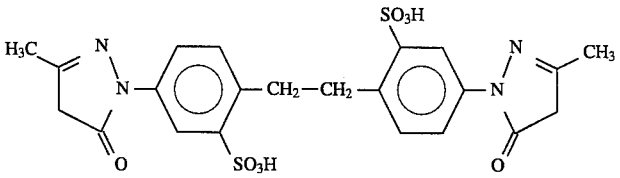
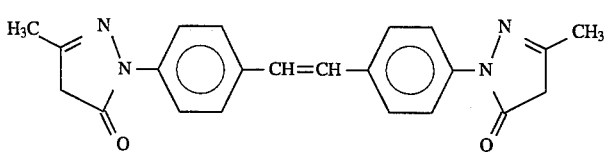

-continued

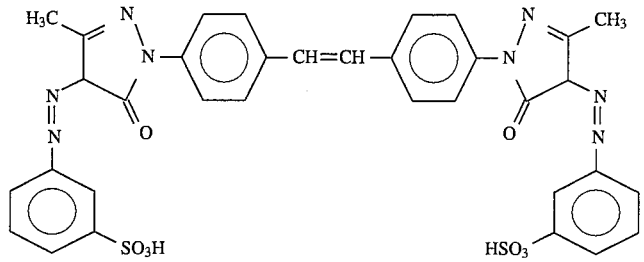

and mixtures thereof, wherein the liquid developer has a resistivity of from about $10^8$ to about $10^{11}$ ohm-cm and a viscosity of from about 25 to about 500 centipoise.

18. A liquid developer composition for the development of electrostatic latent images which comprises a nonaqueous liquid vehicle, a charge control agent, and toner particles comprising a mixture of a resin and a colorant selected from the group consisting of

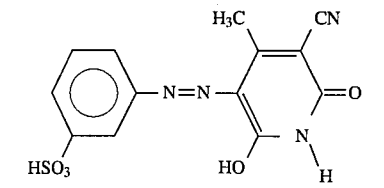

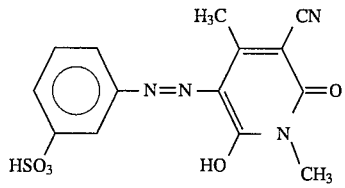

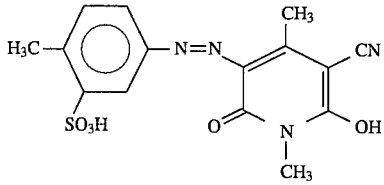

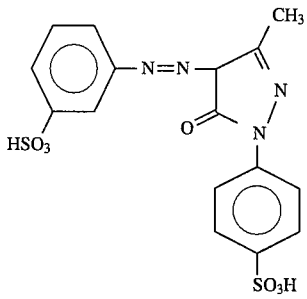

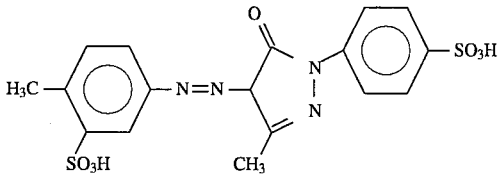

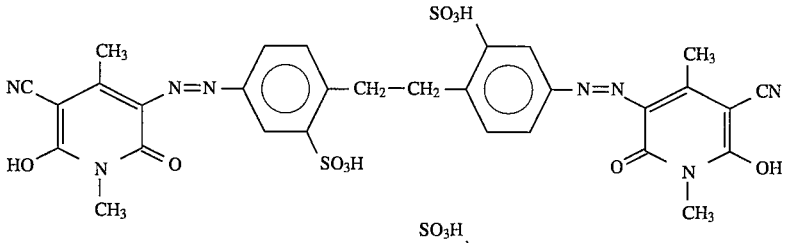

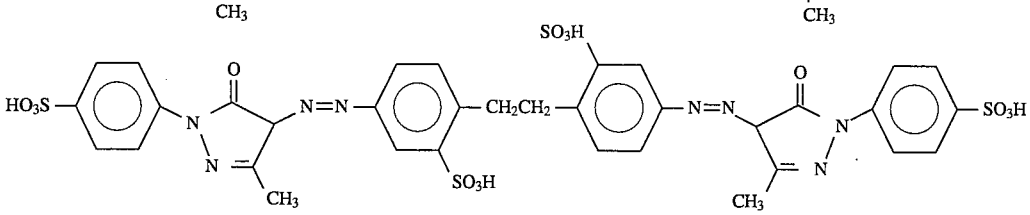

-continued
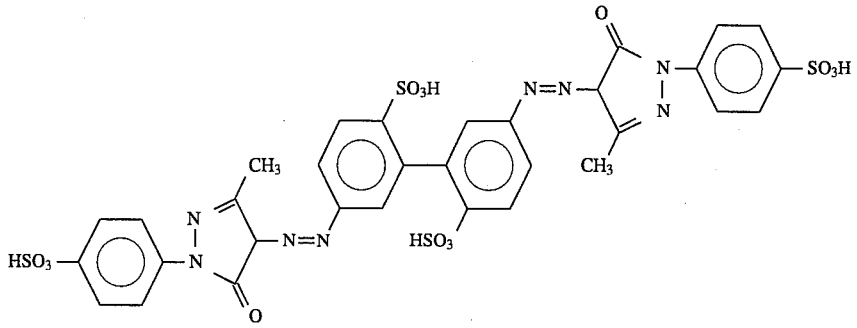
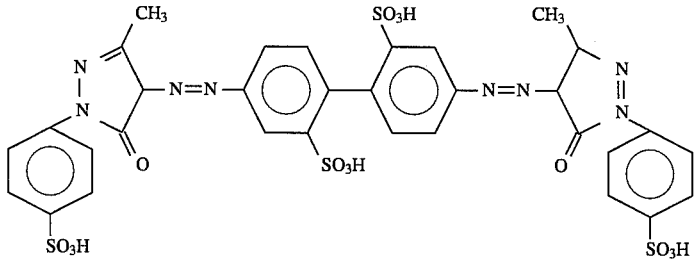
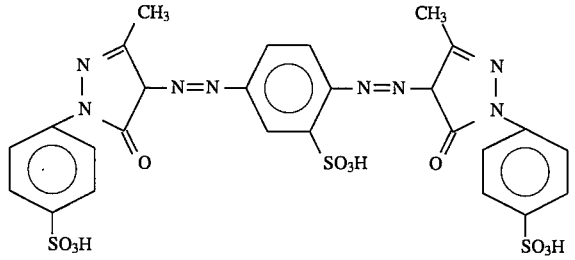
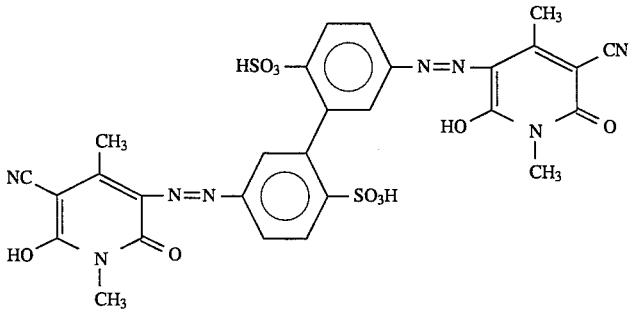
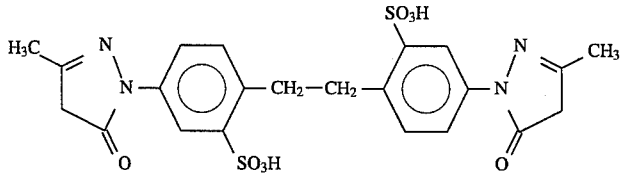
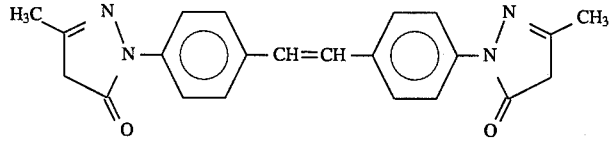

-continued
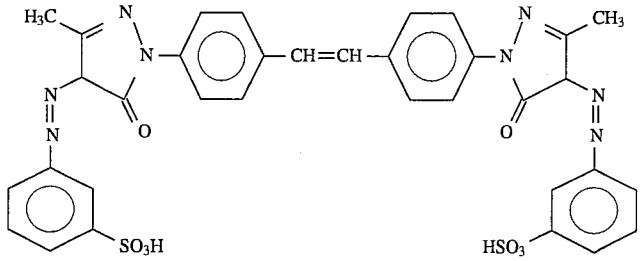
and mixtures thereof.
* * * * *